US012692866B2

(12) United States Patent
Seol et al.

(10) Patent No.: US 12,692,866 B2
(45) Date of Patent: Jul. 28, 2026

(54) COMPRESSOR

(71) Applicant: LG ELECTRONICS INC., Seoul (KR)

(72) Inventors: SeSeok Seol, Seoul (KR); Yunhi Lee, Seoul (KR); Seoung-Min Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 19/032,691

(22) Filed: Jan. 21, 2025

(65) Prior Publication Data

US 2025/0243862 A1 Jul. 31, 2025

(30) Foreign Application Priority Data

Jan. 26, 2024 (KR) ..... 10-2024-0012525

(51) Int. Cl.
*F04C 18/344* (2006.01)
*F04C 29/02* (2006.01)

(52) U.S. Cl.
CPC ..... *F04C 18/3448* (2013.01); *F04C 29/02* (2013.01); *F04C 2240/30* (2013.01); *F04C 2240/40* (2013.01); *F04C 2240/50* (2013.01)

(58) Field of Classification Search
CPC ..... F04C 18/0215; F04C 18/344; F04C 18/3448; F04C 29/02; F04C 2240/30; F04C 2240/40; F04C 2240/50
See application file for complete search history.

(56) References Cited

U.S. PATENT DOCUMENTS 11,454,240 B2 9/2022 Hu et al.
2016/0040672 A1* 2/2016 Lee ..... F04C 29/028 417/410.5

FOREIGN PATENT DOCUMENTS

| | | |
|---|---|---|
| CN | 214036114 | 8/2021 |
| CN | 218816989 | 4/2023 |
| JP | 2013-249737 | 12/2013 |
| KR | 10-2011-0015859 | 2/2011 |
| KR | 10-2447838 | 9/2022 |
| KR | 10-2454724 | 10/2022 |

OTHER PUBLICATIONS

Extended European Search Report dated May 27, 2025 issued in Application No. 25153216.4.
Korean Office Action issued in Application No. 10-2024-0012525 dated Oct. 2, 2025.

* cited by examiner

*Primary Examiner* — Loren C Edwards
(74) *Attorney, Agent, or Firm* — KED & ASSOCIATES

(57) ABSTRACT

A compressor may include a casing, and an electric drive that is disposed inside of the casing and rotate a rotational shaft. A compression portion may be disposed inside of the casing. The compression portion may include a cylinder, a main bearing, and a sub-bearing, which together define a compression space. The compressor may include at least one first oil drain portion recessed radially inward on one of an outer peripheral surface of the main bearing or the cylinder, which has a relatively smaller diameter. The compressor may further include at least one second oil drain portion formed by penetrating, in an axial direction, a remaining one of the main bearing or the cylinder, which has a relatively larger diameter.

30 Claims, 32 Drawing Sheets

COMPRESSOR

CROSS-REFERENCE TO RELATED APPLICATION(S)

This application claims priority under 35 U.S.C. § 119 to Korean Application No. 10-2024-0012525, filed in Korea on Jan. 26, 2024, whose entire disclosure is hereby incorporated by reference.

BACKGROUND

1. Field

A compressor is disclosed herein.

2. Background

Generally, compressors refer to mechanical devices used for generating high pressure or transporting high pressure fluid. A compressor which is applied to a refrigeration cycle of refrigerators and air conditioners compresses a refrigerant and transmits the compressed refrigerant to a condenser. The compressor may be classified as a reciprocating compressor, a rotary compressor, or a scroll compressor depending on a method of compressing the refrigerant.

The rotary compressor may be classified into a method in which vanes are slidably inserted into a cylinder and are in contact with a roller, and a method in which vanes are slidably inserted into the roller and are in contact with the cylinder. Generally, the former is referred to as a "roller eccentric rotary compressor" (hereinafter, referred to as a "rotary compressor"), and the latter is referred to as a "vane concentric rotary compressor" (hereinafter. referred to as a "vane rotary compressor").

In the vane rotary compressor, while vanes inserted into the roller rotate together with the roller, the vanes are pulled toward the cylinder by centrifugal force and back pressure, and are in contact with an inner surface of the cylinder. In the vane rotary compressor, compression chambers corresponding to the number of vanes per rotation of the roller are formed in succession, and each of the compression chambers sequentially performs suction, compression, and discharge operations. Accordingly, the vane rotary compressor may have a higher compression ratio than the rotary compressor.

In the rotary compressor, a main bearing and a sub-bearing may be disposed at upper and lower portions, respectively, based on the cylinder. The main bearing and the sub-bearing, together with the cylinder, form a compression part or portion, and compression chambers in which the roller is disposed are formed inside of the compression portion. The main bearing and the sub-bearing may each support a rotational shaft so that the rotational shaft rotates stably.

The rotary compressor uses oil to lubricate components thereof. After the oil has performed the function of lubricating the compression portion, the oil is collected in a lower portion of the compressor. During the compression process of the compression portion, oil sprayed into an upper space or oil included in gaseous refrigerant may be recovered by gravity into an oil storage space formed in the lower portion of the compressor. For oil recovery, an oil drain hole through which oil passes may be formed through the main bearing.

In Korean Patent No. 10-2447838 (hereinafter "Patent Document 1"), which is hereby incorporated by reference, structure in which an oil drain hole is formed and oil is recovered is disclosed. In Patent Document 1, the oil drain hole is formed on an edge of the main bearing, and a cylinder with a diameter smaller than a diameter of the main bearing is placed at a lower side of the main bearing. Accordingly, oil passing through the oil drain hole may pass between an outer surface of the cylinder and an inner surface of the compressor and may be collected in the lower portion of the compressor.

Recently, there is a trend to apply an eco-friendly refrigerant to a compressor. However, the eco-friendly refrigerant has low-density characteristics, so in order to implement a same performance as existing compressors, a compression chamber is required to be made larger. If only the size of the compression chamber is increased while the size of the compressor is maintained, the cylinder becomes larger, and diameters of the main bearing, the sub-bearing, and the cylinder become similar to each other. Accordingly, a gap between outer peripheral surfaces of the main bearing, the sub-bearing, and the cylinder and an inner peripheral surface of a casing becomes narrow overall, so that sufficient passages for oil recovery cannot be formed.

In particular, oil recovery paths formed on edges of the main bearing, the sub-bearing, and the cylinder, which have similar diameters, may interfere with each other. For example, when a component (the main bearing or the cylinder) disposed on or at an upper or lower side of the oil drain hole covers the oil drain hole, interference with the oil recovery paths may occur. When the oil recovery paths interfere with each other, oil cannot be smoothly collected to the lower side through the oil recovery paths.

In this case, oil may not move downward and may stagnate at an upper portion of the compression portion, or between the compression portion and the casing. When the oil is not recovered, the amount of oil supplied to the compression portion decreases, which causes problems, such as friction loss or wear of the compression portion. In addition, when the oil is not re-collected at a lower portion of the compressor, the oil may mix with refrigerant discharged from the compressor and be discharged outside of the compressor together with the refrigerant, which may cause an oil shortage inside of the compressor.

To solve this problem, an oil recovery path may be disposed at a center of the compression portion rather than at the edge of the compression portion. In each of Chinese Utility Model Application Publication No. CN218816989U (hereinafter "Patent Document 2"), Chinese Utility Model Application Publication No. CN214036114U (hereinafter "Patent Document 3"), and U.S. Pat. No. 11,454,240 (hereinafter "Patent Document 4"), which are hereby incorporated by reference, a compressor is disclosed in which an oil recovery path is formed in components forming a compression portion. The compressor of Patent Document 2 to Patent Document 4 has structure in which an oil recovery path that penetrates a bearing (a flange) in an axial direction is formed, and oil is recovered to the lower portion of the compressor through the oil recovery path.

However, in Patent Document 2 to Patent Document 4, as the oil recovery path is formed by penetrating the compression portion at a location close to the center of the compression portion, care must be taken to ensure that the oil recovery path does not interfere with a compression chamber provided at the center of the compression portion. Accordingly, the size of the compression chamber is limited, thereby reducing compression performance and complicating the structure of the oil recovery path.

BRIEF DESCRIPTION OF THE DRAWINGS

Embodiments will be described in detail with reference to the following drawings in which like reference numerals refer to like elements, and wherein.

DETAILED DESCRIPTION

Figure 1:
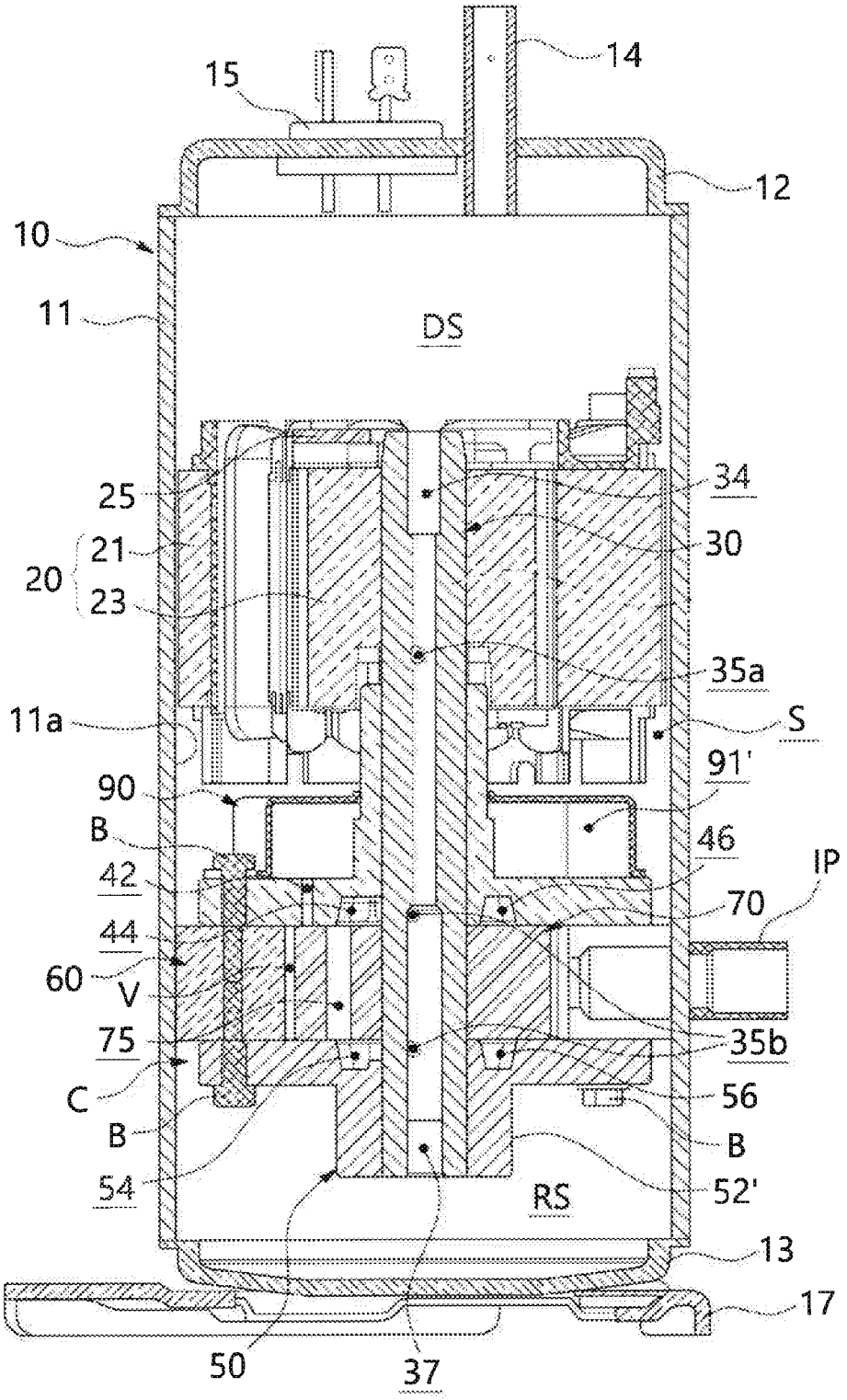
FIG. 1 is a cross-sectional view of a compressor according to an embodiment.

Hereinafter, embodiments are described with reference to exemplary drawings. When giving reference numerals to components in each drawing, it should be noted that identical components are given the same reference numerals as much as possible even if they are shown in different drawings. In addition, when explaining the embodiments disclosed herein, if description of the related known configuration or function is determined to hinder understanding of the embodiments disclosed herein, description thereof has been omitted.

A compressor according to an embodiment may include a casing 10, an electric drive unit (electric drive) 20, a rotational shaft 30, and a compression part or portion C. A main bearing 40, a sub-bearing 50, and a cylinder 60 forming the compression portion C may be stacked on each other. Hereinafter, the compressor in which the compression portion C is disposed under the electric drive unit 20 is described as an example.

The casing 10 may form an exterior of the compressor. The casing 10 may be classified into a vertical casing or a horizontal casing depending on an installation type of the compressor. The vertical casing 10 may have structure in which the electric drive unit 20 and the compression portion C are disposed on or at upper and lower sides along an axial direction, and the horizontal casing 10 may have structure in which the electric drive unit 20 and the compression portion C are disposed on or at left and right or lateral sides. The casing 10 according to this embodiment is described as the vertical casing 10 as an example.

The casing 10 may include a cylindrical body shell 11 that is open at a top and bottom thereof. An open upper portion of the body shell 11 of the casing 10 may be closed by an upper shell 12. A discharge space DS into which compressed refrigerant flows may be defined under the upper shell 12. A downward open portion of the body shell 11 may be closed by a lower shell 13. The body shell 11 may be regarded as an intermediate shell.

The electric drive unit 20 and the compression portion C may be fixed inside of the body shell 11. The body shell 11 may be provided with an intake pipe IP. The intake pipe IP may include an inlet through which refrigerant is introduced. The intake pipe IP may be directly connected to the compression portion C. This structure will be discussed hereinafter.

The upper shell 12 may be provided with a discharge tube 14 that discharges refrigerant to the outside. The discharge tube 14 may be connected to a pipe (not shown) through which refrigerant is delivered to a condenser (not shown) of a refrigeration cycle.

A cluster 15 that transmits external power to the electric drive unit 20 may be disposed in the upper shell 12. The cluster 15 may be regarded as a kind of connector. When an external connector (not shown) is coupled to the cluster 15, external power may be transmitted to the electric drive unit 20 via a wire (not shown). For another example, the cluster 15 may be disposed in the body shell 11 rather than the upper shell 12. Reference numeral 17 indicates a support plate that supports the compressor.

The electric drive unit 20 may be disposed inside of the casing 10. The electric drive unit 20, which generates a rotational force, may rotate the rotational shaft 30. In this embodiment, the electric drive unit 20 is positioned at a side relatively higher than the compression portion C, but alternatively, the compression portion C may be positioned at a side higher than the electric drive unit 20. The electric drive unit 20 may include a stator 21 and a rotor 23 and 25.

The rotor 23 and 25 of the electric drive unit 20 may include rotor core 23 and coil 25. The stator 21 may have a cylindrical shape and may be fixed to an inner peripheral surface 11*a* of the body shell 11 by, for example, hot pressing. The coil 25 may be wound around the rotor core 23 and may be electrically connected to an external power source through the cluster 15, which is coupled thereto through the body shell 11.

The rotational shaft 30 may be rotatably supported by the main bearing 40 and the sub-bearing 50. The main bearing 40 and the sub-bearing 50 may be stacked on upper and lower portions of the cylinder 60, respectively. The sub-bearing 50 and the cylinder 60 may be fixed inside of the casing 10 through the main bearing 40. The main bearing 40 and the sub-bearing 50 are distinguished for convenience, and the main bearing 40 and the sub-bearing 50 may be referred to as a first bearing and a second bearing, respectively. Structure of the main bearing 40 and the sub-bearing 50 will be described hereinafter. For reference, an axial direction hereinafter refers to a longitudinal direction of the rotational shaft 30 (a vertical direction based on FIG. 1).

An oil flow path 34 may be formed at the center of a rotational shaft 30 along the axial direction of the rotational shaft 30. Oil may be stored in an oil storage space RS provided on an inner bottom of the casing 10, and the stored oil may be transferred upward through the oil flow path 34 provided in the rotational shaft 30. The transferred oil may be provided to each component to perform a lubricating function.

As illustrated in FIG. 1, in or at a middle of the oil flow path 34, an oil through hole 35*a* and 35*b* may be formed in a radial direction of the rotational shaft 30. In this embodiment, the oil through hole 35*a* and 35*b* may include first oil through hole 35*a* and second oil through hole 35*b*. The first oil through hole 35*a* may be connected to the electric drive unit 20, and the second oil through hole 35*b* may be connected to the main bearing 40 and the sub-bearing 50. The second oil through hole 35*b* may include two second oil through holes 35*b* at different heights, wherein the two second oil through holes 35*b* may be connected to the main bearing 40 and the sub-bearing 50, respectively.

An oil pickup 37 may be installed in or at a middle or a bottom of the oil flow path 34. A gear pump, a viscous pump, and a centrifugal pump, for example, may be applied as the oil pickup 37. This embodiment illustrates an example in which the centrifugal pump is applied. When the rotational shaft 30 rotates, oil filled in the oil storage space RS of the casing 10 may be pumped by the oil pickup 37, and the pumped oil may rise along the oil flow path 34 and may be supplied to the sub-bearing 50 and the main bearing 40 through the second oil through hole 35*b* to facilitate the rotation of the rotational shaft 30. The oil that continues to rise may be supplied to the electric drive unit 20 through the first oil through hole 35*a*.

Figure 2:
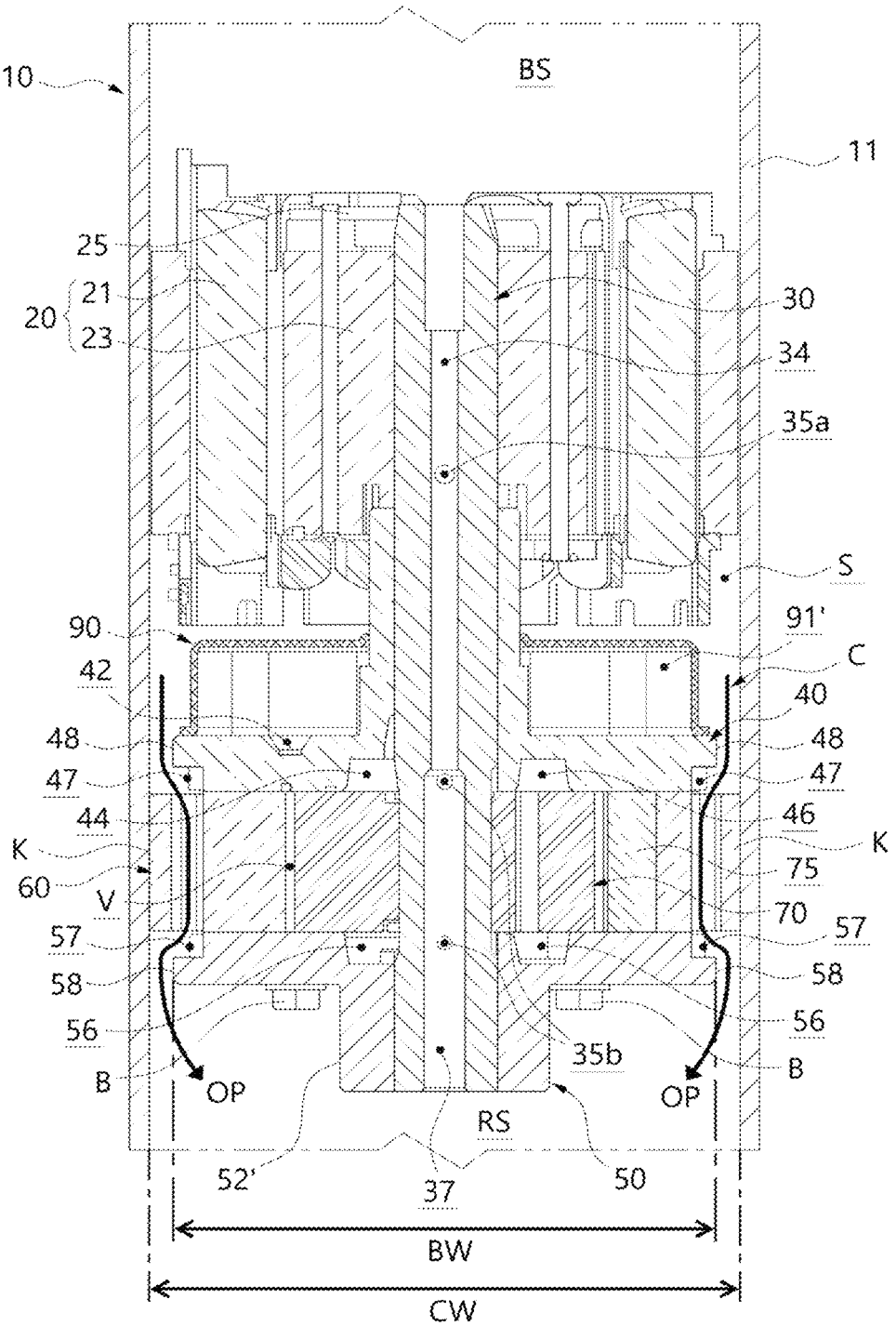
FIG. 2 is a cross-sectional view of an electric drive unit and a compression portion of the compressor of FIG. 1.

Next, as shown in FIG. 2, the compression portion C may include the cylinder 60 disposed in a center thereof, the main bearing 40 and the sub-bearing 50 disposed at the upper and lower portions of the cylinder 60, respectively, and a roller 70 disposed in the center of the cylinder 60. The cylinder 60 and the main bearing 40 and the sub-bearing 50 may be coupled with each other to form a compression space V at components facing each other.

The roller 70 may be rotatably installed in the compression space V, and vanes 75*a*, 75*b*, and 75*c* (75) may be slidably inserted into the roller 70 to divide the compression space V into a plurality of compression chambers V1, V2, and V3 (V). The roller 70 may be surrounded by the cylinder 60, the main bearing 40, and the sub-bearing 50, and may not be exposed to an outside of the compression portion C. The roller 70 will be described hereinafter.

Any one of the main bearing 40, the sub-bearing 50, or the cylinder 60 may be fixedly installed on the body shell 11. In this embodiment, the cylinder 60 may be fixed to the inner peripheral surface 11*a* of the body shell 11. For example, the cylinder 60 may be inserted into the body shell 11 and welded thereto.

Figure 13:
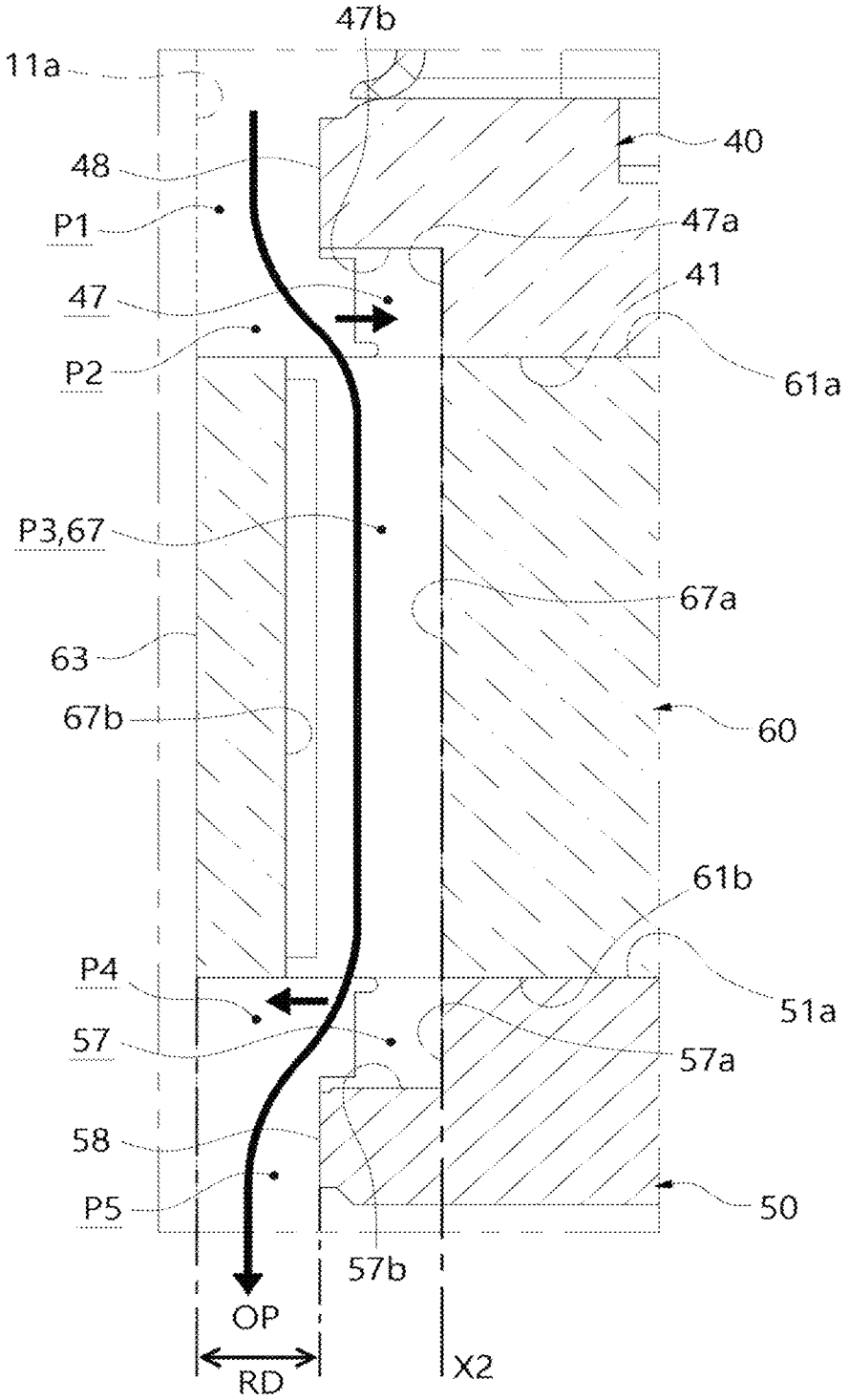
FIG. 13 is an enlarged view of portion A3 of FIG. 12.

As illustrated in FIG. 2, in this embodiment, an outer diameter of the cylinder 60, or an inner diameter CW of the body shell 11 is larger than each of an outer diameter of the main bearing 40 and an outer diameter BW of the sub-bearing 50. Accordingly, an outer peripheral surface 63 of the cylinder 60 may be in contact with the inner peripheral surface 11*a* of the body shell 11, but the outer peripheral surface 43 of the main bearing 40 and an outer peripheral surface 53 of the sub-bearing 50 may be spaced apart from the inner peripheral surface 11*a* of the body shell 11. In this way, a portion at which each of an outer peripheral surface 43 of the main bearing 40 and the outer peripheral surface 53 of the sub-bearing 50 is spaced apart from the inner peripheral surface 11*a* of the body shell 11, may form a portion of an oil drain path OP described hereinafter. Referring to FIG. 13, reference numeral RD indicates a difference between the outer diameter of the cylinder 60, the outer diameter of the main bearing 40, and the outer diameter of the sub-bearing 50.

Figure 3:
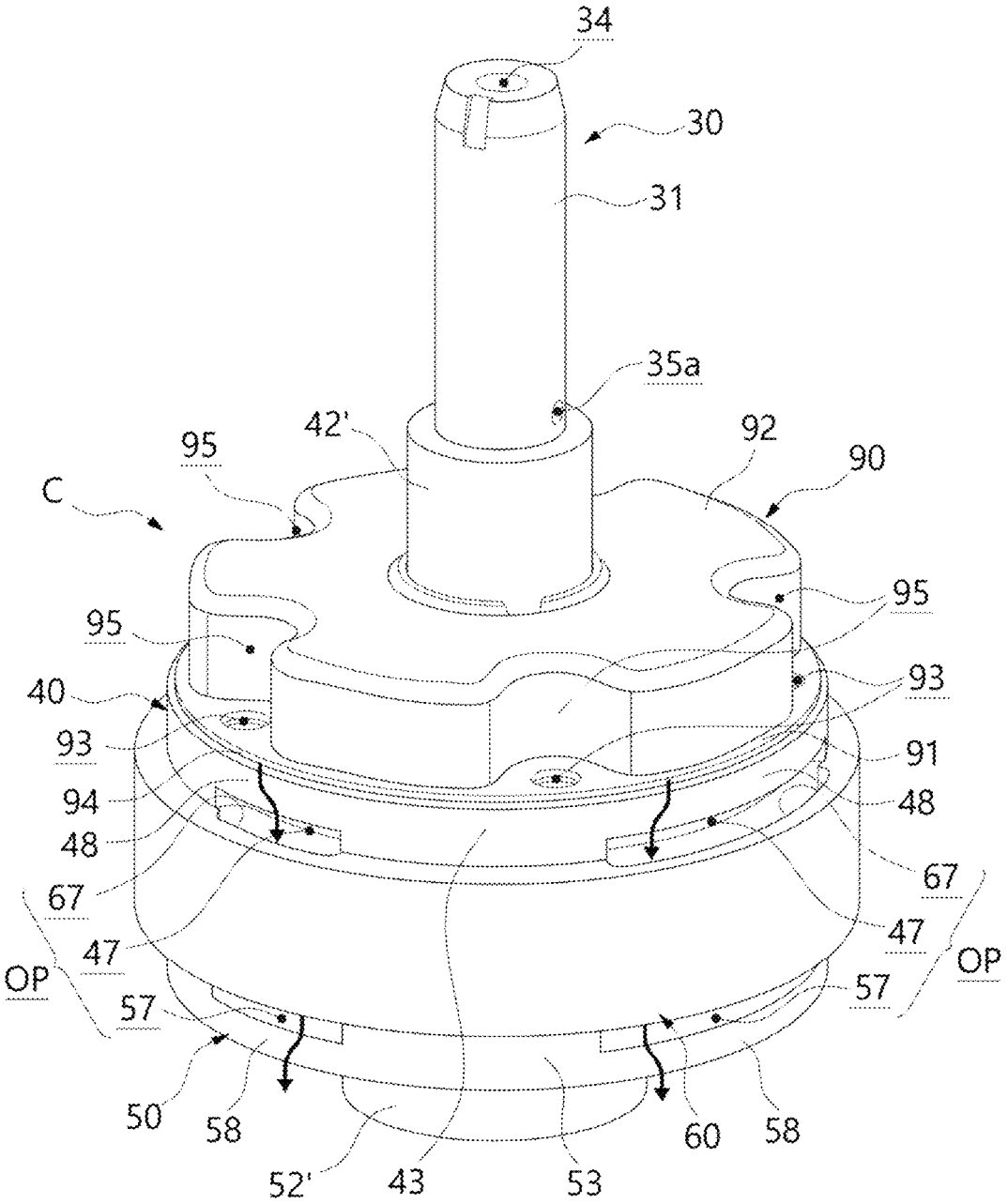
FIG. 3 is a perspective view of the compression portion of FIG. 1.
Figure 4:
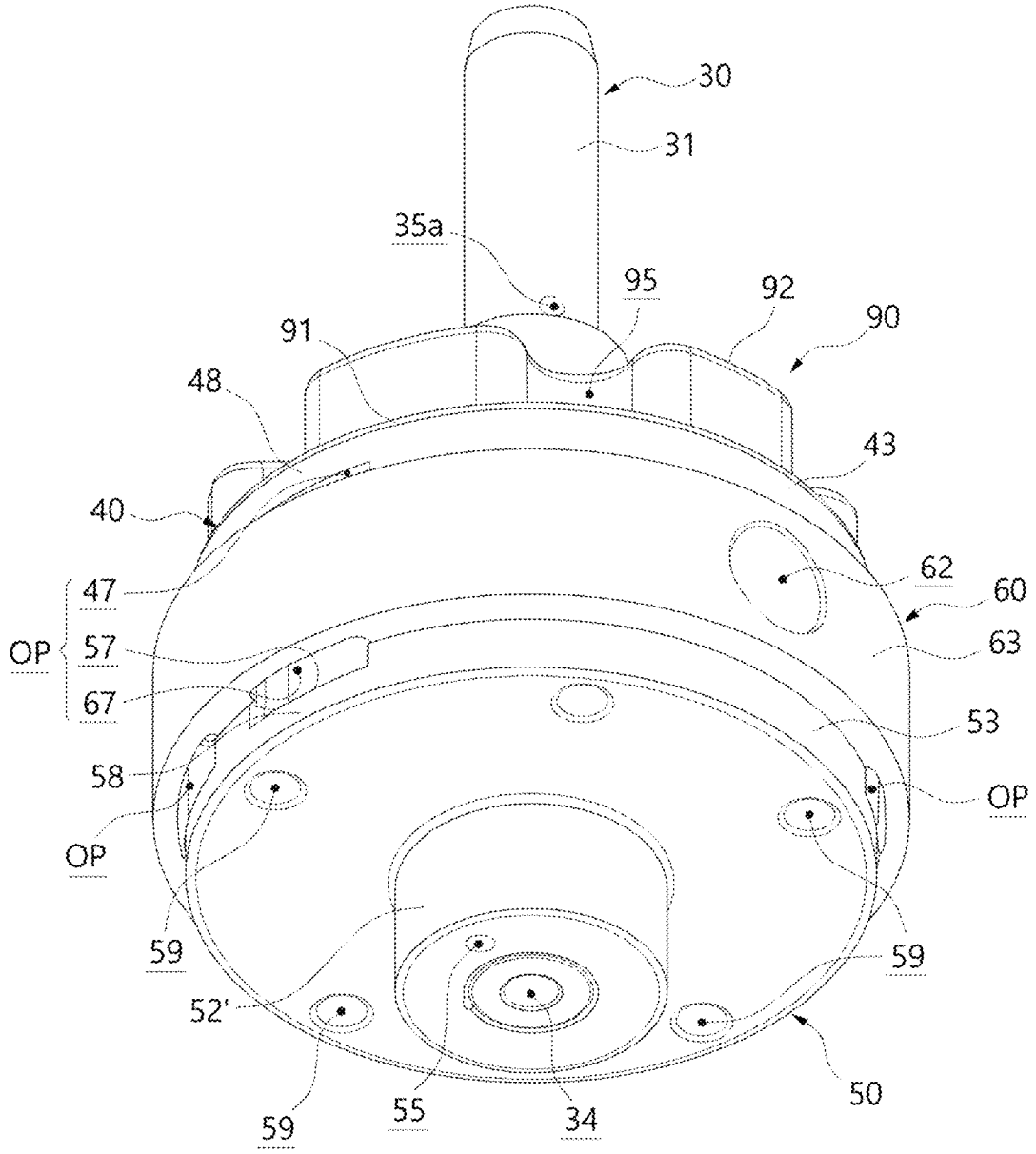
FIG. 4 is a perspective view of the compression portion of FIG. 1 when viewed at an angle different from an angle in FIG. 3.

Referring to FIGS. 2 and 3, the oil drain path OP may be formed in the compression portion C. The oil drain path OP may be an oil movement path, or more specifically, a path through which oil having completed a lubricating function is recovered to the oil storage space RS. The oil drain path OP may be formed along an edge of the compression portion C. The term "edge" refers to an outer portion of the compression portion C close to the inner peripheral surface 11*a* of the body shell 11. Accordingly, oil may move along the edge of the compression portion C through the oil drain path OP. In FIG. 2, a direction in which oil is recovered along a continuous passage created by the oil drain path OP is represented by an arrow.

The oil drain path OP may pass through the main bearing 40, the sub-bearing 50, and the cylinder 60 forming the compression portion C. The oil drain path OP may be formed in each of the main bearing 40, the sub-bearing 50, and the cylinder 60, and each path may be connected to each other to form one oil movement path. This structure will be described hereinafter.

Figure 5:
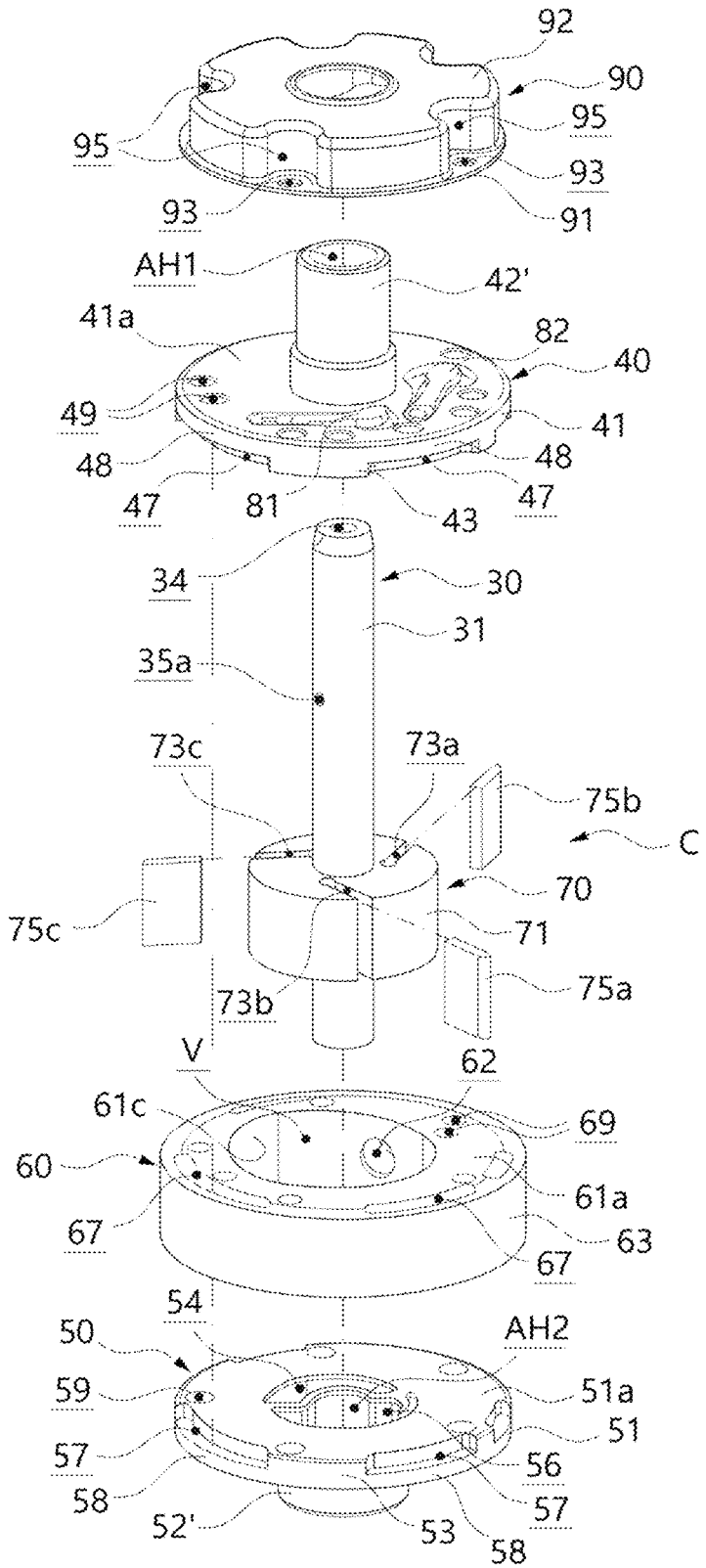
FIG. 5 is an exploded perspective view of the compression portion of FIG. 1.
Figure 6:
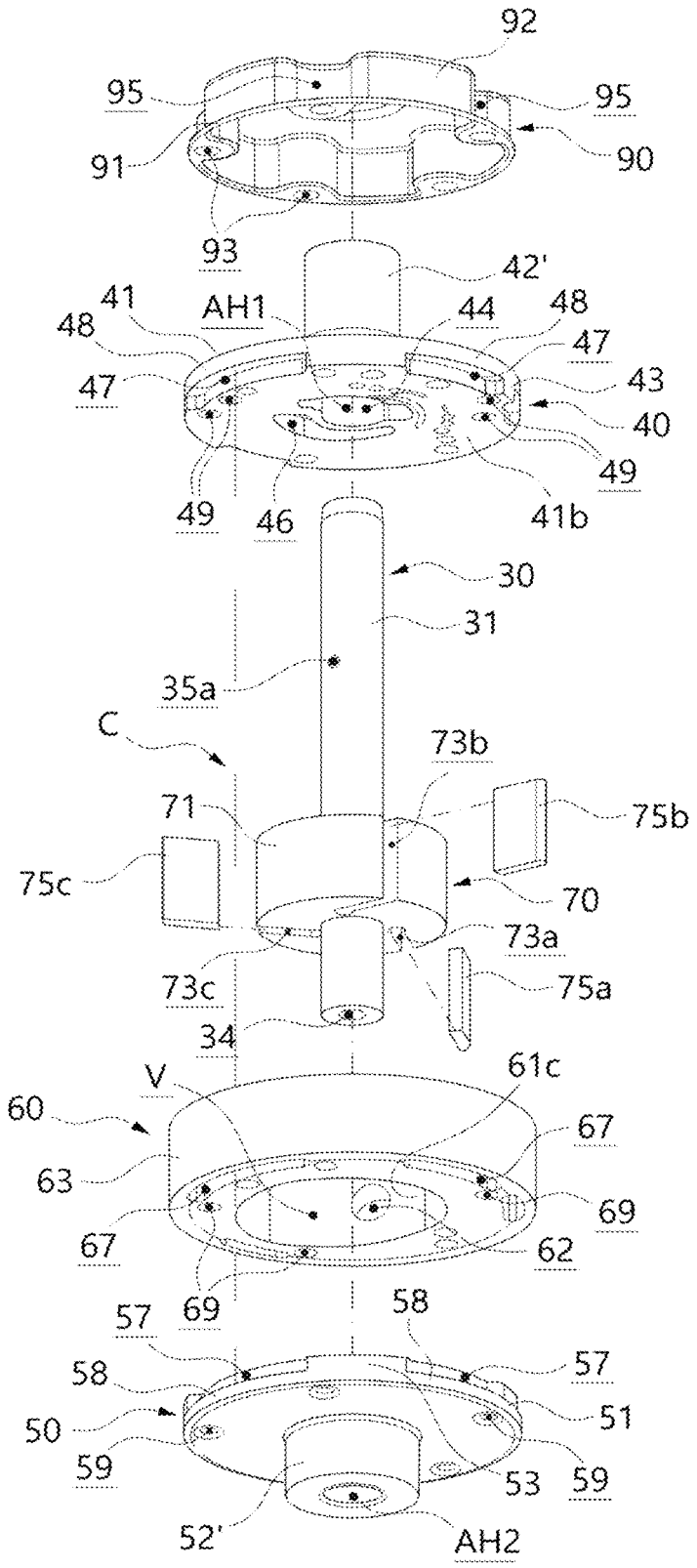
FIG. 6 is an exploded perspective view of the compression portion of FIG. 1 when viewed at an angle different from an angle in FIG. 5.

First, taking a close look at the main bearing 40 forming the compression portion C with reference to FIGS. 5 and 6, a lower surface 41*b* of the main bearing 40 may be disposed to face an upper surface 61*a* of the cylinder 60. The lower surface 41*b* of the main bearing 40 may cover an upper portion of the compression space V1, V2, and V3 formed through the cylinder 60 to form an upper surface of the compression space V1, V2, and V3. Main back pressure pockets 44 and 46 may be recessed on the lower surface 41*b* of the main bearing 40 toward the cylinder 60 to provide back pressure to rear end portions of the vanes 75*a*, 75*b*, and 75*c*. Sub-back pressure pockets 54 and 56 may be depressed on an upper surface 51*a* of the sub-bearing 50 toward the cylinder 60 to provide back pressure to the rear end portions of the vanes 75*a*, 75*b*, and 75*c*.

In this embodiment, the main bearing 40 may (i) rotatably support the rotational shaft 30, (ii) cover the upper side of the compression space V formed through the cylinder 60, (iii) discharge refrigerant compressed in the compression space V, (iv) include the main back pressure pockets 44 and 46 that provides back pressure to the rear end portions of the vanes 75*a*, 75*b*, and 75*c*.

The main back pressure pockets 44 and 46 may be referred to as the main back pressure pockets 44 and 46 to be distinguished from the sub-back pressure pockets 54 and 56 of the sub-bearing 50 described hereinafter. Alternatively, the main back pressure pockets 44 and 46 and the sub-back pressure pockets 54 and 56 may all be referred to as "back pressure pockets". In addition, the first main back pressure pocket 44 and the second main back pressure pocket 46 may be referred to as "first pocket" 46 and "second pocket" 56, respectively. The first sub-back pressure pocket 54 and the second sub-back pressure pocket 56 may be referred to as "first pocket" 46 and "second pocket" 56, respectively. This structure will be described hereinafter.

With reference to FIG. 5, discharge valve 81 and 82 may be provided on upper surface 41*a* of the main bearing 40. The discharge valve 81 and 82 may serve to open and close a discharge port 42 formed in the main bearing 40. The discharge valve 81 and 82 may include a plurality of discharge valves. In this embodiment, the discharge valve 81 and 82 includes first discharge valve 81 and second discharge valve 82. The first discharge valve 81 may open and close first discharge port 42*a*, which will be described hereinafter, and the second discharge valve 82 may open and close a second discharge port 42*b*. The first discharge valve 81 and the second discharge valve 82 may be disposed to be spaced apart from each other along a circumferential direction of the main bearing 40.

The first discharge valve 81 may include a first retainer 81*a* (see FIG. 12), a first valve plate 81*c* (see FIG. 12), and a first valve fastening hole (not shown) into which a fastener is inserted. Although not shown, the second discharge valve 82, like the first discharge valve 81, may include a second retainer, a second valve plate, and a second valve fastening hole into which a fastener is inserted. For another example, when the discharge port 42*a* and 42*b* is formed on the side of the main bearing 40, the discharge valve 81 and 82 may be provided on the side of the main bearing 40. This valve structure is common, and thus, description thereof has been omitted.

Figure 8:
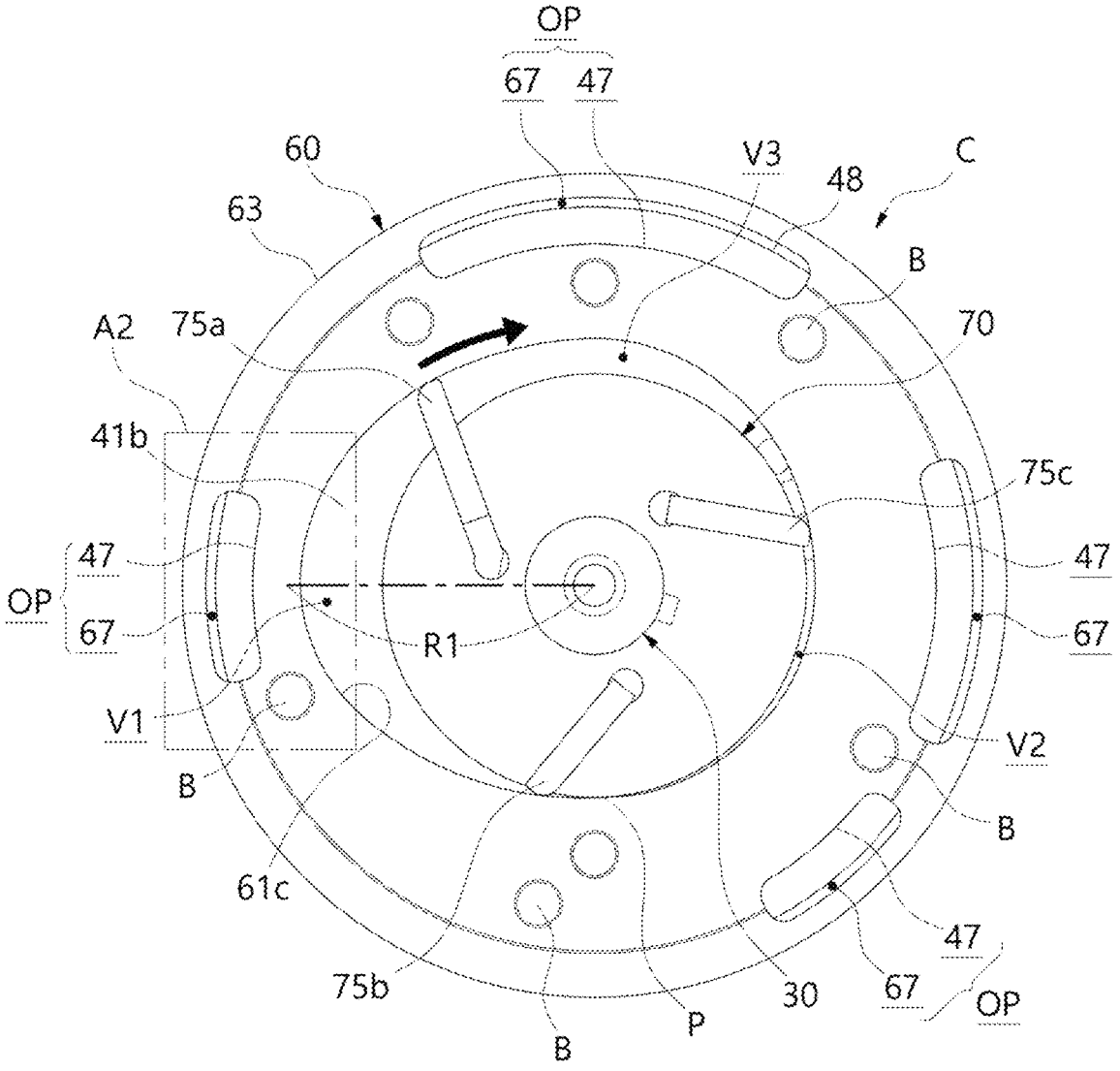
FIG. 8 is a bottom view of a compression space with a sub-bearing of the compression portion removed according to an embodiment.

When the above main bearing 40 is disassembled, the compression space V may be exposed. Referring to FIG. 8, the compression space V may be divided into the plurality of compression chambers V1, V2, and V3 by the plurality of vanes 75*a*, 75*b*, and 75*c*. When the plurality of vanes 75*a*, 75*b*, and 75*c* rotate, the compression of refrigerant may occur in the compression chambers V1, V2, and V3. This process will be described hereinafter.

Figure 7:
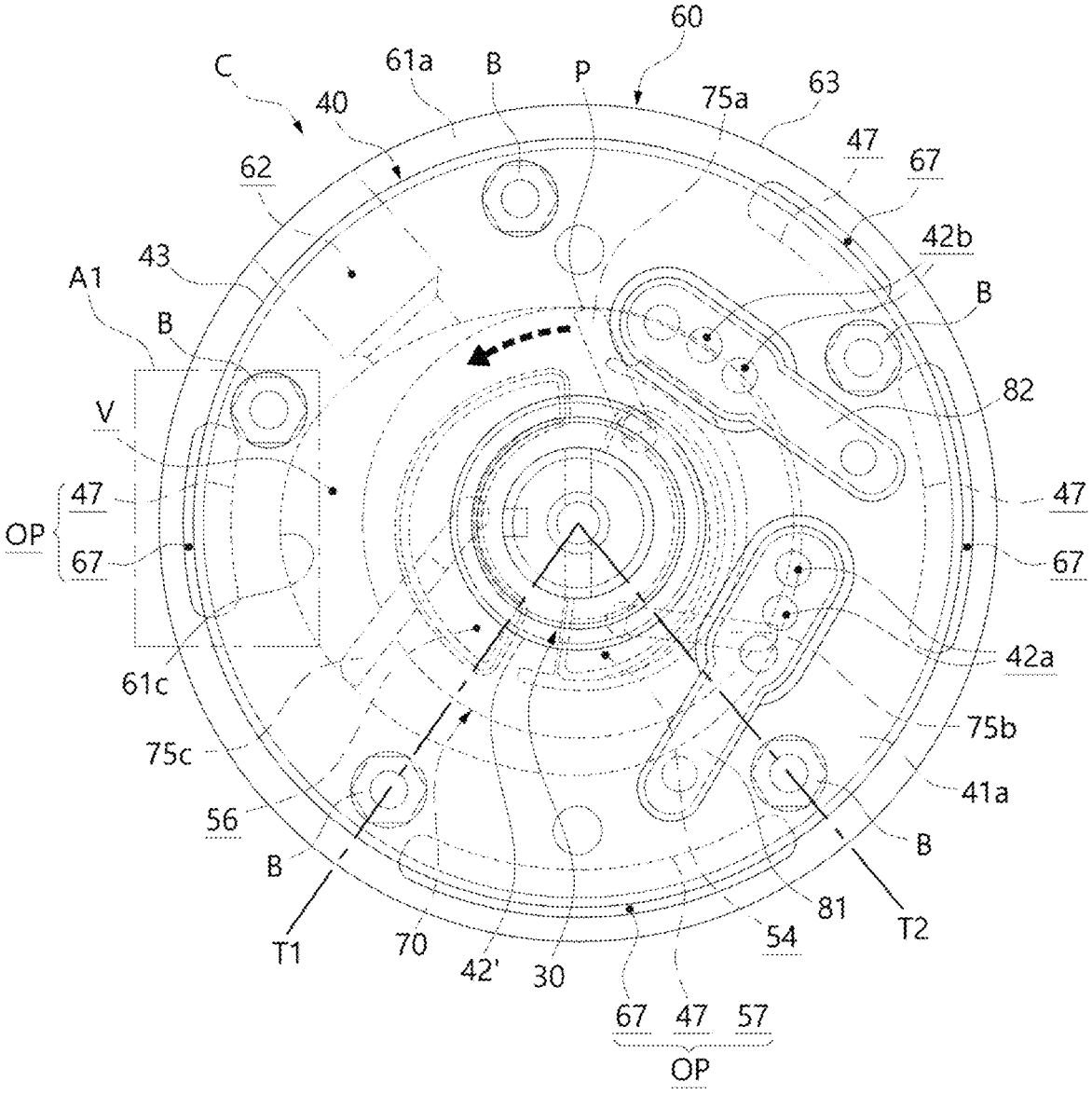
FIG. 7 is a plan view showing internal structure of the compression portion of FIG. 1.

Referring to FIG. 7, the discharge ports 42*a* and 42*b* may be formed by penetrating the main bearing 40 in the axial direction. The axial direction refers to the longitudinal direction of the rotational shaft 30, that is, the vertical direction in FIG. 1. In this embodiment, the discharge port 42*a* and 42*b* may include a plurality of discharge ports. The discharge port 42*a* and 42*b* may include first discharge port 42*a* and second discharge port 42*b*. The first discharge port 42*a* may include a plurality of first discharge ports 42*a*. The plurality of first discharge ports 42*a* may be arranged circumferentially around the rotational shaft 30, which is arranged at a center of the main bearing 40. The second discharge port 42*b* may also include a plurality of second discharge ports 42*b*. The plurality of second discharge ports 42*b* may be arranged circumferentially around the rotational shaft 30, which is arranged at the center of the main bearing 40. For another example, the discharge ports 42*a* and 42*b* may include the first discharge port 42*a*. For reference, in FIG. 1, two discharge ports 42*a* and 42*b* are not distinguished, but are expressed as one discharge port 42.

Referring back to FIG. 5, a main bush part or portion 42' may be provided at the center of the main bearing 40. The main bush portion 42 may be provided in a cylindrical shape at the center of the main bearing 40 and may surround the rotational shaft 30. A first shaft support hole AH1 may be formed at the center of the main bush portion 42'. The main bush portion 42', together with a sub-bush portion 52' described hereinafter, may surround and fix the rotational shaft 30 at different heights so that the rotational shaft 30 is rotatable.

Referring to FIG. 6, the main bearing 40 may include the main back pressure pockets 44 and 46 formed therein. The main back pressure pockets 44 and 46 may increase a pressure of back pressure chambers formed at one end of vane slots 73*a*, 73*b*, and 73*c*, thereby providing back pressure to the vanes 75*a*, 75*b*, and 75*c* in directions protruding from the vane slots 73*a*, 73*b*, and 73*c*. The main back pressure pockets 44 and 46 may include the main back pressure pockets 44 and 46 separated along the circumferential direction of the main bearing 40. The plurality of main back pressure pockets 44 and 46 may have internal pressures different from each other.

The main back pressure pockets 44 and 46 are named differently to be distinguished from the sub-back pressure pockets 54 and 56, which will be described hereinafter. When the sub-back pressure pockets 54 and 56 are omitted, the main back pressure pockets 44 and 46 may also be referred to as back pressure pockets 44 and 46. For another example, the main back pressure pockets 44 and 46 and the sub-back pressure pockets 54 and 56 may be collectively referred to as back pressure pockets 44, 46, 54, and 56.

As shown in FIG. 7, the first main back pressure pocket 44 and the second main back pressure pocket 46 may be formed within an outer diameter range of the roller 70. The term "outer diameter range" of the roller 70 refers to a range formed by an outer circumferential surface of the roller 70 that forms an edge of the roller 70. Accordingly, the first main back pressure pocket 44 and the second main back pressure pocket 46 may be separated from the compression chambers V1, V2, and V3. However, when there is no separate sealing member between the lower surface 41*b* (see FIG. 6) of the main bearing 40 and the upper surface of the roller 70, the first main back pressure pocket 44 and the second main back pressure pocket 46 may slightly communicate with each other through a gap between the two surfaces. This tiny passage allow refrigerant and oil to flow.

In this embodiment, the main back pressure pockets 44 and 46 may include the first main back pressure pocket 44 and the second main back pressure pocket 46. Each of the first main back pressure pocket 44 and the second main back pressure pocket 46 may have an arc shape surrounding the rotational shaft 30 relative to the rotational shaft 30. The first main back pressure pocket 44 and the second main back pressure pocket 46 may overlap a portion of the vane slots 73*a*, 73*b*, and 73*c* and the back pressure chambers during rotation of the roller 70, thereby providing back pressure to the vanes 75*a*, 75*b*, and 75*c*. An inner peripheral surface of each of the first main back pressure pocket 44 and the second main back pressure pocket 46 may be formed in a circular shape, and an outer peripheral surface thereof may be formed in an elliptical shape by considering an overlapping relationship thereof with the vane slots 73*a*, 73*b*, and 73*c*, which will be described hereinafter.

In this embodiment, the first main back pressure pocket 44 may have a higher pressure than the second main back pressure pocket 46. For example, an interior of the first main back pressure pocket 44 may form a discharge pressure, or an intermediate pressure between a suction pressure close to the discharge pressure and the discharge pressure. Oil transmitted to the main bearing 40 through the second oil through hole 35*b* may flow into the first main back pressure pocket 44. The first main back pressure pocket 44 may be formed within the range of the compression chambers V1, V2, and V3, which form the discharge pressure in the compression space V. Accordingly, the first main back pressure pocket 44 may maintain the discharge pressure.

The second main back pressure pocket 46 may have a lower pressure than the first main back pressure pocket 44. For example, the inside of the second main back pressure pocket 46 may form an intermediate pressure between the suction pressure and the discharge pressure. Refrigerant or oil may flow through a tiny passage between a lower surface of the main bearing 40 and an upper surface of the roller 70 into the second main back pressure pocket 46. That is, the first main back pressure pocket 44 and the second main back pressure pocket 46 may slightly communicate with each other through a tiny gap. In addition, the second main back pressure pocket 46 may be formed within the range of the compression chambers V1, V2, and V3, which form an intermediate pressure in the compression space V. Accordingly, the second main back pressure pocket 46 may maintain the intermediate pressure.

First oil drain part or portion 47 may be formed on a side of the main bearing 40. The side of the main bearing 40 may refer to an outer peripheral surface 43 of the main bearing 40. Each of the first oil drain portion 47 may be formed to be recessed on the outer peripheral surface 43 of the main bearing 40. The first oil drain portion 47 may increase a gap between the inner peripheral surface 11*a* of the body shell 11 and the outer peripheral surface 43 of the main bearing 40, thereby securing a passage through which oil may be recovered to the oil storage space RS. The first oil drain portion 47 may be referred to as a main oil drain portion 47 hereinafter to be distinguished from first oil drain portion 57 formed in the sub-bearing 50. Structure of each of the main oil drain portions 47 will be described hereinafter.

The sub-bearing 50 may be fixed inside of the body shell 11 by the cylinder 60. The sub-bearing 50 may have an approximate disk shape like the main bearing 40. In this embodiment, the sub-bearing 50 may (i) rotatably support the rotational shaft 30, (ii) cover the lower portion of the compression space V formed through the cylinder 60, and (iii) form the sub-back pressure pockets 54 and 56 for providing back pressure to the rear end portions of the vanes 75*a*, 75*b*, and 75*c*.

An upper surface of the sub-bearing 50 may be arranged to face a lower surface of the cylinder 60. The upper surface of the sub-bearing 50 may cover the lower portion of the compression space V formed through the cylinder 60 to form a lower surface of the compression space V. The sub-back pressure pockets 54 and 56 may be depressed in the upper surface of the sub-bearing 50 so as to provide back pressure to the rear end portions of the vanes 75*a*, 75*b*, and 75*c*.

Referring to FIG. 6, a sub-bush part or portion 52' may be provided at a center of the sub-bearing 50. The sub-bush portion 52 may be provided in a cylindrical shape at the center of the sub-bearing 50 and may surround the rotational shaft 30. A second shaft support hole AH2 may be formed at the center of the sub-bush portion 52. The sub-bush portion 52' and the main bush portion 42' may surround and fix the rotational shaft 30 at different heights so that the rotational shaft 30 is rotatable.

Referring to FIG. 5, the sub-back pressure pockets 54 and 56 may be formed in the sub-bearing 50. The sub-back pressure pockets 54 and 56 may increase the pressure of the back pressure chambers formed at one end of the vane slots 73*a*, 73*b*, and 73*c*, thereby providing back pressure to the vanes 75*a*, 75*b*, and 75*c* in a direction protruding from the vane slots 73*a*, 73*b*, and 73*c*. That is, the sub-back pressure pockets 54 and 56, together with the main back pressure pockets 44 and 46, may provide back pressure to the vanes 75*a*, 75*b*, and 75*c*.

The sub-back pressure pockets 54 and 56, like the above main back pressure pockets 44 and 46, may include the plurality of sub-back pressure pockets 54 and 56 separated along the circumferential direction of the sub-bearing 50. The plurality of sub-back pressure pockets 54 and 56 may have different internal pressures. The sub-back pressure pockets 54 and 56 may be symmetrical to the main back pressure pockets 44 and 46 described above, and thus, repetitive description thereof has been omitted.

In this embodiment, the first sub-back pressure pocket 54 may have a higher pressure than the second sub-back pressure pocket 56. For example, an interior of the first sub-back pressure pocket 54 may form the discharge pressure, or form an intermediate pressure between the suction pressure close to the discharge pressure and the discharge pressure. Oil transmitted to the main bearing 40 through the second oil through hole 35*b* may flow into the first sub-back pressure pocket 54. The first sub-back pressure pocket 54 may be formed within the range of the compression chambers V1, V2, and V3, which form the discharge pressure in the compression space V. Accordingly, the first sub-back pressure pocket 54 may maintain the discharge pressure.

The second sub-back pressure pocket 56 may have a lower pressure than the first sub-back pressure pocket 54. For example, an interior of the second sub-back pressure pocket 56 may form an intermediate pressure between the suction pressure and the discharge pressure. Oil may flow through a tiny passage between the second sub-bearing protrusion and the lower surface of the roller 70 into the second sub-back pressure pocket 56. The second sub-back pressure pocket 56 may be formed within the range of the compression chambers V1, V2, and V3, which form an intermediate pressure in the compression space V. Accordingly, the second sub-back pressure pocket 56 may maintain the intermediate pressure.

The pressure of the first sub-back pressure pocket 54 may be transmitted to the second sub-back pressure pocket 56. Fluid, such as refrigerant or oil, may leak through a gap formed between the upper surface of the sub-bearing 50 and the lower surface of the roller 70. This may increase the pressure of the second sub-back pressure pocket 56.

For another example, the first sub-back pressure pocket 54 and the second sub-back pressure pocket 56 may be formed asymmetrically to the first main back pressure pocket 44 and the second main back pressure pocket 46, respectively, with respect to the roller 70. For example, the first sub-back pressure pocket 54 and the second sub-back pressure pocket 56 may be formed to be longer in the circumferential direction or have a higher depression height in the vertical direction than the first main back pressure pocket 44 and the second main back pressure pocket 46, respectively. In addition, although not shown in the drawing, the back pressure pockets 44, 46, 54, and 56 may be formed in only one of the main bearing 40 and the sub-bearing 50.

In this embodiment, an example in which the discharge ports 42*a* and 42*b* are formed in the main bearing 40 is mainly described, but for another example, the discharge ports 42*a* and 42*b* may be formed in the sub-bearing 50 instead of the main bearing 40, or may be formed in the main bearing 40 and the sub-bearing 50, respectively. For still another example, the discharge ports 42*a* and 42*b* may be formed through the side of the cylinder 60.

The first oil drain portion 57 may be formed on the side of the sub-bearing 50. The side of the sub-bearing 50 may refer to the outer peripheral surface 53 of the sub-bearing 50. The first oil drain portion 57 may be recessed on the outer peripheral surface 53 of the sub-bearing 50. The first oil drain portion 57 may increase a gap between the inner peripheral surface 11*a* of the body shell 11 and the outer peripheral surface 53 of the sub-bearing 50, thereby securing a passage through which oil may be recovered to the oil storage space RS. The first oil drain portion 57 is hereinafter referred to as sub-oil drain portion 57 to distinguish the first oil drain portion 57 from the main oil drain portion 47 formed in the main bearing 40. Structure of the sub-oil drain portion 57 will be described hereinafter.

Next, while the cylinder 60 is in close contact with the lower surface of the main bearing 40, the cylinder 60 and the sub-bearing 50 may be fastened to the main bearing 40 by fasteners B, such as bolts. In this case, as the cylinder 60 is fixed to the inner peripheral surface 11*a* of the body shell 11 by, for example, welding, the main bearing 40 and the sub-bearing 50 may be together fixed to the casing 10 by the cylinder 60.

The cylinder 60 may include the compression space V (see FIG. 5) formed in a center thereof. An annular empty space formed at the center of the cylinder 60 may form the compression space V. Upper and lower portions of the empty space may be shielded by the main bearing 40 and the sub-bearing 50, respectively, so that the compression space V may be formed. The roller 70 may be rotatably disposed in the compression space V.

The cylinder 60 may include an intake opening 62 formed therein. The intake opening 62 may be formed by radially penetrating the cylinder 60. The intake opening 62 may be a supply path for refrigerant to flow in. The intake opening 62 may be connected to the intake pipe IP (see FIG. 1) described above. For another example, the intake opening 62 may be formed through the main bearing 40 or the sub-bearing 50.

Referring to FIG. 7, the intake opening 62 may be formed at a location spaced apart circumferentially from a contact point P. The contact point P refers to a point at which the outer circumferential surface of the roller 70 and the inner circumferential surface 61*c* of the compression space V are in contact with each other. The discharge ports 42*a* and 42*b* described above may be formed on the main bearing 40 at an opposite side of the intake opening 62 along the circumferential direction based on the contact point P.

Referring to FIG. 8, an inner peripheral surface 61*c* of the compression space V1, V2, and V3, which is a hollow space formed at the center of the cylinder 60, may have an elliptical shape. The inner peripheral surface 61*c* of the cylinder 60 according to this embodiment may be formed in an asymmetrical elliptical shape by combining a plurality of ellipses, for example, four ellipses having different length and width ratios, so as to have two origin points. For reference, the inner peripheral surface 61*c* of the compression spaces V1, V2, and V3 may also be regarded as the inner peripheral surface 61*c* of the cylinder 60.

The roller 70 may be disposed in the compression space V. The roller 70 according to this embodiment may be rotatably provided in the compression space V of the cylinder 60, and the plurality of vanes 75*a*, 75*b*, and 75*c* may be inserted into the roller 70 at intervals from each other along the circumferential direction. Accordingly, the compression space V may be formed by being divided into the compression chambers V1, V2, and V3 corresponding to the number of the plurality of vanes 75*a*, 75*b*, and 75*c*. In this embodiment, the plurality of vanes 75*a*, 75*b*, and 75*c* may include three vanes, and thus, an example in which the compression space V is divided into three compression chambers V1, V2, and V3 will be mainly described.

The roller 70 may be provided integrally with the rotational shaft 30 or may be manufactured separately from the rotational shaft 30 and then assembled later. In this embodiment, the following description is based on an example in which the roller 70 is post-assembled with the rotational shaft 30. However, even if the roller 70 is integrally provided with the rotational shaft 30, the rotational shaft 30 and the roller 70 may be formed to be similar to those of this embodiment. However, in a case in which the roller 70 is post-assembled with the rotational shaft 30 as in this embodiment, the roller 70 may be made of a material different from the material of the rotational shaft 30, for example, a hard material lighter than the material of the rotational shaft 30. In this case, processing of the roller 70 may be easier and a weight of a rotating body including the roller 70 may be reduced, thereby increasing the efficiency of the compressor.

Referring to FIGS. 5 and 6, in this embodiment, the roller 70 may have the rotational shaft 30 coupled to a center thereof and may rotate together with the rotational shaft 30. The roller 70 may rotate together with the rotational shaft 30 to divide the compression space V into the plurality of compression chambers V1, V2, and V3, and may sequentially compress and discharge refrigerant introduced into each of the compression chambers V1, V2, and V3.

A center of rotation of the roller 70 may be concentric with the center of the rotational shaft 30, that is, an axis center. Accordingly, the roller 70 may rotate concentrically with the rotational shaft 30. The inner peripheral surface 61*c* of the cylinder 60 may be formed in an asymmetrical elliptical shape rather than a circular shape. The outer circumferential surface of the roller 70 may be in contact with the inner peripheral surface 61*c* of the cylinder 60 at one contact point P, so that the compression space V may be formed between the outer circumferential surface of the roller 70 and the inner peripheral surface 61*c* of the cylinder 60.

The roller 70 may have the plurality of vane slots 73*a*, 73*b*, and 73*c* formed therein. First ends of the vane slots 73*a*, 73*b*, and 73*c* may be open toward the compression chambers V1, V2, and V3 to form openings, and second ends thereof may be closed. The back pressure chambers may be formed at the closed second ends of the vane slots 73*a*, 73*b*, and 73*c*.

The vanes 75*a*, 75*b*, 75*c* may be slidably inserted into the plurality of vane slots 73*a*, 73*b*, and 73*c*, respectively. A direction in which the vanes 75*a*, 75*b*, and 75*c* slide and are coupled may be orthogonal to an axial direction and at the same time may be oblique from a radial direction of the roller 70. The plurality of vane slots 73*a*, 73*b*, and 73*c* may be provided at intervals along a circumferential direction of the roller 70.

The plurality of vane slots 73*a*, 73*b*, and 73*c* may include first vane slot 73*a*, second vane slot 73*b*, and third vane slot 73*c* along the rotational direction of the roller 70, which is a compression progression direction. The first vane slot 73*a*, the second vane slot 73*b*, and the third vane slot 73*c* may be formed into the same shapes at equal or unequal intervals along the circumferential direction, respectively.

The back pressure chambers (reference numeral not given) may be formed at the innermost second ends of the vane slots 73*a*, 73*b*, and 73*c*, respectively. The back pressure chambers may be spaces in which refrigerant or oil of the discharge pressure or intermediate pressure is received at the rear sides of the vanes 75*a*, 75*b*, and 75*c*, that is, toward the rear end surfaces of the vanes 75*a*, 75*b*, and 75*c*. The plurality of vanes 75*a*, 75*b*, and 75*c* may be pressed toward the inner circumferential surface 61*c* of the compression space V by the pressure of the refrigerant or oil filled in the back pressure chambers. Hereinafter, a direction toward the inner circumferential surface 61*c* of the compression space V may be described by being defined as forward and an opposite direction may be described by being defined as backward, based on a direction of movement of the vanes 75*a*, 75*b*, and 75*c*.

Upper and lower portions of the back pressure chambers may be formed to be shielded by the main bearing 40 and the sub-bearing 50, respectively. The back pressure chambers may communicate with each other independently of the back pressure pockets 44, 46, 54, and 56 or may communicate with each other by the back pressure pockets 44, 46, 54, and 56.

Referring to FIG. 5, the plurality of vanes 75*a*, 75*b*, and 75*c* according to this embodiment may be slidably inserted into the vane slots 73*a*, 73*b*, and 73*c*, respectively. The plurality of vanes 75*a*, 75*b*, and 75*c* may be formed to have approximately equal shapes to the vane slots 73*a*, 73*b*, and 73*c*, respectively. In this case, the vanes 75*a*, 75*b*, and 75*c* may be stably inserted into and removed from inside of the vane slots 73*a*, 73*b*, and 73*c* without shaking.

The plurality of vanes 75*a*, 75*b*, and 75*c* may be defined as first vane 75*a*, a second vane 75*b*, and third vane 75*c* along a rotational direction of the roller 70. The first vane 75*a* may be inserted into the first vane slot 73*a*, the second vane 75*b* may be inserted into the second vane slot 73*b*, and the third vane 75*c* may be inserted into the third vane slot 73*c*.

In the compressor of this embodiment, when power is applied to the electric drive unit 20 through the cluster 15, the rotors 23 and 25 and the rotational shaft 30 coupled to the rotors 23 and 25 may rotate. Accordingly, the roller 70, which is coupled to the rotational shaft 30 or formed integrally with the rotational shaft 30, may rotate together with the rotational shaft 30.

The plurality of vanes 75*a*, 75*b*, and 75*c* may protrude from the vane slots 73*a*, 73*b*, and 73*c*, respectively, by centrifugal force generated by the rotation of the roller 70 and the back pressure of the back pressure chamber supporting the rear of each of the vanes 75*a*, 75*b*, and 75*c*, and may come into contact with the inner circumferential surface 61*c* of the compression space V. Accordingly, the compression space V may be divided into a plurality of compression chambers V1, V2, and V3 by the plurality of vanes 75*a*, 75*b*, and 75*c*, and volumes of the compression chambers V1, V2, and V3 may be varied as the divided compression chambers V1, V2, and V3 move along with the rotation of the roller 70. A process in which refrigerant introduced into each of the compression chambers V1, V2, and V3 is compressed while moving along the roller 70 and the vanes 75*a*, 75*b*, and 75*c*, and discharged into an internal space S of the casing 10 may be repeated. Accordingly, the compression chambers V1, V2, and V3 may include a suction chamber and a discharge chamber.

In this case, a gap between the inner circumferential surface 61*c* of the compression space V and the outer circumferential surface of the roller 70 may rapidly narrow as the compression space approaches the contact point P (see FIG. 7), so that compressed refrigerant may be discharged through the first discharge port 42*a* and the second discharge port 42*b* of the discharge port 42. The first discharge port 42*a* and the second discharge port 42*b* may be arranged along the circumferential direction of the main bearing 40, so that the refrigerant may be discharged sequentially.

A discharge muffler 90 may be disposed on an upper portion of the main bearing 40. The discharge port 42 and the discharge valve 81 and 82 may be accommodated between the discharge muffler 90 and the upper surface 41*a* of the main bearing 40.

In a case in which the discharge port 42 and the discharge muffler 90 are provided on the main bearing 40, refrigerant compressed in the compression chambers V1, V2, and V3 may be discharged through the discharge port 42 to a discharge space 91' (see FIG. 1) of the discharge muffler 90, and the discharged refrigerant may be discharged to the internal space S of the casing 10 through a gap (not shown) between the inner peripheral surface of the discharge muffler 90 and the outer peripheral surface of the main bush portion 42' of the main bearing 40. In this case, the discharged refrigerant may have pulsation pressure thereof reduced in the discharge space 91'.

Referring to FIGS. 5 and 6, the discharge muffler 90 may include a muffler plate 91 having a disc shape and a muffler housing 92 provided on an upper portion of the muffler plate 91. The discharge space 91' may be formed inside of the muffler housing 92.

A plurality of muffler fastening holes 93 may be formed in the muffler plate 91. The muffler fastening holes 93 may axially penetrate the muffler plate 91. The muffler fastening holes 93 may be formed at positions corresponding to main fastening holes 49, cylinder fastening holes 69, and sub-fastening holes 59. Accordingly, the fasteners B may sequentially pass through the muffler fastening holes 93, the main fastening holes 49, the cylinder fastening holes 69, and the sub-fastening holes 59, thereby fastening the discharge muffler 90, the main bearing 40, the cylinder 60, and the sub-bearing 50 to each other.

The muffler housing 92 may have muffler recessed portions 95 provided for avoiding the muffler fastening holes 93. Each of the muffler recessed portions 95 may be recessed radially inward toward a center of the discharge muffler 90. The muffler recessed portion 95 may provide a void space to allow a tool to enter each of the muffler fastening holes 93. The muffler recessed portion 95 may have an axially extending structure.

Referring to FIG. 3, an edge of the muffler plate 91 may correspond to an upper surface of the main bearing 40. In this embodiment, the main oil drain portion 47 may be formed in the main bearing 40, but the upper surface of the main bearing 40 may have a sufficiently wide area, so that the muffler plate 91 may be seated on the upper surface of the main bearing 40. That is, in this embodiment, in order to make the main oil drain portion 47, a portion of the upper surface of the main bearing 40 may not be recessed radially inward, and as the upper surface of the main bearing 40 maintains a regular circular shape, the muffler plate 91 may also be made into a regular circular shape. Accordingly, there is no need to complicate the shape of the discharge muffler 90 in order to mount the discharge muffler 90 on the upper surface of the main bearing 40.

Figure 9A:
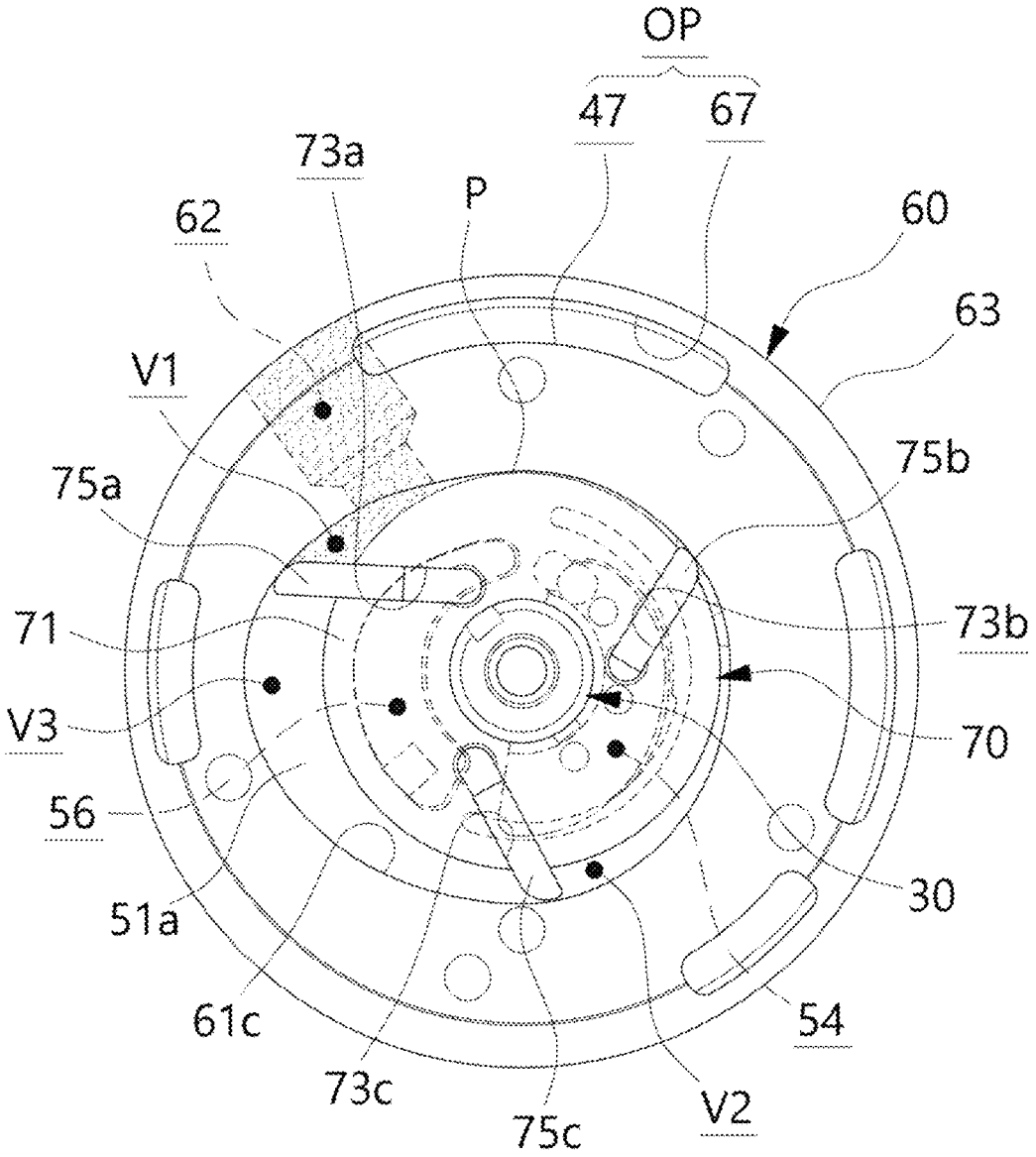
FIGS. 9A, 9B, 9C, and 9D are operation state views sequentially illustrating a process in which refrigerant is compressed according to an embodiment.
Figure 9B:
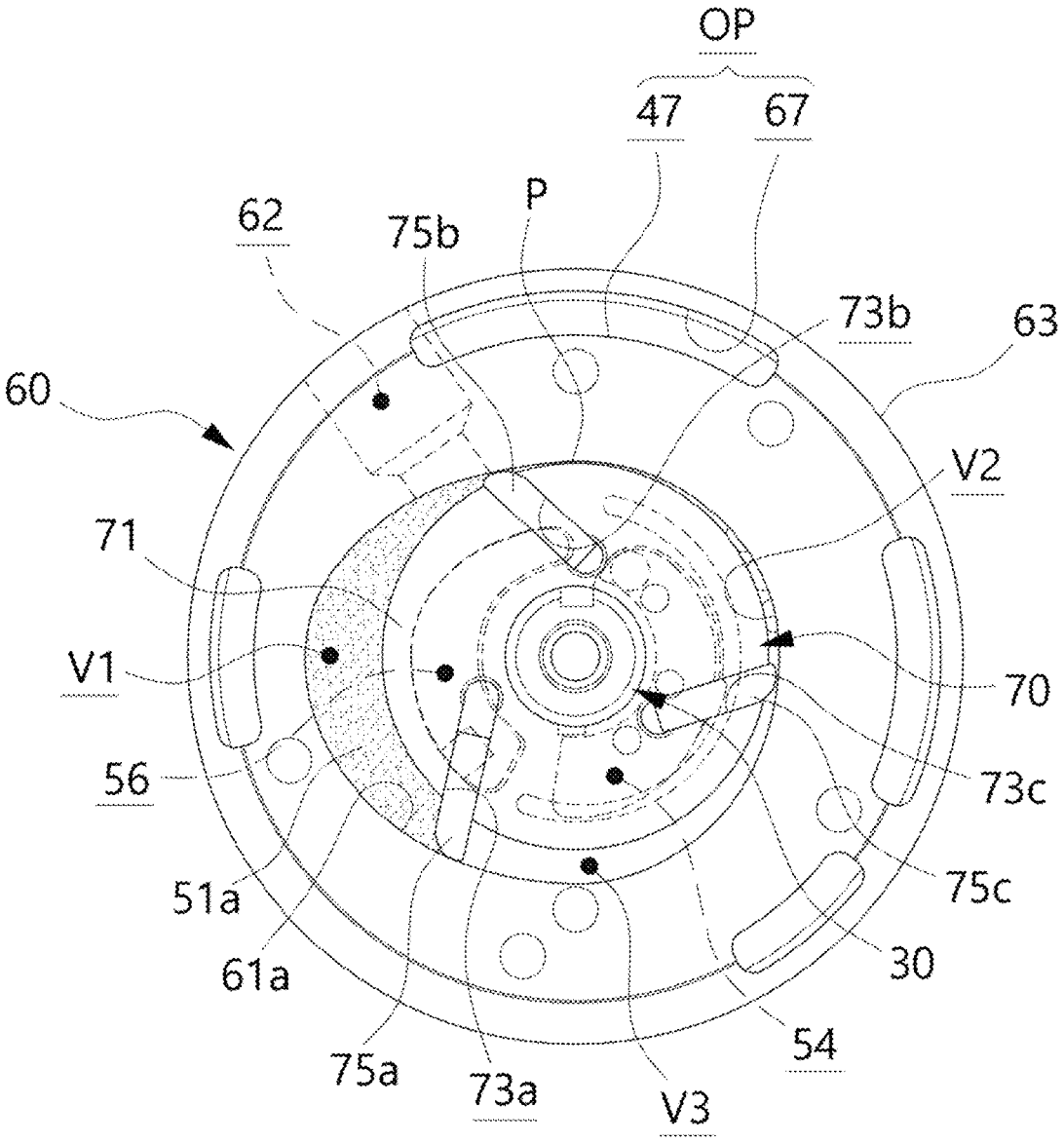

FIG. 9A to 9B are cross-sectional views showing a process in which refrigerant is suctioned into and compressed in the cylinder 60 of the compressor of this embodiment, and is discharged. FIGS. 9A to 9D illustrate the sub-back pressure pockets 54 and 56 of the sub-bearing 50 in a projected state, and the main bearing 40, which is not illustrated in the drawings, is identical to the sub-bearing 50. A portion depicted as a different material in the drawings represents refrigerant.

As illustrated in FIG. 9A, refrigerant may be introduced through the intake opening 62. The introduced refrigerant may be stored between two different vanes 75*a* and 75*b*. FIG. 9A illustrates refrigerant flowing to a position between the first vane 75*a* and the second vane 75*b*.

In this state, when the roller 70 rotates, as shown in FIG. 9B, the volume of the first compression chamber V1 may continuously increase until the first vane 75*a* passes the intake opening 62 and the second vane 75*b* reaches the point of completion of suction, and the refrigerant may be continuously introduced from the intake opening 62 into the first compression chamber V1.

The rear of the first vane 75*a* may be exposed to the second sub-back pressure pocket 56 among the sub-back pressure pockets 54 and 56, so that the first vane 75*a* may be provided with intermediate back pressure. In addition, the rear of the third vane 75*c* may be exposed to the first sub-back pressure pocket 54 among the sub-back pressure pockets 54 and 56, so that the third vane 75C may be provided with a back pressure of the discharge pressure or a pressure close to the discharge pressure (hereinafter, referred to as a "discharge pressure"). Accordingly, the first vane 75*a* may be brought into close contact with the inner peripheral surface 61*c* of the cylinder 60 by the intermediate pressure, and the third vane 75*c* may be brought into close contact with the inner peripheral surface 61*c* of the cylinder 60 by the discharge pressure.

When the second vane 75*b* passes the point of completion of suction (or the point of start of compression) and begins a compression stroke, the first compression chamber V1 may be sealed and move toward the discharge port 42 together with the roller 70. During this process, the volume of the first compression chamber V1 continuously may decrease, and refrigerant in the first compression chamber V1 may be gradually compressed.

In this case, when the pressure of the refrigerant in the first compression chamber V1 increases, the first vane 75*a* may be pushed to the rear of the first vane slot 73*a*. In this case, the first compression chamber V1 may communicate with the preceding third compression chamber V3, and the refrigerant may leak. In particular, before the back pressure of the second sub-back pressure pockets 56 (or the second main back pressure pocket 46) is sufficiently high during the initial operation of the compressor, the first vane 75*a* is likely to be pushed rearward, causing such leakage, and during the process, shaking thereof may occur. In this embodiment, to prevent this phenomenon, a pressure transmission path is implemented. Structure of the pressure transmission path K will be described hereinafter.

Figure 9C:
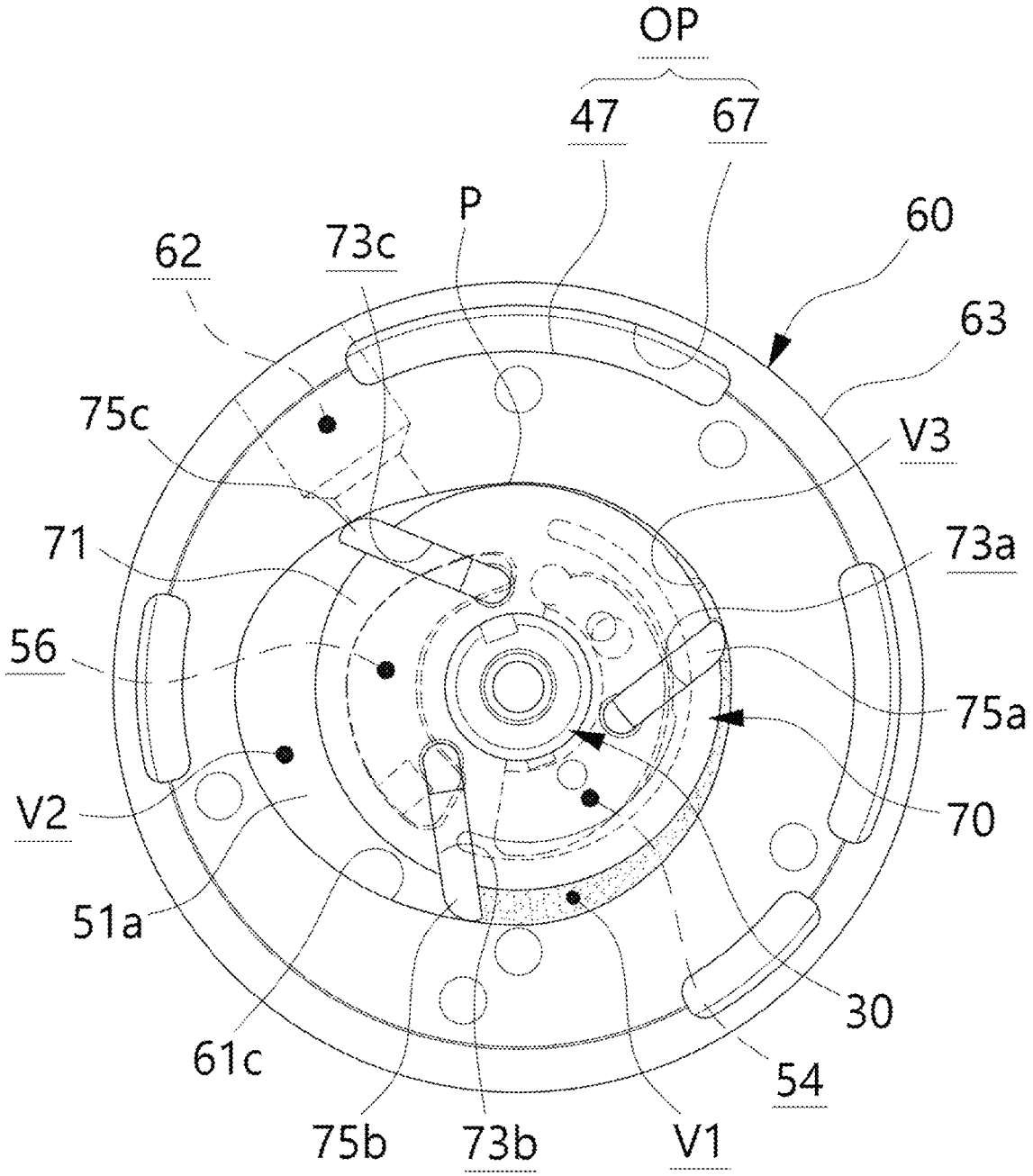

Referring to FIGS. 9B and 9C, when the first vane 75*a* leaves the second sub-back pressure pocket 56 and enters the first sub-back pressure pocket 54, the first vane 75*a* receives the back pressure of the discharge pressure changed from the back pressure of the intermediate pressure. Accordingly, as the back pressure provided to the first vane 75*a* increases, the first vane 75*a* may be prevented from being pushed backwards.

As illustrated in FIG. 90, when the first vane 75*a* passes the first discharge port 42A (not shown in FIG. 9C) and the second vane 75*b* has not yet reached the first discharge port 42*a*, the first compression chamber V1 may communicate with the first discharge port 42*a*, and the first discharge port 42*a* may be opened by the pressure of the first compression chamber V1. Accordingly, a portion of the refrigerant of the first compression chamber V1 may be discharged into internal space S of the casing 10 through the first discharge port 42*a*, and the pressure of the first compression chamber V1 may be decreased to a predetermined pressure. For another example, when the first discharge port 42*a* is not present, the refrigerant of the first compression chamber V1 may not be discharged, but may be concentrated toward the second discharge port 42*b*, which is the main discharge port 42.

In this case, the volume of the first compression chamber V1 may be further reduced, so the refrigerant of the first compression chamber V1 may be further compressed. As the first vane slot 73*a*, in which the first vane 75*a* is accommodated, and a first back pressure chamber 74*a* fully communicate with the first sub-back pressure pocket 54, the first vane 75*a* may be provided with a back pressure almost close to the discharge pressure. Accordingly, the first vane 75*a* may be prevented from being pushed rearward, that is, in a direction away from the inner peripheral surface 61*c* of the cylinder 60, by a high back pressure, thereby preventing refrigerant leakage between the compression chambers V1, V2, and V3.

Figure 9D:
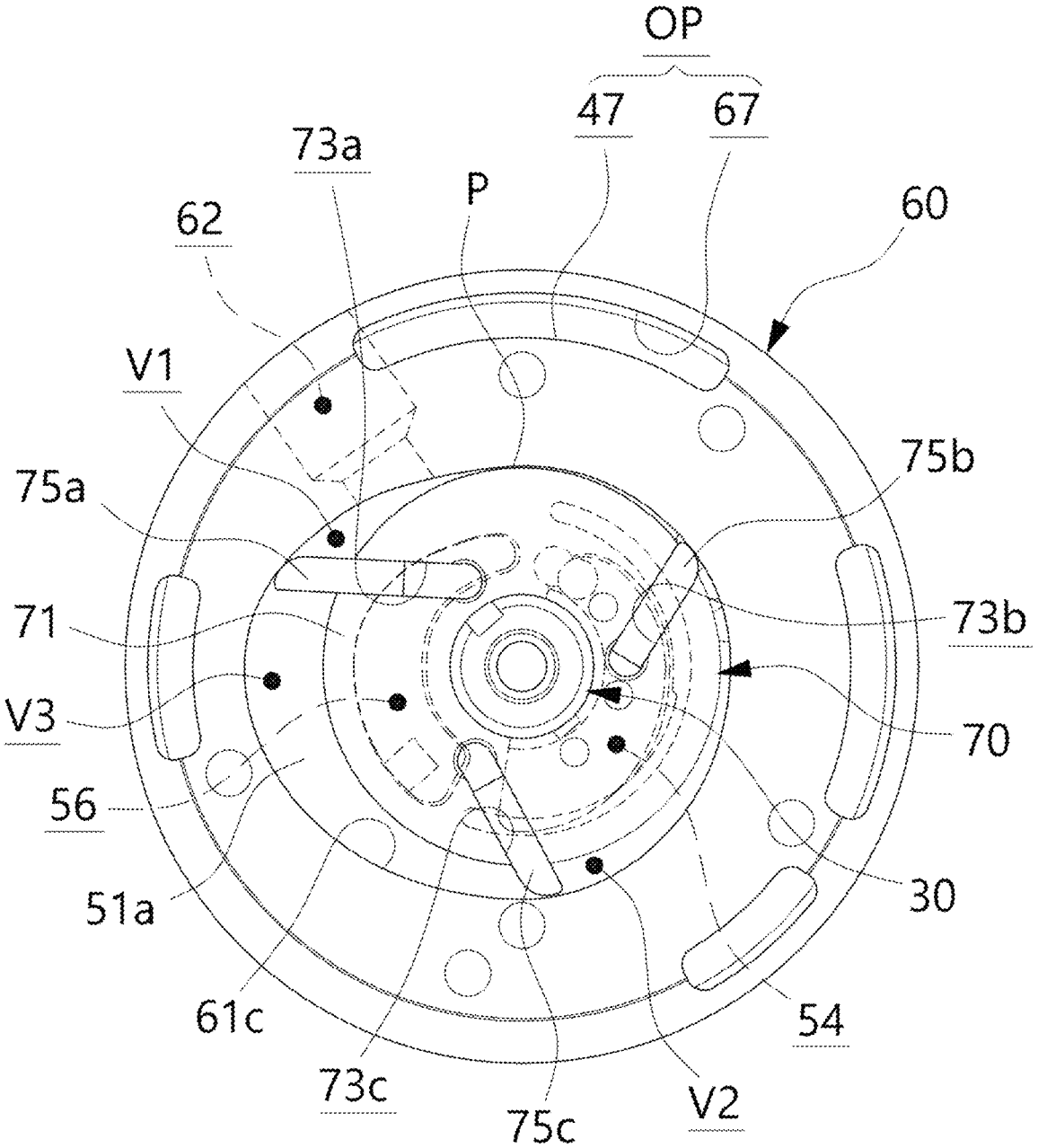

As illustrated in FIG. 9D, when the first vane 75*a* passes the contact point P, the same process as above may be repeated so that refrigerant may be continuously compressed. In FIGS. 9A, 9B, 9C, and 9D, only the process of compressing refrigerant in the first compression chamber V1 is described to help understanding, but refrigerant may be continuously compressed even in the second compression chamber V2 and the third compression chamber V3 following the first compression chamber V1. Accordingly, in the compressor of this embodiment, refrigerant may be continuously compressed and discharged through the plurality of compression chambers V1, V2, and V3.

Figure 10:
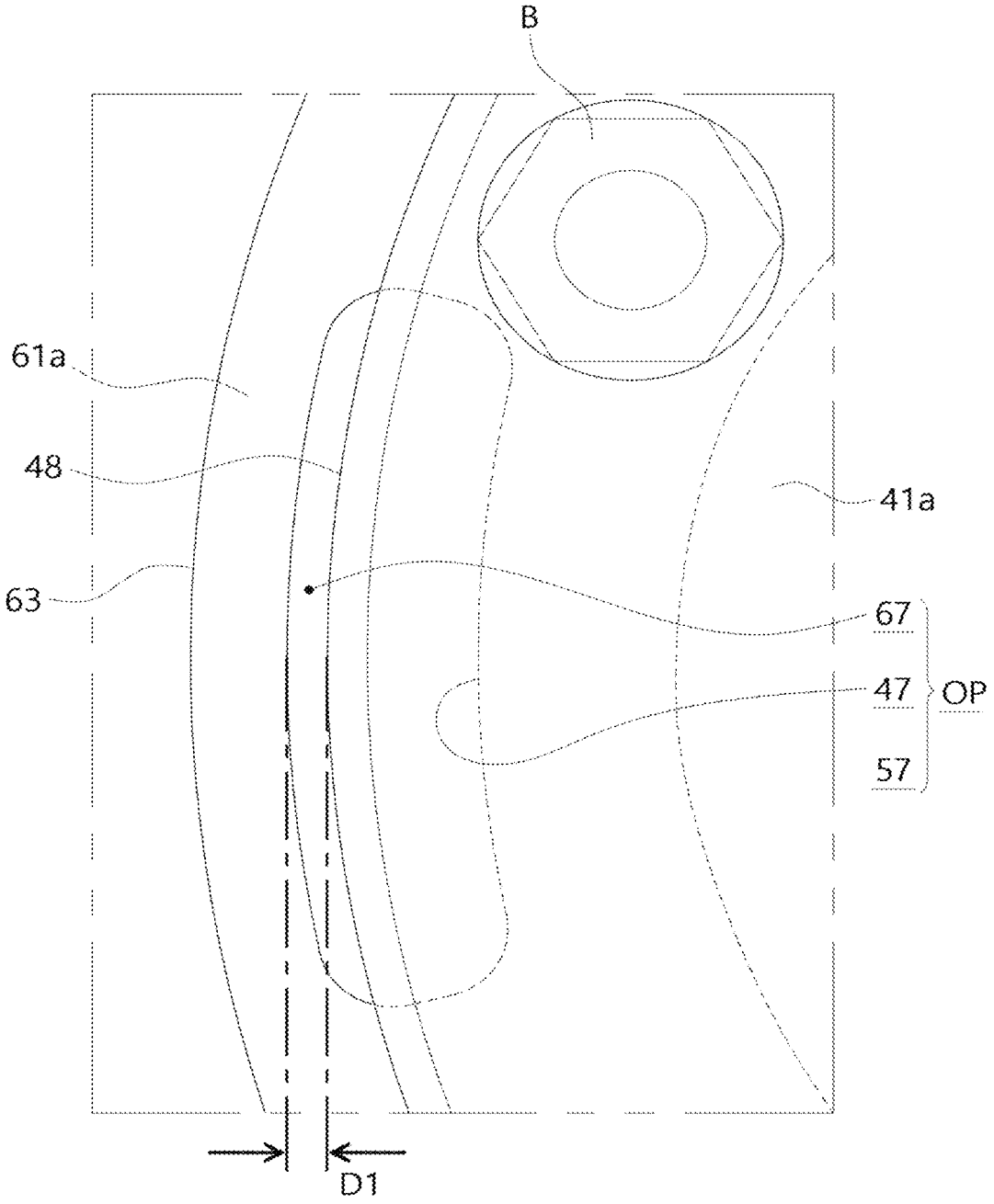
FIG. 10 is an enlarged view of portion A1 of FIG. 7.

In this way, during the process of compressing refrigerant, oil may be supplied to the compression portion C, so that movement and rotation of components may be performed smoothly. In addition, as illustrated in FIG. 10, the oil may be recovered back to the oil storage space RS through the oil drain path OP. Hereinafter, the oil drain path OP will be described.

The oil drain path OP may provide an axial path to the compression portion C. The oil drain path OP may be a passage that extends axially from an edge of the compression portion C. Referring to FIG. 2, an upper end portion of the oil drain path OP may be open to the internal space S of the casing 10, and a lower end portion of the oil drain path OP may be open to an oil storage space RS. Accordingly, oil introduced through the upper end portion of the oil drain path OP may be discharged through the lower end portion of the oil drain path OP and recovered in the oil storage space RS. The term "recovered" means that the oil existing in the internal space S of the casing 10 is moved by gravity and is collected again in the oil storage space S.

The oil drain path OP may include the first oil drain portion 47 and 57 and the second oil drain portion 67. The first oil drain portion 47 and 57 and the second oil drain portion 67 may be formed to have different axial heights in the compression portion C. The first oil drain portion 47 and 57 and the second oil drain portion 67 may be axially connected to each other. The first oil drain portion 47 and 57 may be provided in one of the main bearing 40 (or the sub-bearing 50) and the cylinder 60, and the second oil drain portion 67 may be provided in a remaining one. In this embodiment, the first oil drain portion 47 and 57 may be provided in the main bearing 40 and the sub-bearing 50, and the second oil drain portion 67 may be provided in the cylinder 60.

As described above, the outer diameter of the cylinder 60 CW (see FIG. 2) may be larger than each of the outer diameter of the main bearing 40 and the outer diameter of the sub-bearing 50 BW (see FIG. 2). In this way, the first oil drain portion 47 or 57 may be provided on the outer peripheral surface 43 of the main bearing 40, which has a relatively smaller diameter among the main bearing 40 and the cylinder 60. The second oil drain portion 67 may be provided on the outer peripheral surface 63 of the cylinder 60, which has a relatively larger diameter among the main bearing 40 and the cylinder 60. In addition, the first oil drain portion 47 and 57 and the second oil drain portion 67 may be connected to each other in the axial direction to form the oil drain path OP.

The first oil drain portion 47 and 57 may include the main oil drain portion 47 formed in the main bearing 40 and the sub-oil drain portion 57 formed in the sub-bearing 50, as described above. As the above main oil drain portion 47 and the above sub-oil drain portion 57 have symmetrical structures, the main oil drain portion 47 will be mainly described.

The above main oil drain portion 47 may be recessed inward in the radial direction from the outer peripheral surface 43 of the main bearing 40. The radial direction may refer to a direction connecting the center of the main bearing 40 with the outer peripheral surface 43 of the main bearing 40. The center of the main bearing 40 may also be regarded as the center of the rotational shaft 30. When the main oil drain portion 47 is recessed on the outer peripheral surface 43 of the main bearing 40, a radius of the main bearing 40 may be formed smaller at a portion at which the main oil drain portion 47 is formed than at other portions thereof.

As illustrated in FIGS. 5 and 6, the main oil drain portion 47 may be recessed on the outer peripheral surface 43 of the main bearing 40 and formed circumferentially in the outer peripheral surface 43 of the main bearing 40. The main oil drain portion 47 may be formed at a position axially corresponding to the second oil drain portion 67 and the sub-oil drain portion 57 arranged under the main oil drain portion 47.

A rim 48 may be provided on an upper portion of the main oil drain portion 47. The rim 48 may be provided on the outer peripheral surface 43 of the main bearing 40. The rim 48 may have the shape of a ring provided along an edge of the main bearing 40. As the main oil drain portion 47 is recessed on the outer peripheral surface 43 of the main bearing 40, the rim 48 may be regarded as a portion that protrudes radially outward relative to the outer peripheral surface 43 of the main bearing 40. Hereinafter, the rim 48 may be referred to as main rim 48 to be distinguished from a sub-rim 58 formed in the sub-bearing 50.

As shown in FIG. 7, when projected on a plane, the main rim 48 may cover a portion or all of the second oil drain portion 67. The term "cover" means that the main rim 48 and the second oil drain portion 67 overlap in the axial direction, so that a portion or all of the second oil drain portion 67 is not visible when the compression portion C is viewed from above. Referring to FIGS. 7 and 10, the main rim 48 covers a portion of the second oil drain portion 67, leaving only the remaining portion of the second oil drain portion 67 exposed.

Referring to FIG. 10, which is an enlarged view of portion A1 in FIG. 7, the main rim 48 covers the second oil drain portion 67, so only a portion of the second oil drain portion 67 is exposed. A radial width of the second oil drain portion 67 thus exposed is expressed as D1. As the second oil drain portion 67 is formed to have a radially larger width than an outer peripheral surface of the main rim 48, a portion of the second oil drain portion 67 may not overlap with the main rim 48. In this way, the portion at which the main rim 48 and the second oil drain portion 67 do not overlap each other may be a portion of a passage through which oil may fall. As explained hereinafter, as the main oil drain portion 47, the second oil drain portion 67, and the sub-oil drain portion 57 have the shape of a continuous flat or curved surface, the portion expressed by the dotted line in FIG. 7 may be the main oil drain portion 47 and the sub-oil drain portion 57.

Figure 11:
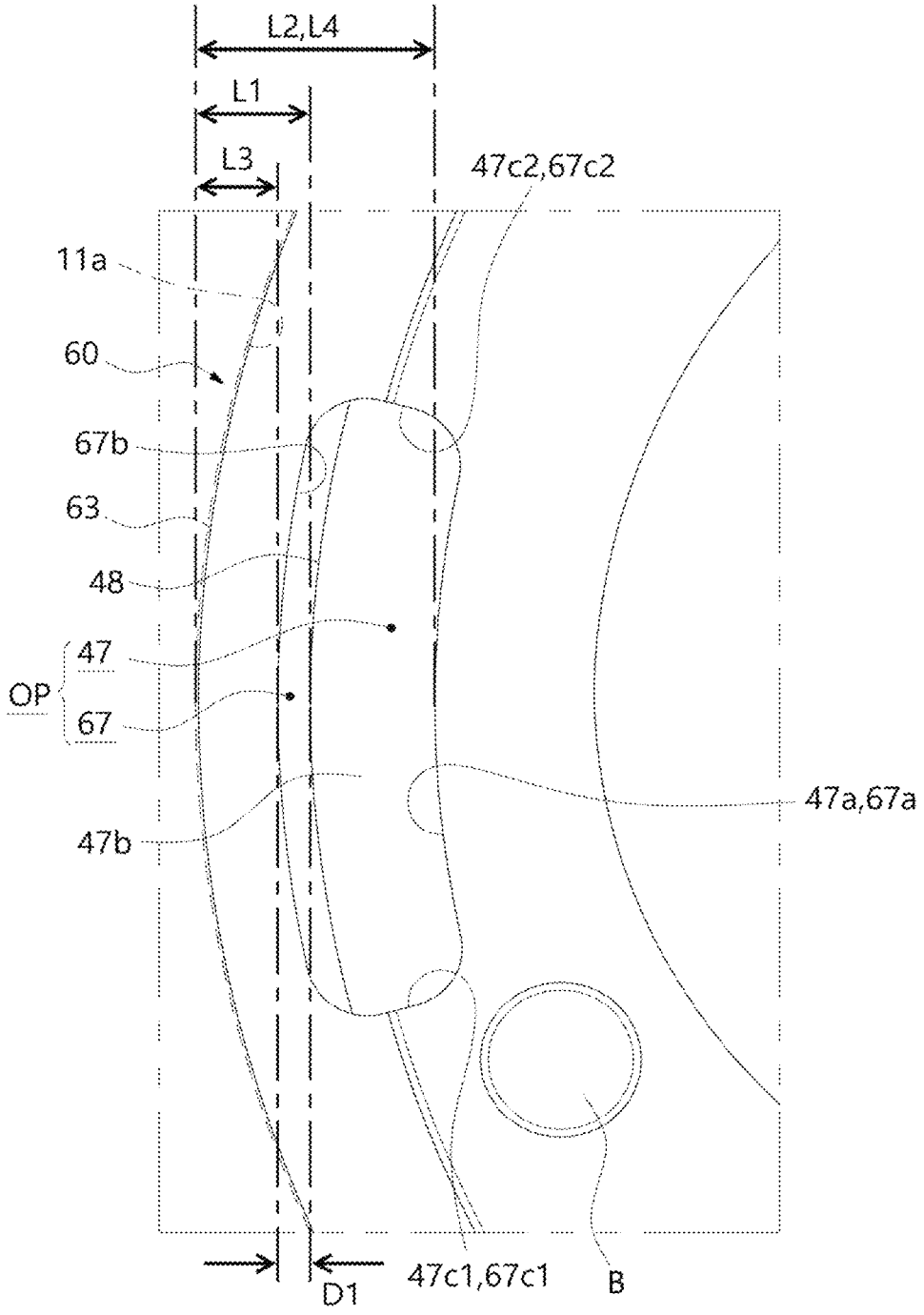
FIG. 11 is an enlarged view of portion A2 of FIG. 8.

FIGS. 8 and 11 illustrate the compression portion C viewed from below with the sub-bearing 50 removed. As shown in the drawings, as the second oil drain portion 67 is viewed from the lower side of the cylinder 60, the second oil drain portion 67 is fully exposed. However, the main rim 48, which overlaps the upper portion of the second oil drain portion 67, covers the second oil drain portion 67 from the opposite side.

Accordingly, in this embodiment, the second oil drain portion 67 may overlap the main bearing 40 in some sections in the axial direction, but smooth oil flow is possible through the first oil drain portion 47 and 57. That is, the first oil drain portion 47 and 57 may be formed in the radial direction orthogonal to the axial direction, thereby providing a wide oil recovery passage.

When a difference between the outer diameter of the cylinder 60 and the outer diameter of the main bearing 40 is large, interference between the main rim 48 and the second oil drain portion 67 may not occur. Referring to FIG. 2, in this embodiment, a ratio BW/CW of a size BW of the outer diameter of the main bearing 40 to a size CW of the outer diameter of the cylinder 60 or the inner diameter of the casing 10 may be larger than 0.8. In addition, a difference CW-BW between the size of the outer diameter of the cylinder 60 or the inner diameter of the casing 10 and the outer diameter of the main bearing 40 may be less than 10 mm. In this case, the second oil drain portion 67 may be axially covered by the main rim 48, and the need to form the oil drain path OP through the first oil drain portion 47 and 57 and the second oil drain portion 67 may increase.

Figure 12:
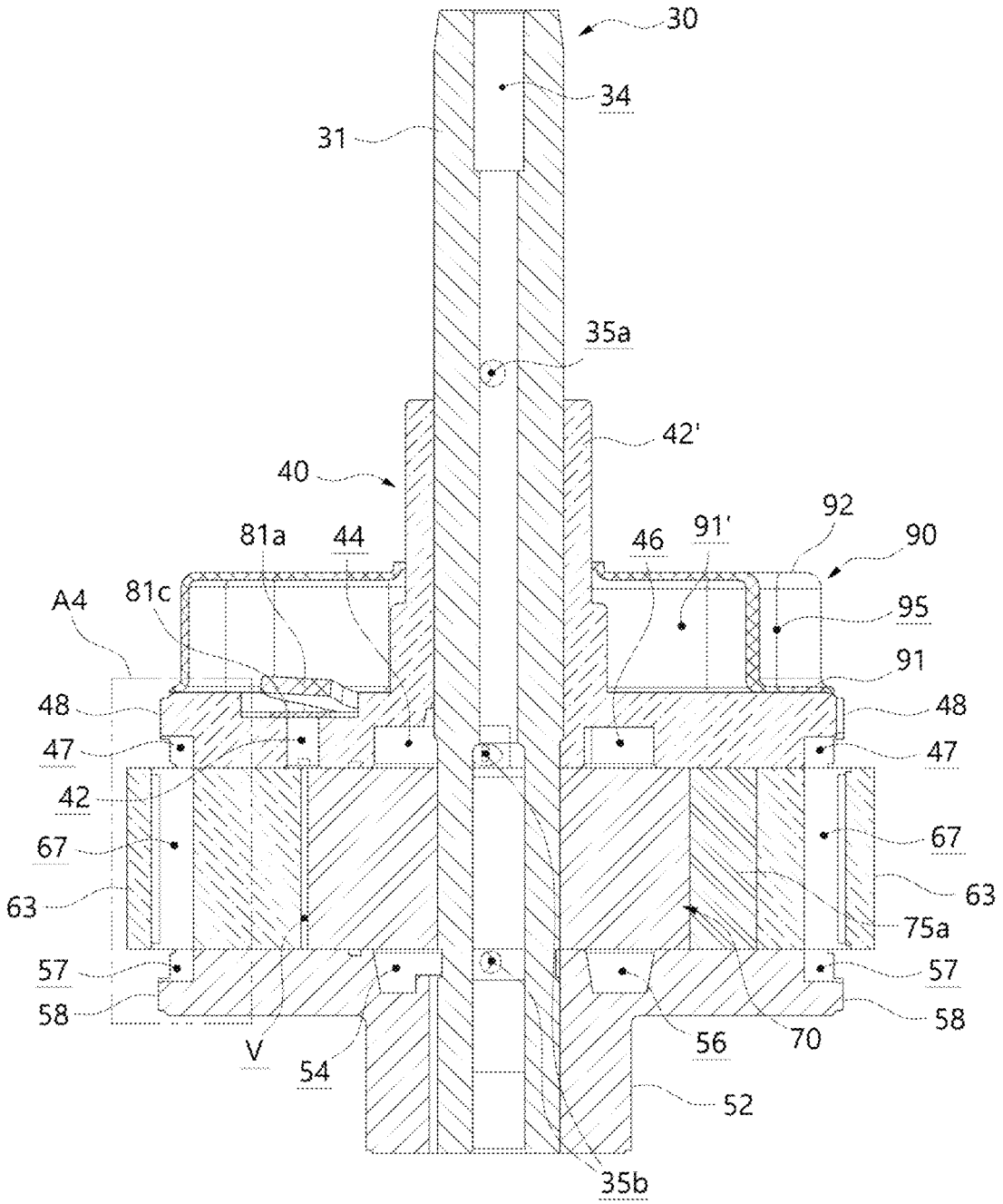
FIG. 12 is a cross-sectional view of the compression portion of FIG. 1.

Next, referring to FIG. 12, the main oil drain portion 47, the second oil drain portion 67, and the sub-oil drain portion 57 may be axially arranged at the edge portion of the compression portion C. The main oil drain portion 47, the second oil drain portion 67, and the sub-oil drain portion 57 may be formed along the circumferential direction of the compression portion C and may be arranged at positions corresponding to each other to form a continuous path.

Referring to FIG. 13, which is an enlarged version of portion A3 of FIG. 12, the inner peripheral surface 11*a* of the body shell 11 is illustrated with a dotted line. The first oil drain portion 47 and 57 may be recessed radially (to the right in the drawing) from the inner peripheral surface 11*a* of the body shell 11. That is, the main oil drain portion 47 may be recessed in a direction away from the inner peripheral surface 11*a* of the body shell 11. Accordingly, a wide axial passage (see P2 in FIG. 13) may be secured between the main oil drain portion 47 and the inner peripheral surface 11*a* of the body shell 11.

In addition, a second passage P2 formed by the first oil drain portion 47 and 57 may be axially connected to a first passage (P1 of FIG. 13) formed on the upper portion of the main oil drain portion 47. Accordingly, the first passage P1 formed between the main rim 48 and the inner peripheral surface 11*a* of the body shell 11 at an uppermost portion of the compression portion C may be connected to a third passage P3 formed by the second oil drain portion 67 via the second passage P2. As a result, the main oil drain portion 47 having a relatively recessed shape may be implemented while maintaining an entire upper area formed by the upper surface 41*a* of the main bearing 40 and the radius of the main rim 48.

In this embodiment, the upper surface of the main rim 48 may be formed in a circular shape. The upper surface of the main rim 48 may form the edge of the upper surface of the main bearing 40, and the main rim 48 may have a circular shape on the upper surface of the main bearing 40. The discharge muffler 90 may be seated on the upper surface of the main rim 48. When the main rim 48 has a regular circular shape, the main rim 48 may correspond to the edge of the muffler plate 91. Accordingly, even without changing the shape of the discharge muffler 90, a seating area of the discharge muffler 90 may be formed to be wide by the upper surface of the main rim 48.

The main oil drain portion 47 may extend from a point axially downward from an upper end of the outer peripheral surface 43 of the main bearing 40 to a lower end of the outer peripheral surface 43 of the main bearing 40. The main rim 48 may be provided from the upper end of the outer peripheral surface 43 of the main bearing 40 to the point axially downward therefrom, and the main oil drain portion 47 may be formed from an axial lower end of the main rim 48 to an axial lower end of the main bearing 40. That is, the lower end of the main oil drain portion 47 may be open toward the second oil drain portion 67.

Figure 14:
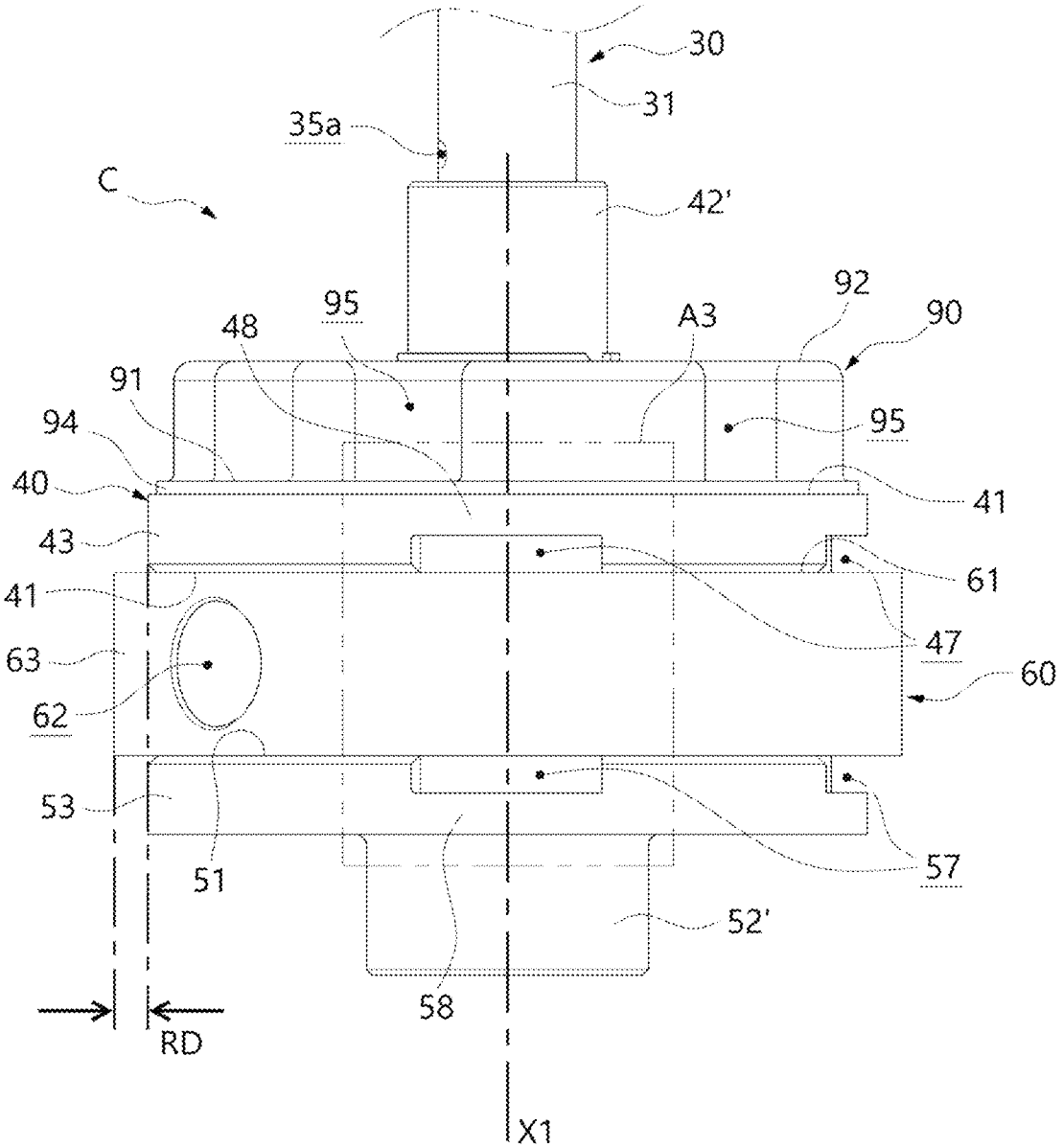
FIG. 14 is a side view of the compression portion of FIG. 1.

Referring to FIGS. 13 and 14, the main oil drain portion 47 may include a main outer peripheral surface 47*a* forming the outer peripheral surface 43 of the main bearing 40, a main upper surface 47*b* forming an upper surface of the main oil drain portion 47, and main sides 47*c*1 and 47*c*2 forming a side of the main oil drain portion 47. The main upper surface 47*b* may be connected to an axial upper end portion of the main outer peripheral surface 47*a*. The main sides 47*c*1 and 47*c*2 may be connected to opposite circumferential end portions of the main outer peripheral surface 47*a*. Accordingly, the main oil drain portion 47 may have a structure in which the upper end portion and opposite end portions thereof are surrounded by the main upper surface 47*b* and the main sides 47*c*1 and 47*c*2, respectively. In addition, the axial lower end portion of the main oil drain portion 47 may be connected to the second oil drain portion 67.

In this case, as will be described hereinafter, the surface of the first oil drain portion 47 and 57 may form a flat or curved surface continuous with the surface of the second oil drain portion 67. More precisely, the main outer peripheral surface 47*a* may form a flat or curved surface continuous with a first drain inner surface 67*a* of the second oil drain portion 67. Each of the main sides 47*c*1 and 47*c*2 may form a flat or curved surface continuous with each of connecting inner surfaces 67*c*1 and 67*c*2 of the second oil drain portion 67. Accordingly, oil may flow smoothly along the surface of the first oil drain portion 47 and 57 and the surface of the second oil drain portion 67, and oil recovery may be effectively achieved.

In addition, the first drain inner surface 67*a* may form a flat or curved surface continuous with a sub-outer peripheral surface 57*a* of the sub-oil drain portion 57. Each of the connecting inner surfaces 67*c*1 and 67*c*2 of the second oil drain portion 67 may form a flat or curved surface continuous with each of sub-sides 57*c*1 and 57*c*2 of the sub-oil drain portion 57. As a result, the main outer peripheral surface 47*a*, the first drain inner surface 67*a*, and the sub-outer peripheral surface 57*a* may form a continuous flat or curved surface along the axial direction. Each of the main sides 47*c*1 and 47*c*2, each of the connecting inner surfaces 67*c*1 and 67*c*2, and each of the sub-sides 57*c*1 and 57*c*2 may also form a continuous flat or curved surface along the axial direction. This structure will be explained again hereinafter.

The main oil drain portion 47 may be formed along the circumferential direction of the main bearing 40. In this embodiment, the plurality of main oil drain portions 47 may be arranged to be spaced apart from each other along a circumference of the main bearing 40. In this case, oil may be recovered from several locations in the main bearing 40, that is, from locations with different phase differences.

In this case, the first oil drain portion 47 or 57 may be formed between the main fastening holes 49. Referring to FIG. 7, in FIG. 7, the fasteners B are fastened, so the main fastening holes 49 are covered. The main oil drain portion 47 may be formed between imaginary extension lines T1 and T2 that connects centers of two fasteners B neighboring to each other among the plurality of fasteners B with the center of the rotational shaft 30. In addition, the sub-oil drain portion 57 and the second oil drain portion 67 may also be formed between the imaginary extension lines T1 and T2 connecting the centers of two fasteners B neighboring to each other among the plurality of fasteners B with the center of the rotational shaft 30.

In this case, the oil drain path OP may not interfere with the main fastening holes 49, the cylinder fastening holes 69, and the sub-fastening holes 59 to which the fasteners B are fastened. In this way, when the oil drain path OP and the fastening holes 49, 59, and 69 do not interfere with each other, the fastening holes 49, 59, and 69 may be disposed at positions close to the edge of the compression portion C. As the fastening holes 49, 59, and 69 are required to avoid interference with the compression space V, the compression space V may be secured to be wider as the fastening holes 49, 59, and 69 are arranged toward the edge of the compression portion C. Accordingly, in this embodiment, the compression space V may be secured to be wide, and a compression capacity of the compressor may also be increased.

Referring to FIG. 7, the center of each of the plurality of main fastening holes 49 may be formed between the compression space V and the main oil drain portion 47. Although not shown, the center of each of the plurality of cylinder fastening holes 69 may be formed between the compression space V and the second oil drain portion 67. In addition, although not shown, the center of each of the plurality of sub-fastening holes 59 may be formed between the compression space V and the sub-oil drain portion 57. In this embodiment, as the main fastening holes 49, the cylinder fastening holes 69, and the sub-fastening holes 59 are arranged close to the edge of the compression portion C, the compression space V may be formed to be wide.

The rim 48 may be formed on the upper portion of the first oil drain portion 47 to protrude toward the inner peripheral surface 11*a* of the casing 10 more than each of the first oil drain portion 47 and 57. In this embodiment, an axial height of the first oil drain portion 47 may be lower than or equal to an axial height of the rim 48. In this case, an overall strength of the main bearing 40 may be prevented from being reduced due to the recessed main oil drain portion 47.

The first oil drain portion 47 or 57 may have a same cross-sectional shape along the axial direction. Referring to FIGS. 5 and 6, the main oil drain portion 47 may have the same shape along the axial direction. More precisely, the main oil drain portion 47 may have an approximate oval shape extending circumferentially. When the main oil drain portion 47 has the same cross-sectional shape along the axial direction, a constant passage may be created along an oil recovery path without any holding portions (steps), thereby allowing oil to be recovered smoothly. In addition, when the main oil drain portion 47 has the same cross-sectional shape along the axial direction, machinability for machining the main oil drain portion 47 may also be improved.

Next, referring to the second oil drain portion 67, the second oil drain portion 67 may be formed by axially penetrating one of the main bearing and the cylinder having a larger diameter. In this embodiment, as the outer diameter CW of the cylinder 60 is larger than the outer diameter BW of each of the main bearing 40 and the sub-bearing 50, the second oil drain portion 67 may be formed by axially penetrating the cylinder 60.

As described above, in this embodiment, the second oil drain portion 67 may overlap the main rim 48 in the axial direction, so that a portion of the second oil drain portion 67 may be covered. However, as the main oil drain portion 47 is recessed inward in the radial direction of the main bearing 40, a connecting portion of the main oil drain portion 47 and the second oil drain portion 67 may be made to be sufficiently wide.

Referring to FIG. 14, the second oil drain portion 67 may be formed through the cylinder 60, so that the second oil drain portion 67 may not be exposed to the side or front of the compression portion C. However, the main oil drain portion 47 and the sub-oil drain portion 57 may be disposed on an upper portion and lower portion of the second oil drain portion 67, respectively, and may be exposed to a side and front of the compression portion C.

Figure 15:
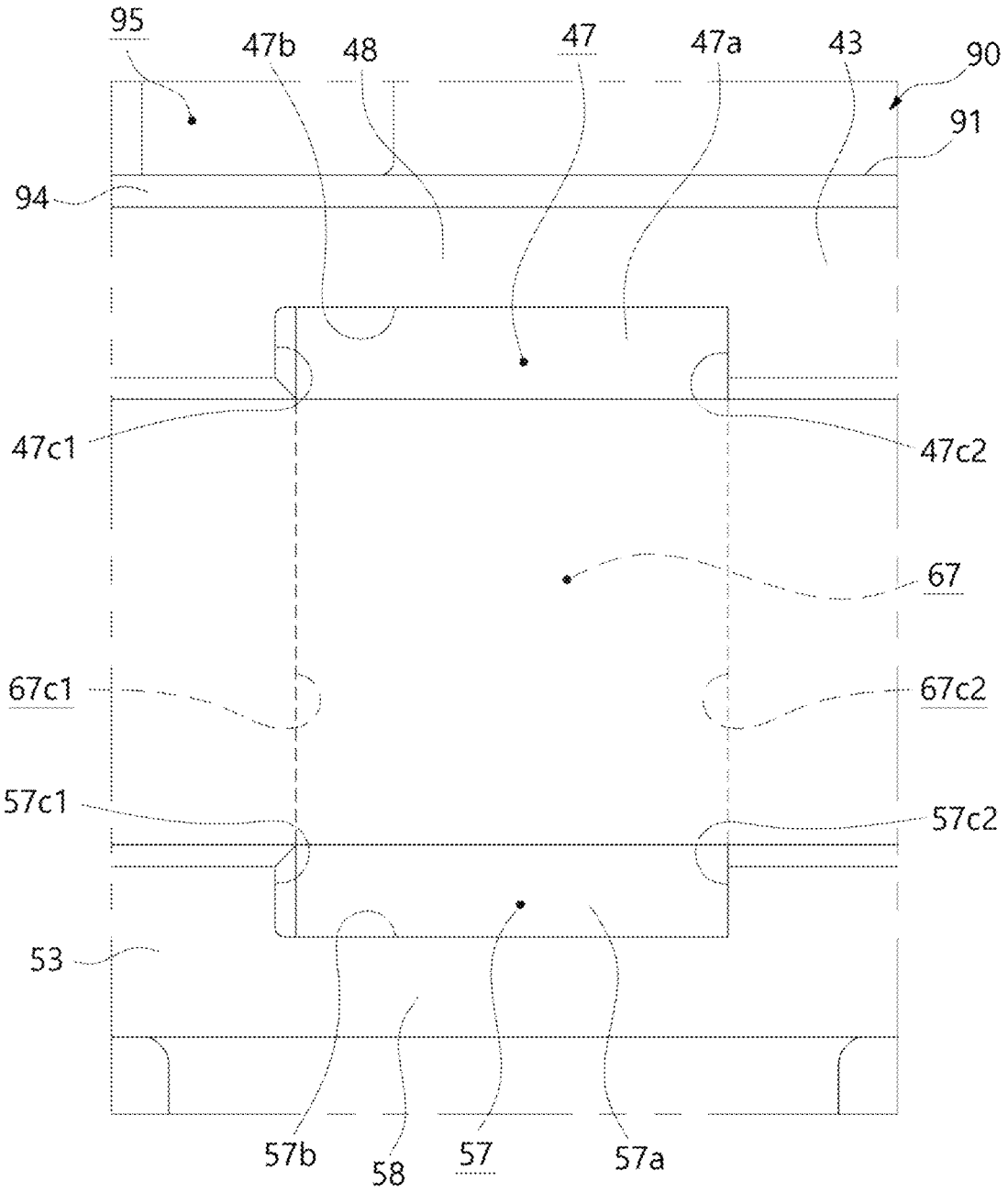
FIG. 15 is an enlarged view of portion A4 of FIG. 14.

Referring to FIG. 15, the second oil drain portion 67 is marked with a dotted line. The upper end of the second oil drain portion 67 may be connected to the main oil drain portion 47. The lower end of the second oil drain portion 67 may be connected to the sub-oil drain portion 57. Accordingly, the oil drain path OP may be formed by the main oil drain portion 47, the second oil drain portion 67, and the sub-oil drain portion 57 connected to each other.

The first oil drain portion 47 and 57 and the second oil drain portion 67 may form an approximately rectangular shape when viewed from the front (in the radial direction) with reference to FIG. 15. This is because the first oil drain portion 47 and 57 and the second oil drain portion 67 have the same widths in the circumferential direction of the compression portion C. In this case, there are no holding portions on opposite sides of the oil drain path OP, and there are no steps that obstruct the flow of oil.

Referring to FIGS. 13 and 15, the second oil drain portion 67 may be formed by axially penetrating the cylinder 60 at the edge of the cylinder 60. The second oil drain portion 67 may be open at upper and lower sides in the axial direction. More specifically, the upper side of the second oil drain portion 67 may be open toward the main oil drain portion 47, and the lower side of the second oil drain portion 67 may be open toward the sub-oil drain portion 57. In other words, the upper portion of the second oil drain portion 67 may be open toward an upper portion of the internal space S, and the lower portion of the second oil drain portion 67 may be open toward the oil storage space RS.

Referring to FIG. 13, the second oil drain portion 67 may include the first drain inner surface 67*a* forming the inner surface of the second oil drain portion 67. The second oil drain portion 67 may include a second drain inner surface 67*b* formed by being spaced apart from the first drain inner surface 67*a*. The second drain inner surface 67*b* may be formed at a position relatively closer to the inner peripheral surface 11*a* of the body shell 11 than the first drain inner surface 67*a*. Accordingly, the first drain inner surface 67*a* and the second drain inner surface 67*b* may face each other, based on the radial direction of the cylinder 60. The third passage P3 may be formed between the first drain inner surface 67*a* and the second drain inner surface 67*b*.

Referring to FIGS. 11 and 15, the connecting inner surfaces 67*c*1 and 67*c*2 may be formed on opposite end portions of the second oil drain portion 67, respectively. The pair of connecting inner surfaces 67*c*1 and 67*c*2 may connect the first drain inner surface 67*a* with the second drain inner surface 67*b*. In this embodiment, each of the pair of connecting inner surfaces 67*c*1 and 67*c*2 may be a curved surface. Accordingly, between the connecting inner surfaces 67*c*1 and 67*c*2, the first drain inner surface 67*a*, and the second drain inner surface 67*b*, a sharp edge may not be formed, but a curved surface may be formed so that oil may flow more efficiently.

The first drain inner surface 67*a*, the second drain inner surface 67*b*, and the pair of connecting inner surfaces 67*c*1 and 67*c*2 may be connected to each other. Accordingly, the first drain inner surface 67*a*, the second drain inner surface 67*b*, and the pair of connecting inner surfaces 67*c*1 and 67*c*2 may form a structure surrounding portions of the second oil drain portion 67 except for the upper and lower portions thereof.

As described above, the first drain inner surface 67*a* may form a flat or curved surface continuous with the first oil drain portion 47 and 57. Referring to FIG. 13, the main outer peripheral surface 47*a* of the main oil drain portion 47 arranged at the upper side thereof may form a flat or curved surface continuous with the first drain inner surface 67*a* arranged at the lower side thereof. In addition, the sub-outer peripheral surface 57*a*, which is arranged under the first drain inner surface 67*a*, may also form a flat or curved surface continuous with the first drain inner surface 67*a*.

Referring to FIG. 8, the second oil drain portion 67 may be formed between the cylinder fastening holes 69. The second oil drain portion 67 may be formed between two adjacent fasteners B among the fasteners B fastened to the plurality of cylinder fastening holes 69. In this case, the oil drain path OP may not interfere with the main fastening holes 49, the cylinder fastening holes 69, and the sub-fastening holes 59 to which the fasteners B are fastened. This structure is the same as the structure of the main oil drain portion 47 described above, and thus, repetitive description thereof has been omitted.

Figure 16:
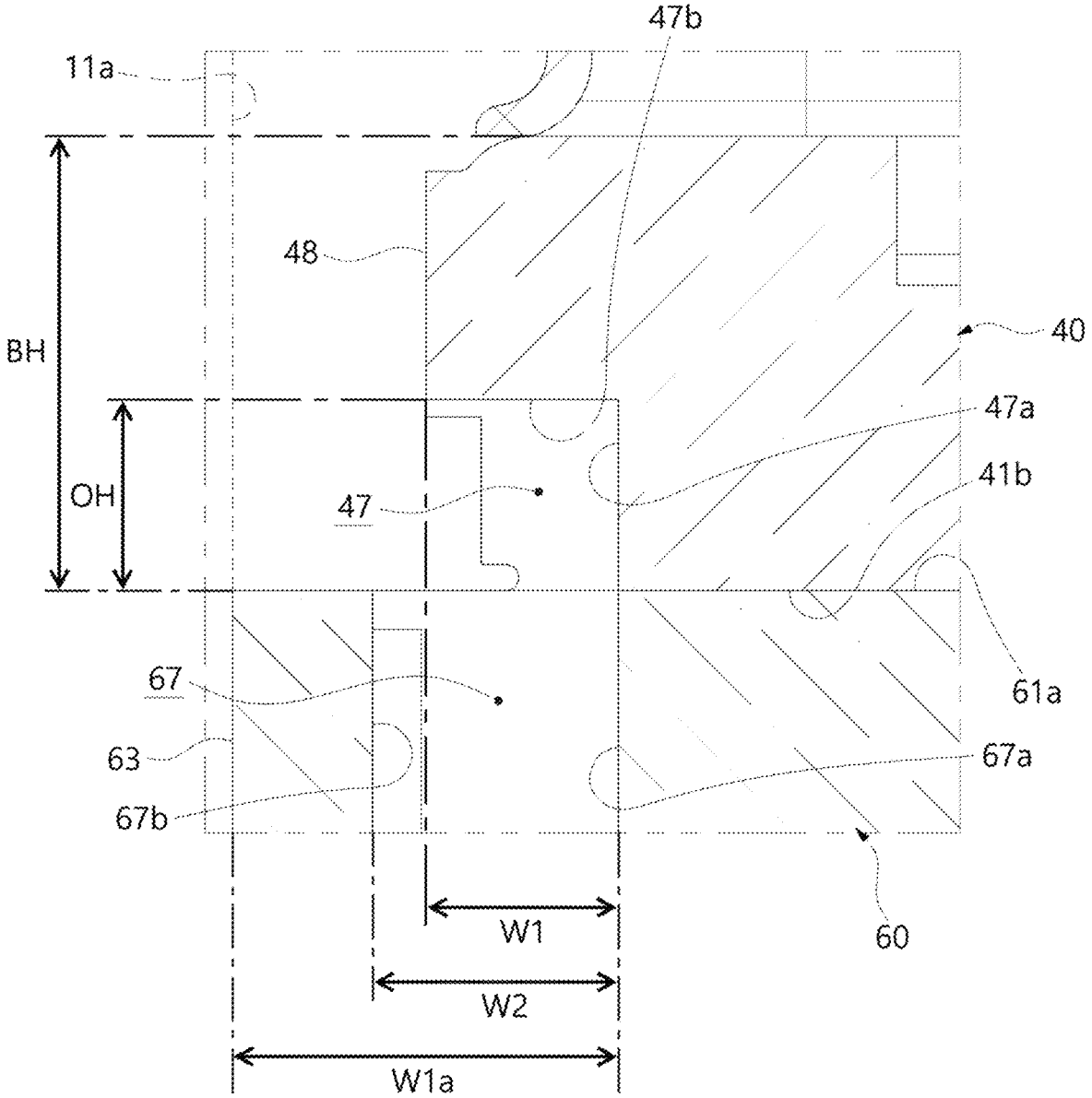
FIG. 16 is an enlarged cross-sectional view showing a first oil drain portion and a second oil drain portion according to an embodiment.

Referring to FIG. 16, which is an enlarged version of a portion of FIG. 13, a radial width of a passage formed between the inner peripheral surface 11*a* of the casing 10 and the first oil drain portion 47 and 57 may be greater than a radial width of the second oil drain portion 67. More precisely, a radial distance W1*a* between the inner peripheral surface 11*a* of the body shell 11 and the main outer peripheral surface 47*a* of the main oil drain portion 47 may be greater than a radial width W2 of the second oil drain portion 67. In this case, the second passage P2 (see FIG. 13) formed by the main oil drain portion 47 may be secured to be wide, so that even if a large amount of oil passes through the second passage P2, a bottleneck phenomenon may be prevented in the second passage P2.

Referring to FIG. 11, which is a plan view, a radial distance between the main rim 48 and the inner peripheral surface 11*a* of the body shell 11 is expressed as L1. A radial distance between the surface of the first oil drain portion 47 and 57 and the inner peripheral surface 11*a* of the body shell 11 is expressed as L2. A radial distance between the second drain inner surface 67*b* and the inner peripheral surface 11*a* of the body shell 11 is expressed as L3. For reference, the surface of the first oil drain portion 47 and 57 refers to the main outer peripheral surface 47*a*, and L2 is the same as W1*a* in FIG. 16.

In this case, a size relationship of L1, L2, and L3 may be L3<L1<L2. In this case, (i) an entire lower part of the first passage P1 formed between the main rim 48 and the inner peripheral surface 11*a* of the body shell 11 may be completely included in the upper end portion of the second passage P2 formed between the main outer peripheral surface 47*a* and the inner peripheral surface 11*a* of the body shell 11, and (ii) at least a portion of the upper end portion of the third passage P3 formed by the second oil drain portion 67 may overlap and be connected to the lower end portion of the second passage P2. Accordingly, the oil drain path OP may form a continuous passage.

In FIG. 11, a radial distance between the second drain inner surface 67*b* and the inner peripheral surface 11*a* of the casing 10 is indicated as L4. The radial distance L4 between the second drain inner surface 67*b* and the inner peripheral surface 11*a* of the casing 10 may be equal to a radial distance L2 between the main outer peripheral surface 47*a* and the inner peripheral surface 11*a* of the body shell 11. Accordingly, a size relationship of L1, L2, L3, and L4 may be L3<L1<L2=L4. Accordingly, the entire upper portion of the third passage P3 may be completely included in the lower end portion of the second passage P2, and a wide connecting space may be formed between the second passage P2 and the third passage P3.

Figure 17:
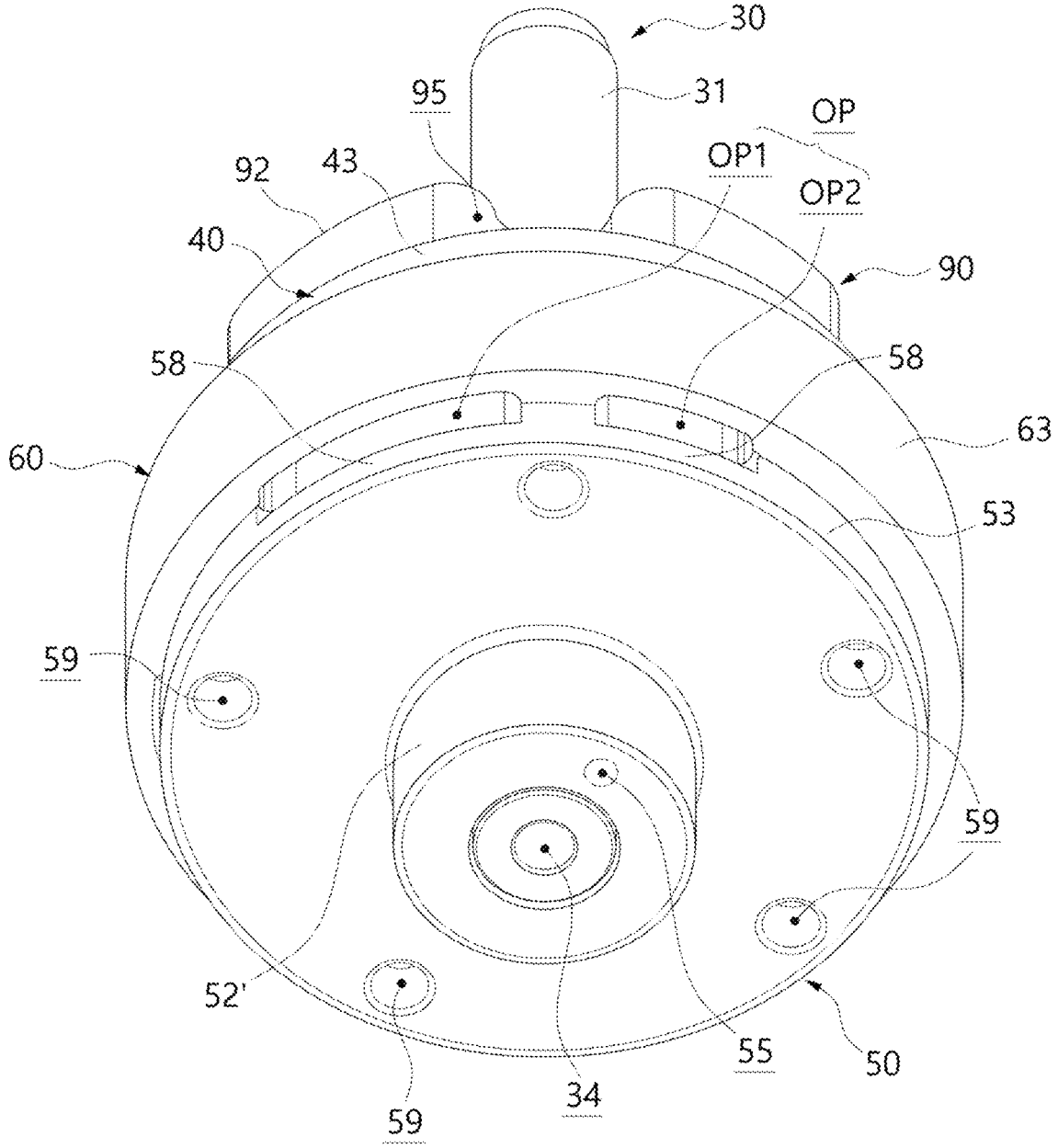
FIG. 17 is a perspective view of the compression portion when viewed at an angle different from angles in FIGS. 3 and 4 according to an embodiment.

Referring to FIG. 17, the sub-oil drain portion 57 is illustrated. The sub-oil drain portion 57 may be recessed inward in the radial direction of the sub-bearing 50 from the outer peripheral surface 53 of the sub-bearing 50. In this embodiment, the sub-oil drain portion 57 may have a structure symmetrical to the main oil drain portion 47. Accordingly, the structure of the sub-oil drain portion 57 is similar to the structure of the main oil drain portion 47 disused above, and components different from the main oil drain portion 47 will be described hereinafter.

The sub-oil drain portion 57 may be connected to the second oil drain portion 67. Accordingly, the main oil drain portion 47 and the sub-oil drain portion 57 may form the oil drain path OP via the second oil drain portion 67. In FIG. 17, only the open appearance of the sub-oil drain portion 57 is shown, but the second oil drain portion 67 may be continuously formed above the sub-oil drain portion 57.

The sub-oil drain portion 57 may extend from a point axially upward from a lower end of the outer peripheral surface 53 of the sub-bearing 50 to an upper end of the outer peripheral surface 53 of the above sub-bearing 50. The sub-rim 58 may be provided from the lower end of the outer peripheral surface 53 of the sub-bearing 50 to a point upward in the axial direction, and the sub-oil drain portion 57 may be formed from an axial upper end of the sub-rim 58 to an axial upper end of the sub-bearing 50. That is, the upper end of the sub-oil drain portion 57 may be regarded to be open toward the second oil drain portion 67.

Referring to FIG. 13, a fourth passage P4 formed by the sub-bearing 50 may be formed between the sub-oil drain portion 57 and the inner peripheral surface 11*a* of the body shell 11. The fourth passage P4 may be axially connected to a fifth passage P5 formed at a lower portion of the sub-oil drain portion 57. Accordingly, the second oil drain portion 67 may be connected to the fifth passage P5 forming an outlet of the oil drain path OP via the fourth passage P4 formed between the sub-oil drain portion 57 and the inner peripheral surface 11*a* of the body shell 11. As a result, the sub-oil drain portion 57 having a relatively recessed shape may be implemented while maintaining an entire area formed by the lower surface of the sub-bearing 50 and a radius of the sub-rim 58.

Referring to FIGS. 13 and 15, the sub-oil drain portion 57 may include the sub-outer peripheral surface 57*a* forming the outer peripheral surface 53 of the sub-bearing 50, a sub-lower surface 57*b* forming a lower surface of the sub-oil drain portion 57, and the sub-sides 57*c*1 and 57*c*2 forming sides of the sub-oil drain portion 57. The sub-lower surface 57*b* may be connected to an axial lower end portion of the sub-outer peripheral surface 57*a*. The sub-sides 57*c*1 and 57*c*2 may be connected to opposite circumferential end portions of the sub-outer peripheral surface 57*a*. Accordingly, the sub-oil drain portion 57 may have a structure in which the lower end portion and opposite end portions thereof are surrounded by the sub-lower surface 57*b* and the sub-sides 57*c*1 and 57*c*2, respectively. In addition, the axial upper end portion of the sub-oil drain portion 57 may be connected to the lower end portion of the second oil drain portion 67.

Referring to FIG. 17, the sub-oil drain portion 57 may be formed between the sub-fastening holes 59. The sub-oil drain portion 57 may be formed between two adjacent sub-fastening holes 59 among the plurality of sub-fastening holes 59. In this case, the oil drain path OP may not interfere with the main fastening holes 49, the cylinder fastening holes 69, and the sub-fastening holes 59 to which the fasteners B are fastened. This structure is the same as the structure of the main oil drain portion 47 and the second oil drain portion 67 described above, and thus, repetitive description thereof has been omitted.

Figure 18:
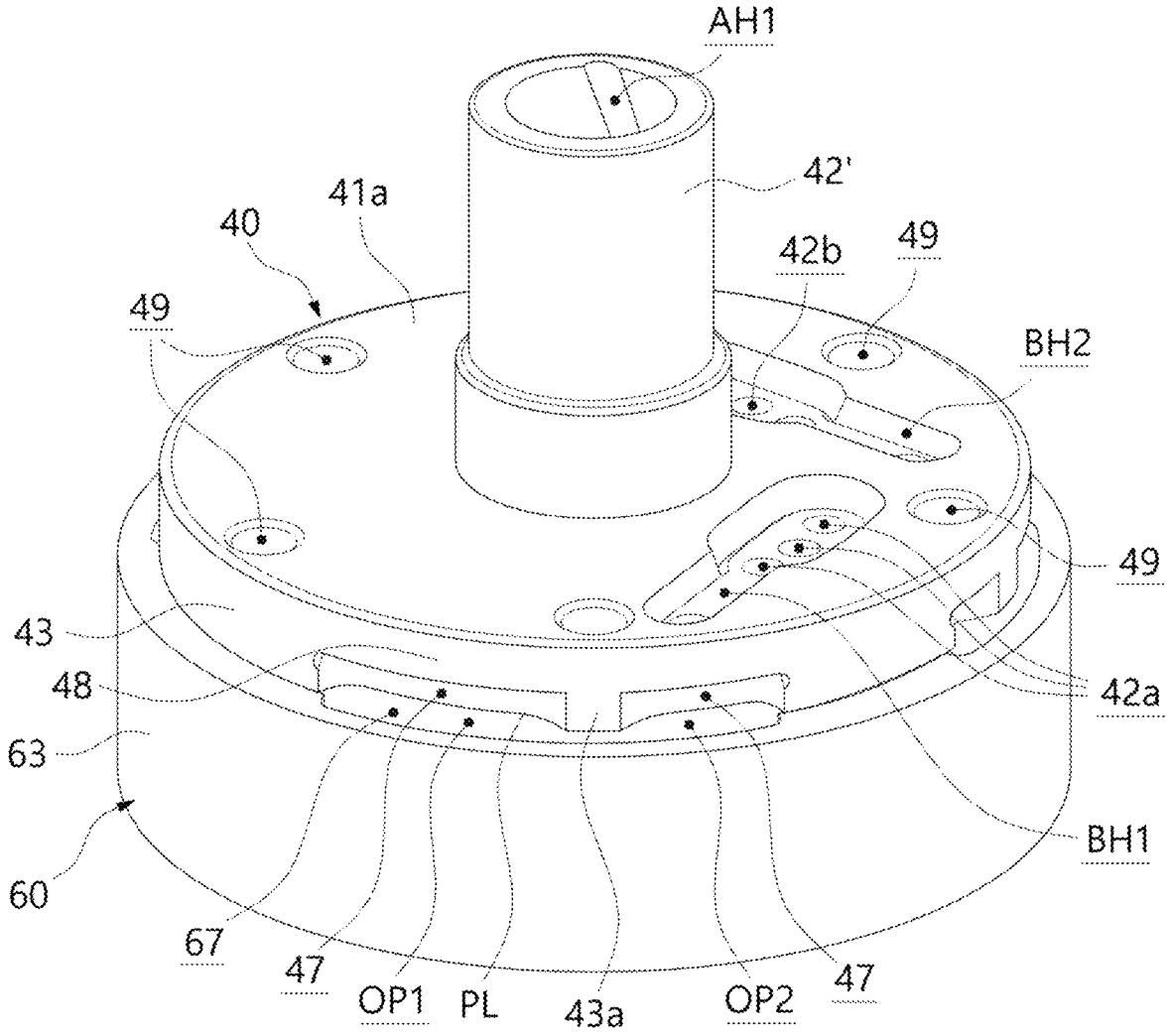
FIG. 18 is a perspective view of the compression portion with a discharge muffler removed according to an embodiment.
Figure 19:
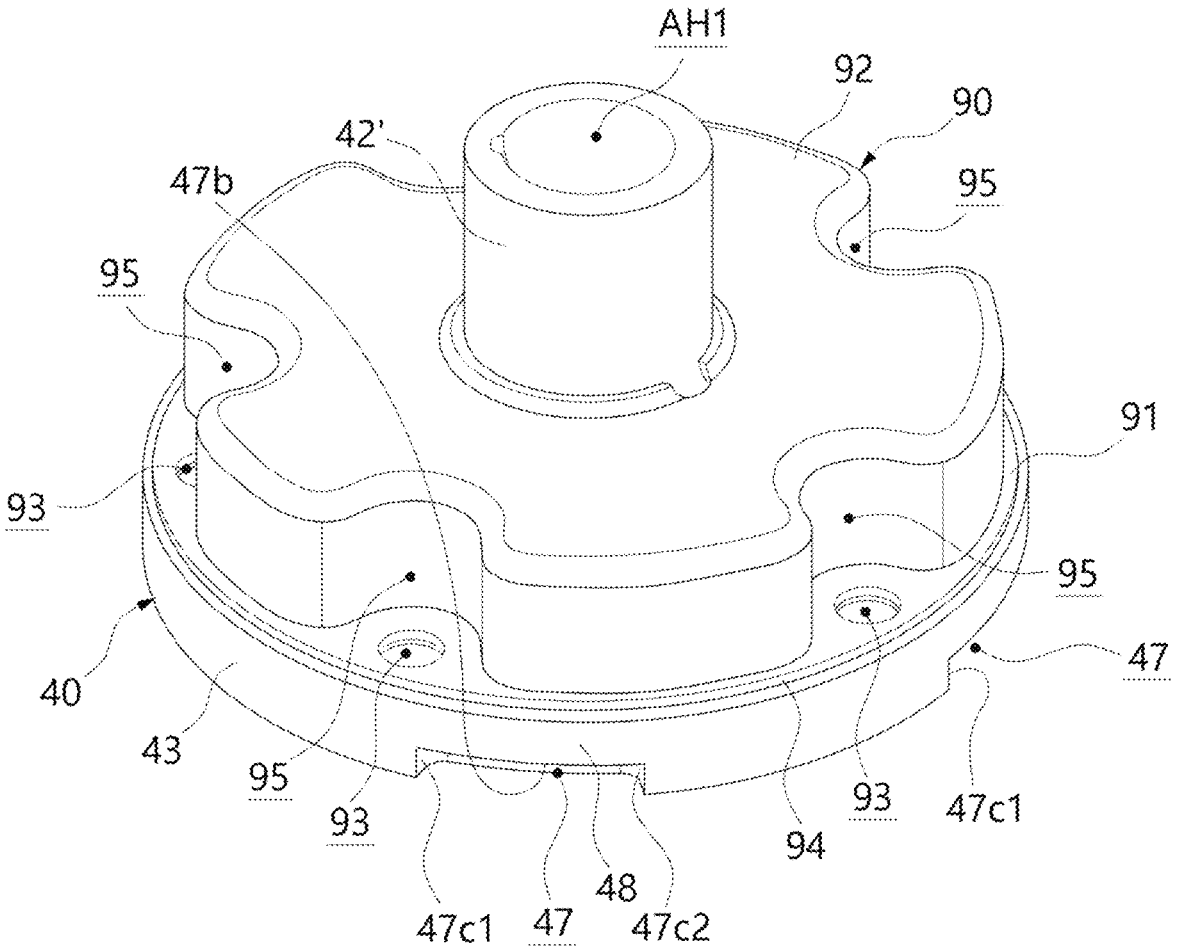
FIG. 19 is a perspective view illustrating a state in which a main bearing and the discharge muffler are coupled to each other according to an embodiment.

Referring to FIG. 18, the plurality of oil drain paths OP is illustrated. FIG. 18 illustrates first oil drain path OP1 and second oil drain path OP2 of the plurality of oil drain paths OP. The first oil drain path OP1 and the second oil drain path OP2 may be separated from each other and may form independent paths. The main bearing 40 may include a partition wall 43*a* provided between the plurality of main oil drain portions 47 to separate the main oil drain portions 47 from each other. Likewise, the outer peripheral surface 63 of the cylinder 60 and the outer peripheral surface 53 of the sub-bearing 50 may respectively include partition portions connected to the partition wall 43*a*.

The plurality of oil drain paths OP1 and OP2 may be disposed along the circumferential direction of the compression portion C. More precisely, the plurality of oil drain paths OP1 and OP2 may be disposed between the plurality of fastening holes B. In this case, oil may be recovered from several locations in the compression portion C.

Figure 20:
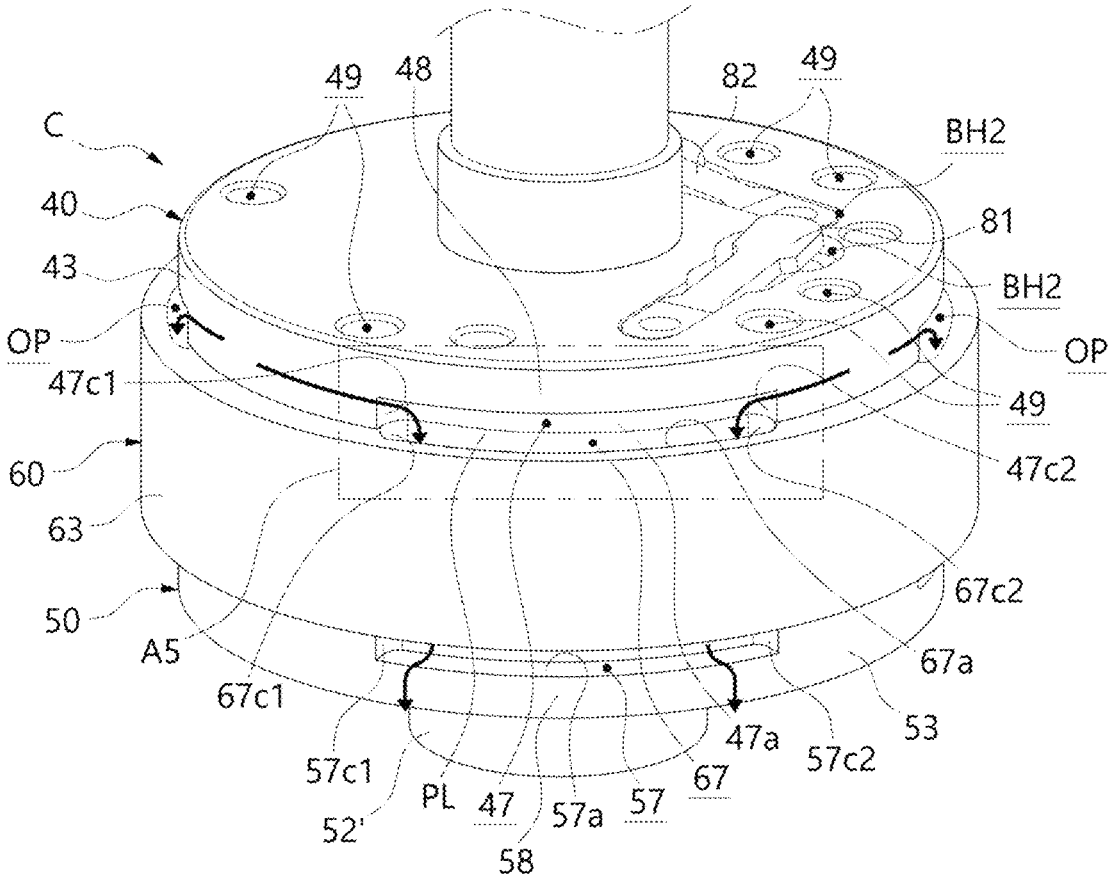
FIG. 20 is a perspective view illustrating oil moving through an oil drain path according to an embodiment.
Figure 21:
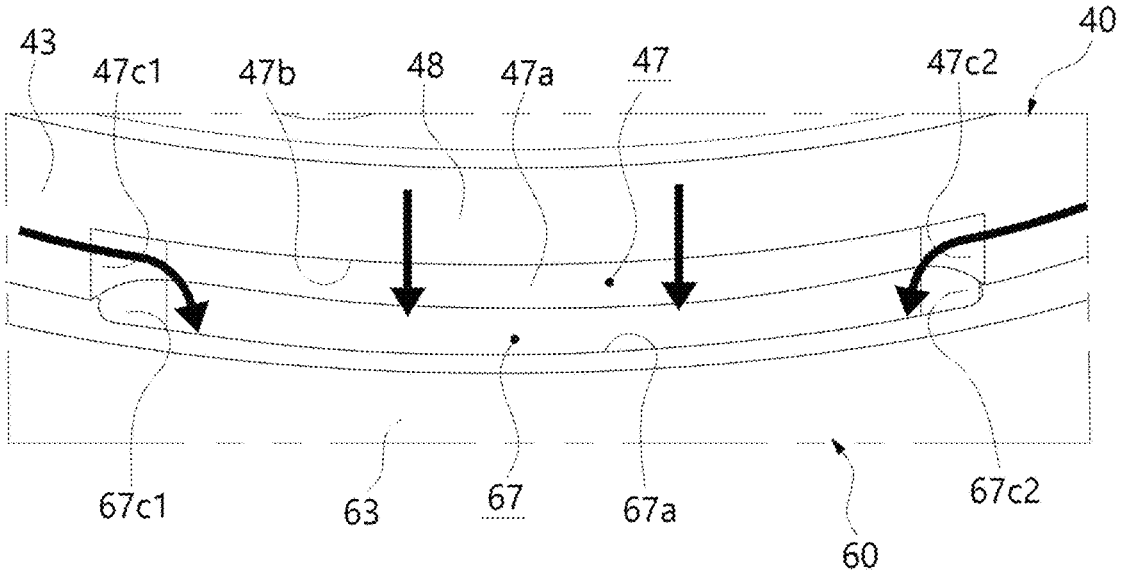
FIG. 21 is an enlarged view of portion A5 of FIG. 20.

Referring to FIGS. 20 and 21, paths through which oil is recovered through the oil drain paths OP formed in the compression portion C are indicated by arrows. As shown in the drawings, oil flowing along the upper surface of the main bearing 40 forming the compression portion C, or along the surface of the discharge muffler 90 and the inner peripheral surface 11*a* of the body shell 11 although omitted in FIG. 20 may flow between the inner peripheral surface 11*a* of the body shell 11 and the outer peripheral surface 43 of the main bearing 40. Further, oil may flow through the main oil drain portion 47 recessed in the outer peripheral surface 43 of the main bearing 40 into the oil drain paths OP. Accordingly, each of the main oil drain portions 47 may be regarded as an inlet of a path through which oil is recovered.

Referring to FIG. 21, oil may flow along the surface of the main rim 48 provided on the upper side of the main oil drain portion 47. In addition, oil collected in a space formed by the outer peripheral surface 43 of the main bearing 40, the upper surface of the cylinder 60, and the inner peripheral surface 11*a* of the body shell 11 may move in the circumferential direction of the cylinder 60 and flow into the main oil drain portion 47.

The oil that flows into the main oil drain portion 47 in this way may move downward along the oil drain path OP. In FIG. 20, reference numeral PL represents a surface on which the main oil drain portion 47 and the second oil drain portion 67 are in close contact. In this way, when the main oil drain portion 47 and the second oil drain portion 67 are in close contact with each other, the continuous oil drain path OP is formed. As described above, as the first oil drain portion 47 and 57 and the second oil drain portion 67 form a continuous flat or curved surface, oil may smoothly flow without being stagnant due to a step structure.

The oil drain path OP may include a first path formed between the outer peripheral surface 43 of the main bearing 40 and the inner peripheral surface 11*a* of the casing 10. The first path may be connected to a second path formed by axially penetrating the cylinder 60. A third path may be formed between the outer peripheral surface 53 of the sub-bearing 50 and the inner peripheral surface 11*a* of the casing 10. The third path may be connected to the second path and may be open to the oil storage space RS. In this case, the first path and the second path may be axially connected to each other, and the second path and the third path may also be axially connected to each other.

In this case, at least one of the first path or the third path may be configured such that portions having different radial widths of the compression portion C are axially connected to each other. Referring to FIG. 13, in this embodiment, the first passage P1 included in the first path may have a narrower radial width than the second passage P2. In addition, the fifth passage P5 included in the third path may have a narrower radial width than the fourth passage P4.

Referring back to FIG. 16, a total axial height of the main rim 48 and the main oil drain portion 47 is indicated as BH, and an axial height of the main oil drain portion 47 is indicated as OH. The total axial height BH of the main rim 48 and the main oil drain portion 47 may also be regarded as the axial height BH of the main bearing 40. The main oil drain portion 47 may occupy only the partial height OH of the total axial height BH.

In this case, a relative ratio OH/BH of the axial height OH of the main oil drain portion 47 to the total axial height BH of the main rim 48 and the main oil drain portion 47 may be 0.2 to 0.35. When the relative ratio OH/BH is less than 0.2, the axial height occupied by the main oil drain portion 47 may be low, so a height of the second passage P2, which is a passage between the first passage P1 and the third passage P3, may be low, and smooth oil transfer may not be achieved. Conversely, when the relative ratio OH/BH is greater than 0.35, an oil recovery rate may no longer increase and remain unchanged.

Figure 22:
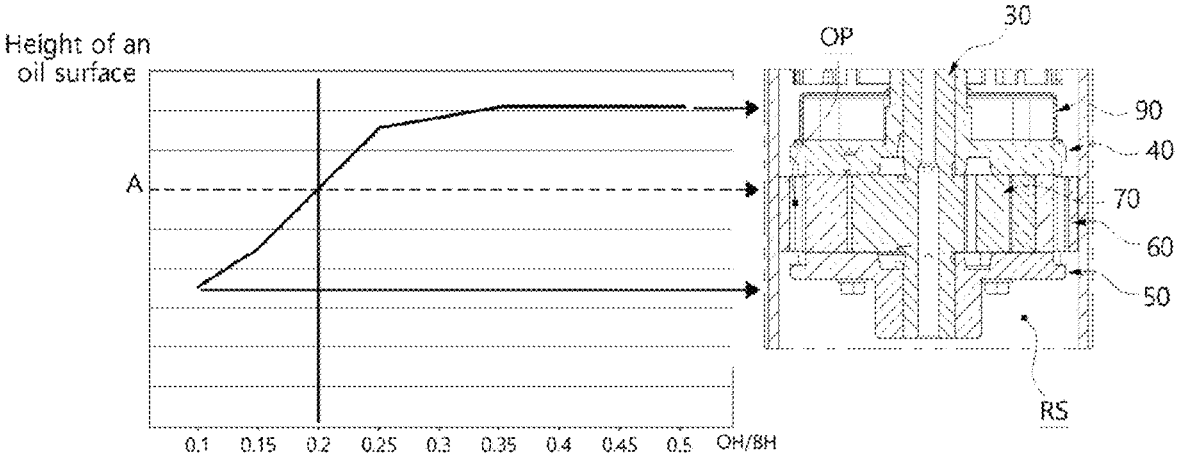
FIG. 22 is a graph illustrating a height of an oil surface according to a height of the first oil drain portion according to an embodiment.

FIG. 22 shows a graph of oil surface height according to the relative ratio OH/BH. The oil surface height refers to height formed by the oil inside of the casing 10. The oil surface height must be at least height A at which the roller 70 is located to enable smooth lubrication. When oil recovery is not smooth, oil floats inside of the compressor and fails to perform a lubricating function thereof, and accordingly, the oil surface height may also be lowered. In FIG. 22, A represents a minimum oil surface height for smooth operation of the compressor.

As shown in FIG. 22, when the relative ratio OH/BH is less than 0.2, the oil surface height may be lower than the minimum oil surface height A, causing a problem in lubrication function. Conversely, when the relative ratio OH/BH is greater than 0.35, it can be seen that the oil surface height no longer increases and is maintained. Accordingly, considering durability of the main bearing 40, the relative ratio OH/BH may be set to 0.35 or less rather than further increasing the axial height OH of the main oil drain portion 47.

Figure 23:
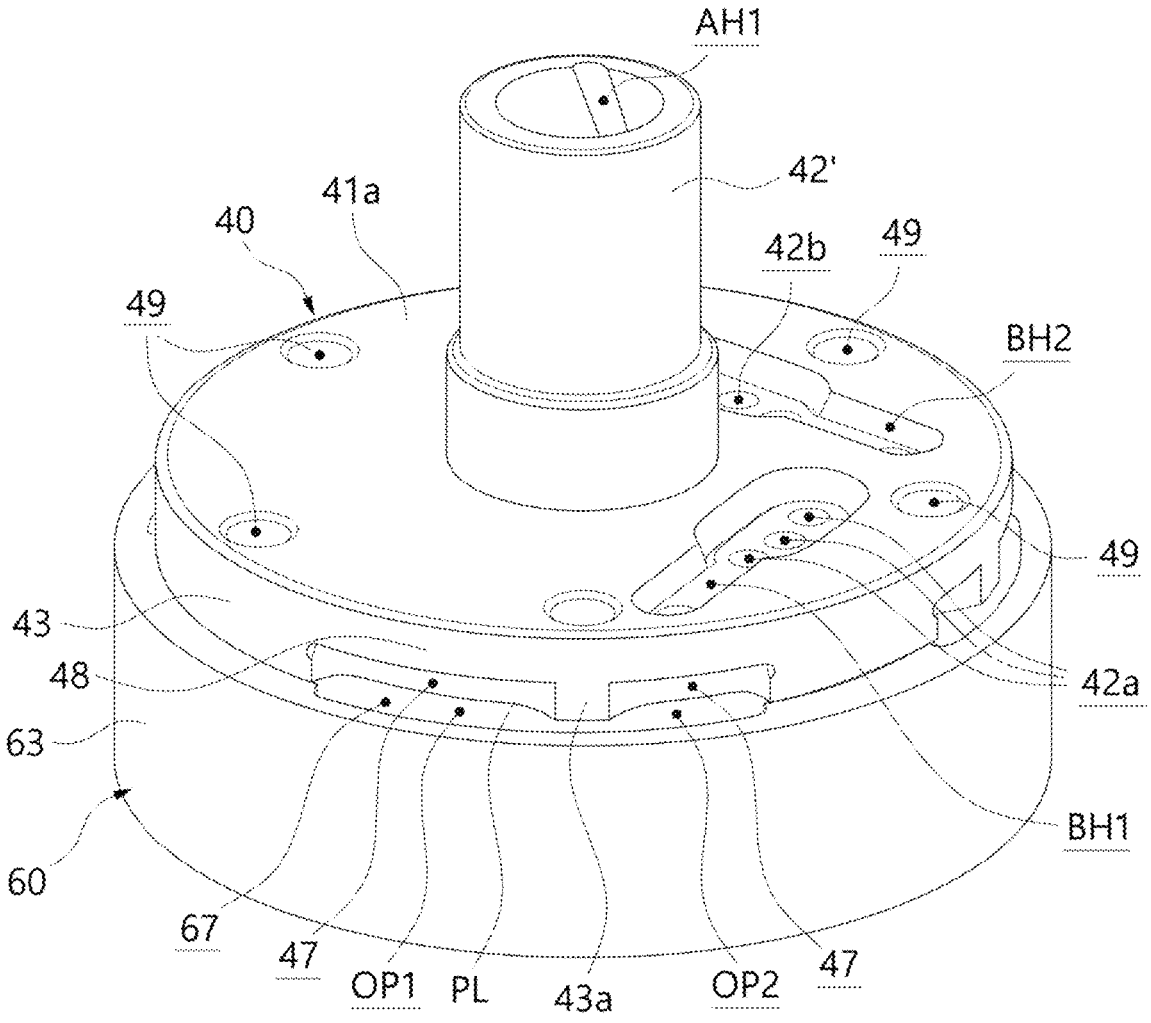
FIG. 23 is a perspective view of a compression portion of a compressor according to another embodiment.

FIG. 23 illustrates a compression portion of a compressor according to another embodiment. Components identical to those of the previously described embodiments are given the same reference numerals and repetitive description thereof has been omitted. As shown in the drawing, main oil drain portion 147 may be continuous from an upper end of an outer peripheral surface of main bearing 40 to a lower end of the outer peripheral surface of the main bearing 40. That is, unlike the previous embodiments, main rim 48 is omitted in the axial upper portion of the main oil drain portion 147. However, this structure may be applied only to a location at which main fastening holes 49 are not arranged at the upper end portion of the main oil drain portion 147. As shown in FIG. 23, a portion of the main oil drain portion 47 provided in the main bearing 40 may not extend to the upper end of the outer peripheral surface of the main bearing 40, while another portion thereof may extend to the upper end of the outer peripheral surface of the main bearing 40.

Figure 24:
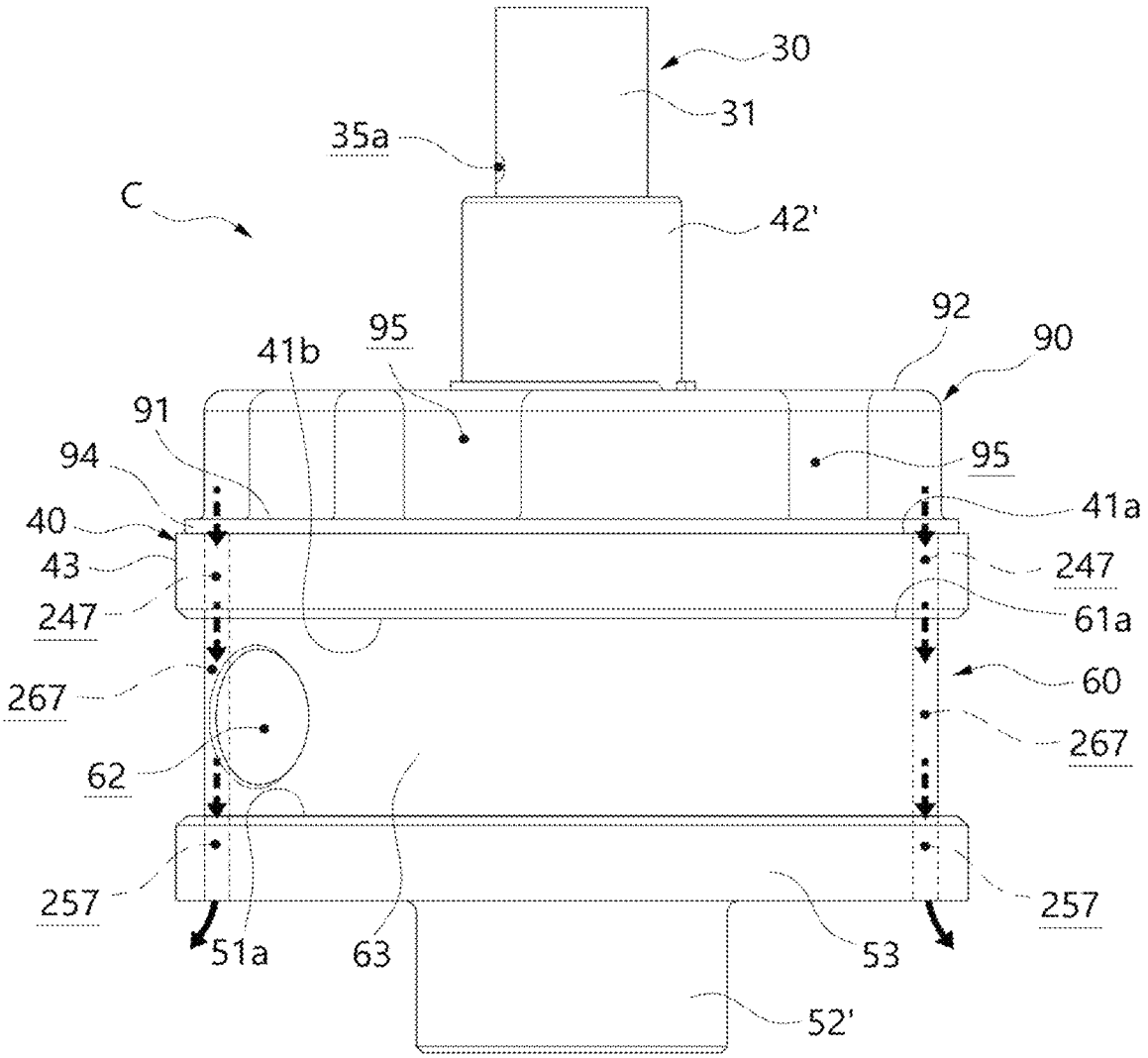
FIG. 24 is a side view of a compression portion of a compressor according to still another embodiment.

FIG. 24 illustrates a side view of a compression portion of a compressor according to another embodiment. Components identical to those of the previously described embodiments are given the same reference numerals and repetitive description thereof has been omitted. As shown in the drawing, in this embodiment, a diameter of each of main bearing 40 and sub-bearing 50 is larger than a diameter of cylinder 60. Accordingly, the main bearing 40 or the sub-bearing 50 may be fixed to inner peripheral surface 11*a* of body shell 11.

In this case, first oil drain portion 267 may be formed on outer peripheral surface 63 of the cylinder 60 by being recessed inward in the radial direction of the cylinder 60. The main bearing 40 and the sub-bearing 50 may include second oil drain portion 247 and 257, respectively, formed by penetrating the main bearing 40 and the sub-bearing 50 in the axial direction of the compression portion C. In this embodiment, each of the first oil drain portion 267 may be axially connected to an entirety or a portion of the second oil drain portion 247 and 257. Accordingly, the first oil drain portion 267 and the second oil drain portion 247 and 257 may be connected to each other to form the oil drain path OP. In this embodiment, the discharge muffler 90 may have a shape so as not to cover the inlet of the oil drain path OP, which is the upper end portion of the main oil drain portion 247 among the second oil drain portion 247 and 257.

Figure 25:
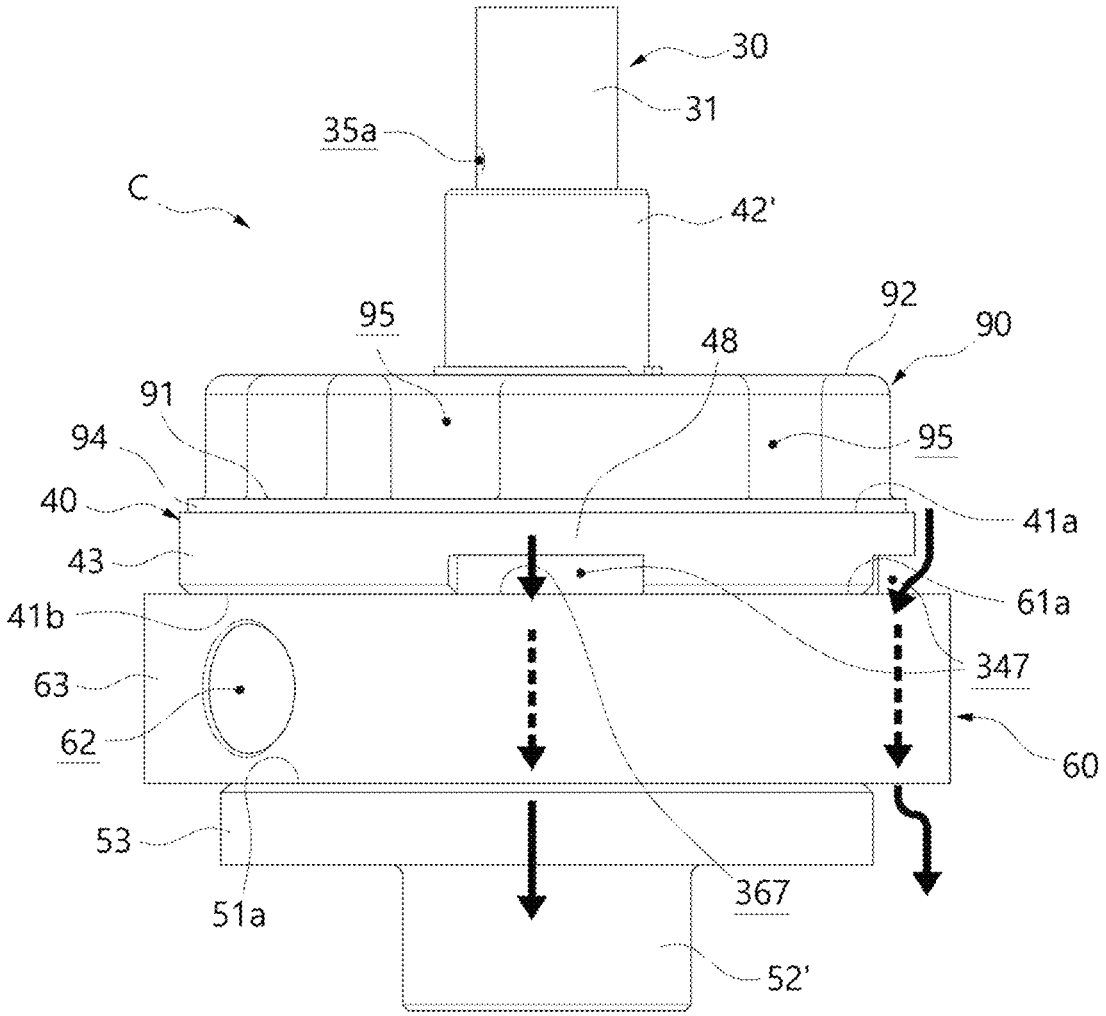
FIG. 25 is a side view of a compression portion of a compressor according to still another embodiment.

FIG. 25 illustrates a side view of structure of a compression portion of a compressor according to yet another embodiment. Components identical to those of the previously described embodiments are given the same reference numerals and repetitive description thereof has been omitted. As shown in the drawing, the first oil drain portion may be omitted in sub-bearing 50. In this embodiment, a diameter of the sub-bearing 50 may be smaller than a diameter of main bearing 40. Accordingly, as the sub-bearing 50 at a lower portion of the second oil drain portion 67 does not cover the outlet of the oil drain path OP, which is a lower end portion of the second oil drain portion 67, a separate sub-oil drain portion may be omitted from the sub-bearing 50.

Figure 26:
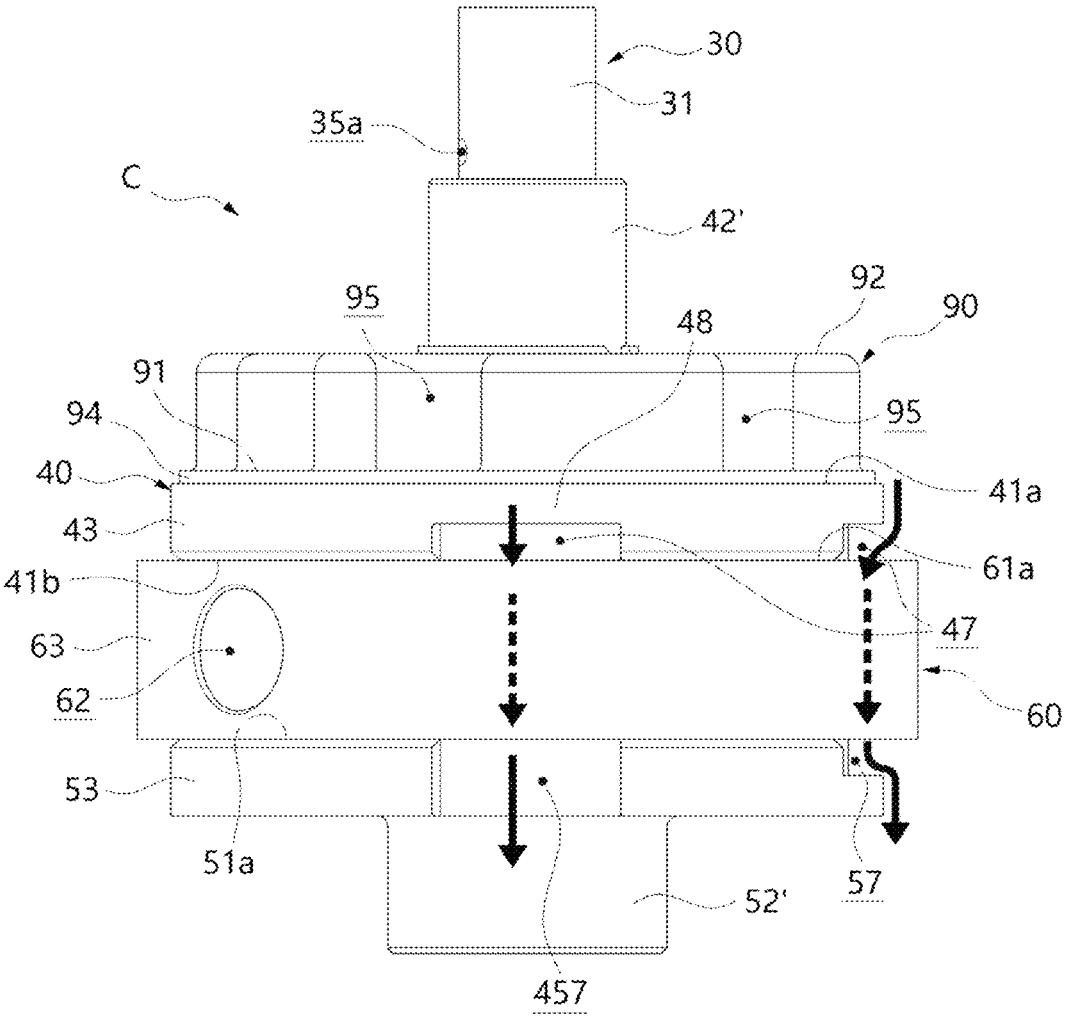
FIG. 26 is a side view of a compression portion of a compressor according to yet another embodiment.

FIG. 26 illustrates a side view of a compression portion of a compressor according to still another embodiment. As shown in the drawing, a sub-oil drain portion 457 formed in sub-bearing 50 among the first oil drain portion 47 and 57 may be continuous from an upper end of outer peripheral surface 53 of the sub-bearing 50 to a lower end of the outer peripheral surface 53 of the sub-bearing 50. That is, unlike the previous embodiments, the sub-rim may be omitted at the axial lower portion of the sub-oil drain portion 457. However, this structure may be applied only to a location at which the main fastening holes are not arranged at the lower end portion of the sub-oil drain portion 457. As illustrated in FIG. 26, a portion of the sub-oil drain portion 457 provided in the sub-bearing 50 may not extend to the lower end of the outer peripheral surface 53 of the sub-bearing 50, while another portion thereof may extend to the lower end of the outer peripheral surface 53 of the sub-bearing 50.

Figure 27:
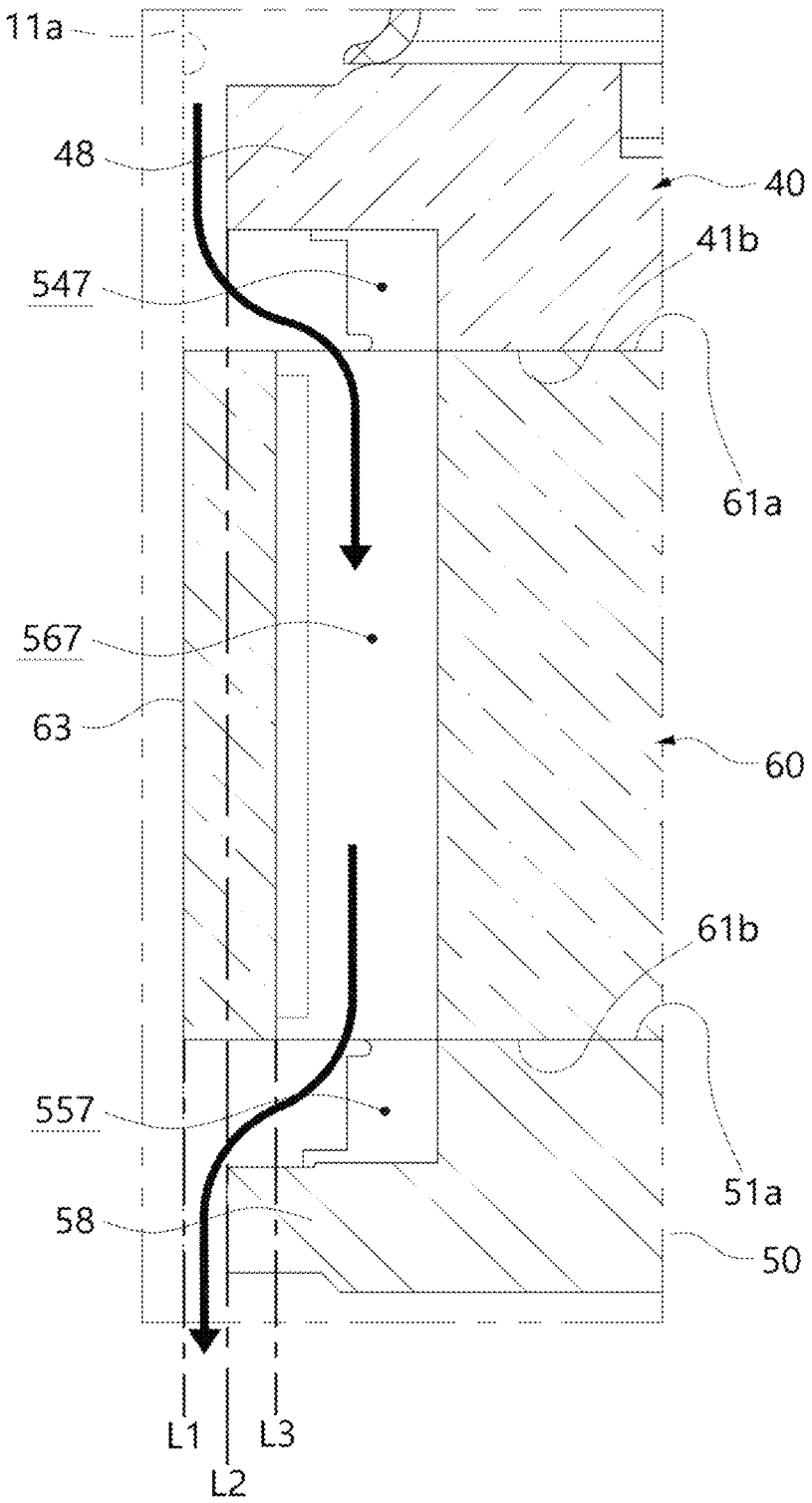
FIG. 27 is a cross-sectional view of an oil drain path of a compressor according to an additional embodiment.

FIG. 27 illustrates a cross-sectional view of oil drain path OP of a compressor according to yet another embodiment. Components identical to those of the previously described embodiments are given the same reference numerals and repetitive description thereof has been omitted. As shown in the drawing, a main oil drain portion 547 of first oil drain portion 547 and 557 may be formed in main bearing 40, and main rim 48 may protrude from an axial upper portion of the main oil drain portion 547.

In this case, the main rim 48 may cover the upper end portion of a second oil drain portion 567 formed on an axial lower portion. In this embodiment, the main rim 48 may overlap an entirety of the upper end portion of the second oil drain portion 567 in the axial direction. More specifically, when an imaginary extension line that extends axially along the inner peripheral surface 11*a* of the body shell 11 is referred to as L1, an imaginary extension line that extends axially along the outer peripheral surface of the main rim 48 is referred to as L2, and an imaginary extension line that extends axially along an inner peripheral surface relatively close to the inner peripheral surface 11*a* of the body shell 11 in the inner peripheral surface of the second oil drain portion 567 is referred to as L3, L2 may be formed between L1 and L3. Even in this case, as the above L2 is spaced apart from the L1, an inlet of the oil drain path OP through which oil may pass may be secured.

Figure 28:
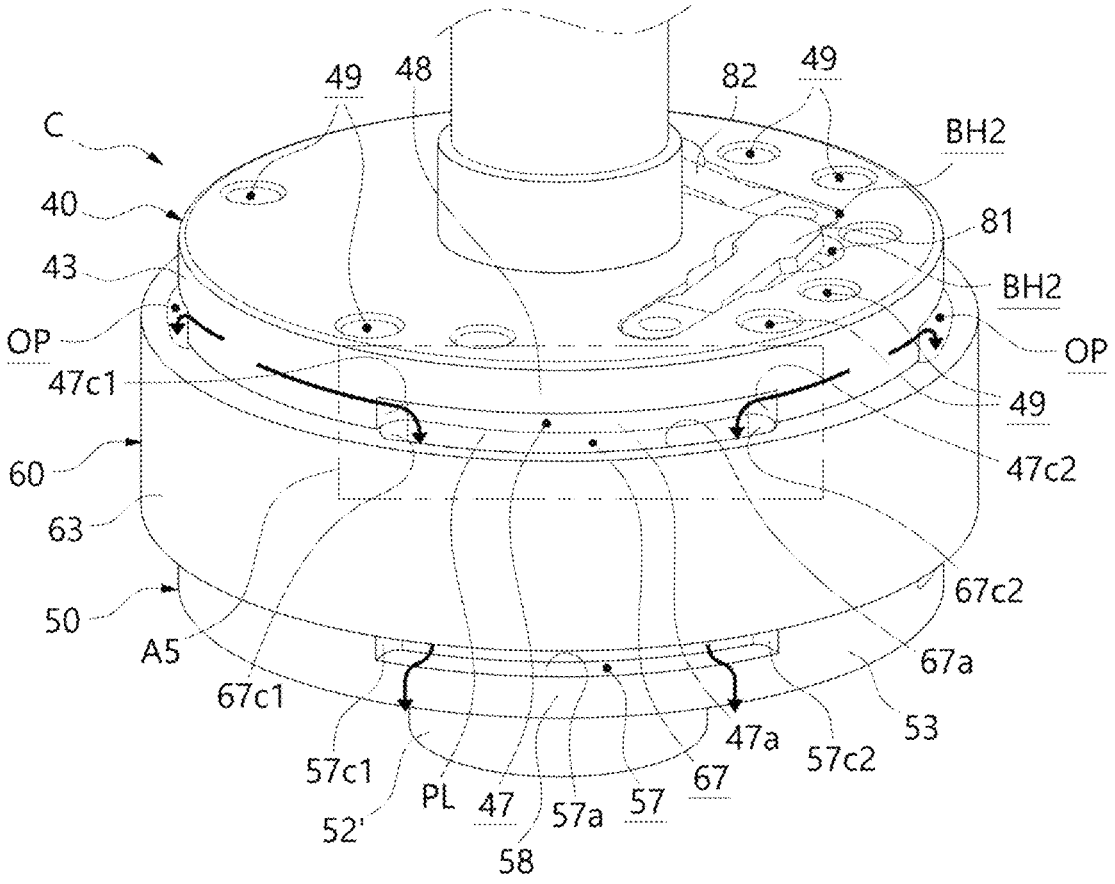
FIG. 28 is a perspective view of a compression portion of a compressor according to yet another embodiment.

FIG. 28 illustrates a perspective view of a compression portion forming a compressor according to yet another embodiment. Components identical to those of the previously described embodiments are given the same reference numerals and repetitive description thereof has been omitted. As shown in the drawing, main oil drain portion 647 and sub-oil drain portion 657 of first oil drain portion 647 and 657 may have sizes different from each other. More specifically, the main oil drain portion 647 and the sub-oil drain portion 657 may have different widths in the circumferential direction. In this embodiment, a circumferential width of the main oil drain portion 647 may be narrower than a circumferential width of the sub-oil drain portion 657. For another example, the circumferential width of the main oil drain portion 647 may be larger than the circumferential width of the sub-oil drain portion 657.

Figure 29:
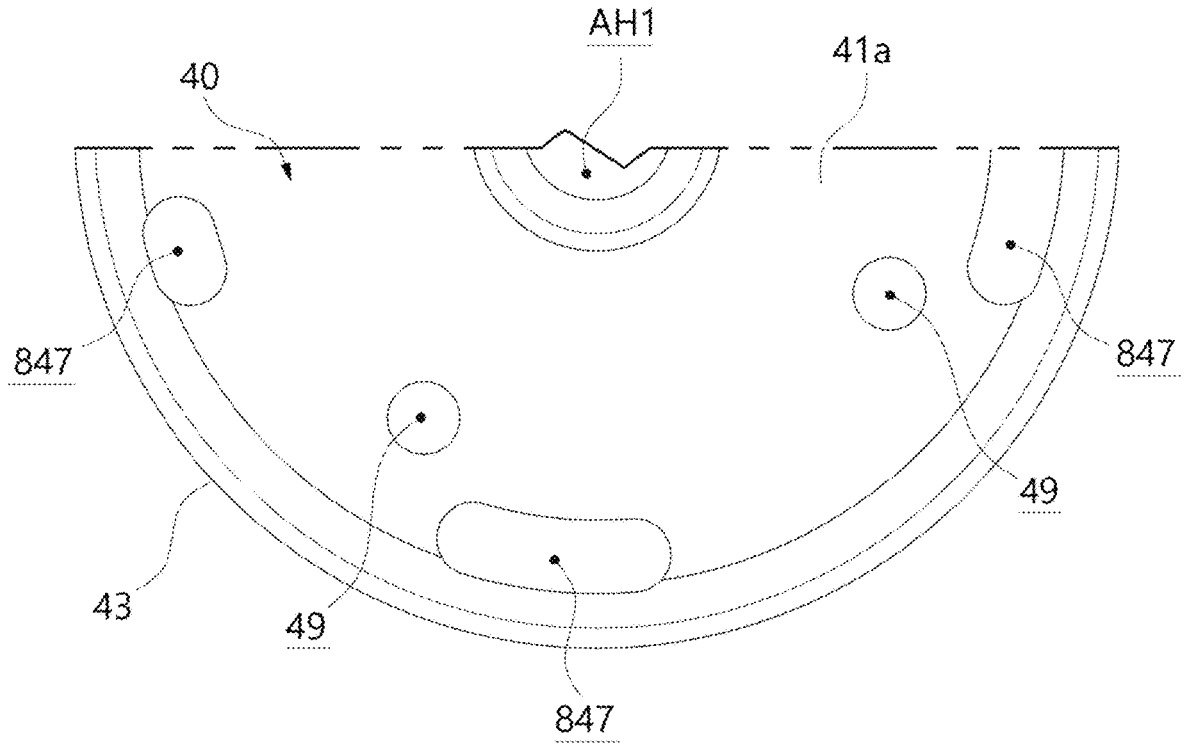
FIG. 29 is a plan view of a main bearing of a compressor according to still another embodiment.

FIG. 29 illustrates a plan view of a main bearing of a compressor according to yet another embodiment. Components identical to those of the previously described embodiments are given the same reference numerals and repetitive description thereof has been omitted. As shown in the drawing, in this embodiment, a second oil drain portion 847 may be formed in main bearing 40. In this case, the plurality of second oil drain portion 847 may be disposed along the circumferential direction of the main bearing 40. In addition, circumferential widths of the plurality of second oil drain portion 847 may be different from each other.

Figure 30:
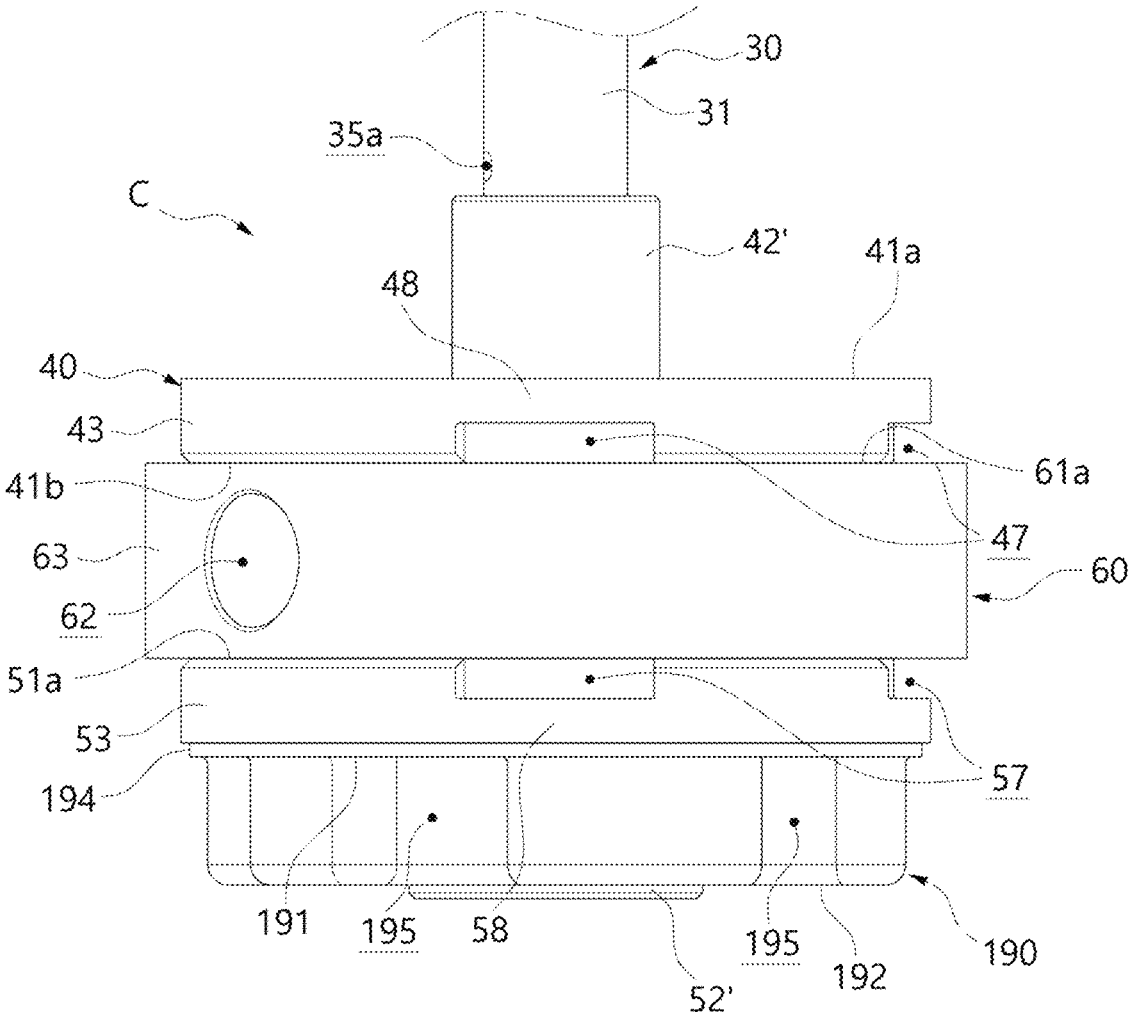
FIG. 30 is a side view of a compression portion of a compressor according to still another embodiment.

FIG. 30 illustrates a side view of a compression portion of a compressor according to yet another embodiment. Components identical to those of the previously described embodiments are given the same reference numerals and repetitive description thereof has been omitted. As shown in the drawing, discharge muffler 190 may be disposed not on an upper surface of main bearing 40 but on a lower surface of sub-bearing 50. In this embodiment, as the lower surface of the sub-bearing 50 is in a regular circular shape, the lower surface thereof may provide a sufficient area on which the discharge muffler 190 may be seated. Although not shown, for another example, the discharge muffler 190 may be omitted.

Accordingly, embodiments disclosed herein have been developed keeping in mind the above problems occurring in the related art, and to ensure a wide oil recovery path between a side (outer peripheral surface) of a compression portion and an inner peripheral surface of a casing even when outer diameters of components of the compression portion are similar to each other.

Embodiments disclosed herein expand the oil recovery path while securing a wide compression chamber.

Embodiments disclosed herein enable oil to be recovered through the oil recovery path formed between the compression portion and the casing even if an oil drain hole formed in the compression portion is covered by other components.

Embodiments disclosed herein secure a sufficient area for mounting a muffler on the main bearing or the sub-bearing while forming a passage for oil recovery on the edge of a main bearing or a sub-bearing.

Embodiments disclosed herein provide the oil recovery path with a wide and simple shape on the outer peripheral surface of the compression portion without making an oil recovery path with a complex shape at a center portion of the compression portion.

Embodiments disclosed herein provide a compressor that may include a casing, and an electric drive unit that is disposed inside of the casing and rotates a rotational shaft. A compression part or portion may be disposed inside of the casing. The compression part may include a cylinder, a main bearing, and a sub-bearing which together define a compression space. In this case, first oil drain part or portion may be formed to be recessed radially inward on an outer peripheral surface of any one of the main bearing or the cylinder which has a relatively smaller diameter. A second oil drain part or portion may be formed by penetrating, in an axial direction, a remaining one of the main bearing or the cylinder which has a relatively larger diameter. Each of the first oil drain part and each of second oil drain part may be connected to each other in the axial direction to form an oil drain path. Accordingly, through the oil drain path, an oil recovery rate may be increased and components inside of the compressor may be efficiently lubricated by oil, thereby increasing lubrication performance and operational reliability.

The first oil drain part may be formed in the main bearing. Each of the first oil drain part may form a passage between the outer peripheral surface of the main bearing and the inner peripheral surface of the casing. Accordingly, as the oil drain path is formed along an edge of the compression part, which is outside of the compression chamber, a wide compression chamber may be secured inside of the compression part.

The first oil drain part may extend from a point axially downward from an upper end of the outer peripheral surface of the main bearing to a lower end of the outer peripheral surface of the main bearing. Accordingly, an upper surface of the main bearing may maintain a circular shape, and the upper surface of the main bearing may secure a large area to seat other components, such as a discharge muffler.

A radial width of a passage formed between the inner peripheral surface of the casing and the first oil drain part may be larger than a radial width of each of the second oil drain part. In this case, bottlenecks may be eliminated in an oil recovery process.

A surface of the first oil drain part and a surface of the second oil drain part may form a continuous flat or curved surface. Accordingly, due to a stepped structure, stagnation of oil may be prevented, and a flow of oil may be facilitated.

The second oil drain part may include a first drain inner surface forming the inner surface of the second oil drain part. The second oil drain part may include a second drain inner surface that faces the first drain inner surface by being spaced apart therefrom and is formed at a position closer to the inner peripheral surface of the casing than the first drain inner surface. The second oil drain part may include connecting inner surfaces that connect the first drain inner surface with the second drain inner surface. In this case, the second drain inner surface and the first oil drain part may form a continuous flat or curved surface.

A rim part or rim may be formed on the upper portion of the first oil drain part, with the rim part protruding radially toward the inner peripheral surface of the casing more than the first oil drain part.

A relationship among a radial distance L1 between the rim part and the inner peripheral surface of the casing, a radial distance L2 between the surface of the first oil drain part and the inner peripheral surface of the casing, a radial distance L3 between the first drain inner surface and the inner peripheral surface of the casing, and a radial distance L4 between the second drain inner surface and the inner peripheral surface of the casing may be $L3<L1<L2=L4$.

The rim part may be formed on the upper portion of the first oil drain part, with the rim part protruding radially toward the inner peripheral surface of the casing more than the first oil drain part. A relative ratio OH/BH of an axial height OH of the first oil drain part to a total axial height BH of the rim part and the first oil drain part may be 0.2 to 0.35.

The rim part may be formed on the upper portion of the first oil drain part, with the rim part protruding radially toward the inner peripheral surface of the casing more than the first oil drain part. The rim part may be spaced apart axially upward from the upper end of the second oil drain part. In this case, the first oil drain part may be formed between the rim part and the second oil drain part.

The rim part may be formed on the upper portion of the first oil drain part, with the rim part protruding radially toward the inner peripheral surface of the casing more than the first oil drain part. An edge of the rim part may have a circular shape, and the discharge muffler may be seated on an upper surface of the rim part.

A plurality of first oil drain part and a plurality of second oil drain part may each be disposed along a circumferential direction of the compression part.

Main fastening holes and cylinder fastening holes through which fasteners pass may be formed in the main bearing and the cylinder, respectively, along a circumferential direction thereof. The main fastening holes and the cylinder fastening holes may be axially connected to each other. The first oil drain part may be formed between the main fastening holes in the circumferential direction, and the second oil drain part may be formed between the cylinder fastening holes in the circumferential direction.

The plurality of main fastening holes through which the fasteners pass may be formed through the main bearing along the circumferential direction thereof. A center of each of the main fastening holes may be formed between the compression space and the first oil drain part in a radial direction.

The center of the main fastening hole and the first oil drain part may be spaced apart from each other along the circumferential direction of the main bearing.

An outer peripheral surface of the cylinder may be in close contact with the inner peripheral surface of the casing. Each of the outer peripheral surface of the main bearing and the outer peripheral surface of the sub-bearing may be spaced apart from the inner peripheral surface of the casing.

A diameter of the cylinder may be larger than a diameter of each of the main bearing and the sub-bearing. The first oil drain part may be formed in each of the main bearing and the sub-bearing. The second oil drain part may be formed in the cylinder.

The first oil drain part may be formed on the outer peripheral surface of the main bearing, which faces the inner peripheral surface of the casing, by being recessed inward in the radial direction of the main bearing.

The first oil drain part may be continuous from an upper end of the outer peripheral surface of the main bearing to a lower end of the outer peripheral surface of the main bearing.

The first oil drain part may have an equal cross-sectional shape along the axial direction.

The rim part may be formed on the upper portion of the first oil drain part, with the rim part protruding radially toward the inner peripheral surface of the casing more than the first oil drain part. An axial height of the first oil drain part may be lower than an axial height of the rim part.

The first oil drain part may be formed in the main bearing, and the second oil drain part may be formed in the cylinder. The oil drain path may include a first passage formed between the upper part of the outer peripheral surface of the main bearing and the inner surface of the casing, a second passage formed by the first oil drain part, and a third passage formed by the second oil drain part.

The first oil drain part may include a main oil drain part or portion formed in the main bearing, and a sub-oil drain part or portion formed in the sub-bearing. In this case, the main oil drain part and the sub-oil drain part may form the oil drain path via the second oil drain part.

The sub-oil drain part may extend from a point axially upward from the lower end of the outer peripheral surface of the sub-bearing to the upper end of the outer peripheral surface of the sub-bearing. The sub-oil drain part may extend from the upper end of the outer peripheral surface of the sub-bearing to the lower end thereof.

A circumferential width of the first oil drain part may be equal to a circumferential width of the second oil drain part. The outer peripheral surface of the main bearing may overlap an entirety or a portion of the second oil drain part in the radial direction.

The upper surface edge of the main bearing or the lower surface edge of the sub-bearing may have a circular shape. The discharge muffler may be seated on the upper surface of the main bearing or the lower surface of the sub-bearing.

The oil drain path may include a first path formed between the outer peripheral surface of the main bearing and the inner peripheral surface of the casing, a second path formed by axially penetrating the cylinder and connected to the first path, and a third path formed between the outer peripheral surface of the sub-bearing and the inner peripheral surface of the casing and connected to the second path. In this case, at least one of the first path or the third path may be configured such that parts or portions having different radial widths of a first bearing or the second bearing are axially arranged.

The oil drain path may include the first passage formed between the upper end part of the outer peripheral surface of the main bearing and the inner peripheral surface of the casing, the second passage formed at a side axially downward than the upper end part and formed between the outer peripheral surface of the main bearing and the inner peripheral surface of the casing, with the second passage being wider in the radial direction than the first passage, and the third passage formed by axially penetrating the cylinder.

The compressor as described above may have at least the following advantages.

According to embodiments disclosed herein, the main bearing, the sub-bearing, and the cylinder forming the compression portion may have a continuous oil drain path formed along the axial direction. The oil drain path may be formed along the edge of the compression portion, allowing oil inside of the compressor to be efficiently recovered. Through the oil drain path, an oil recovery rate may be increased, and components inside of the compressor may be efficiently lubricated by oil, thereby increasing lubrication performance and operational reliability.

In addition, according to embodiments disclosed herein, as the oil drain path is formed along the edge of the compression portion, which is outside of the compression chamber, a wide compression chamber may be secured inside of the compression portion. Accordingly, along with securing the wide compression chamber, the oil drain path may also be formed to be wide.

In addition, according to embodiments disclosed herein, the oil drain path may have structure recessed radially from the side of the compression portion. Accordingly, even when outer diameters of components that form the compression portion are similar to each other, the oil drain path may be prevented from being narrowed by interference between the components.

In addition, according to embodiments disclosed herein, even if the outer diameters of components forming the compression portion are similar to each other and a hole (the second oil drain part) forming the oil drain path is axially covered by another component, the radially recessed portion (the first oil drain part) may axially connect the oil drain path. Accordingly, in order not to cover a hole for oil recovery, there is no need to complicate the shape of another component, such as the main bearing, and structure of the compression portion may be implemented to be simple.

In addition, according to embodiments disclosed herein, the first oil drain part, which is a portion of the oil drain path, may be formed by being recessed radially from the compression portion, and the second oil drain part, which is another portion of the oil drain path, may be formed by axially penetrating the compression portion. The first oil drain part may provide a wide oil recovery passage through a recessed structure, and a portion in which the second oil drain part is formed may maintain a circular edge, thereby providing a continuous contact surface between the outer peripheral surface of the compression portion and the inner peripheral surface of the casing. Accordingly, the compression portion may be stably mounted inside of the casing.

In particular, the upper surface of a component that maintains a circular shape, for example, the main bearing, may also be circular, and accordingly, a wide mounting surface for the discharge muffler may be formed on the upper surface of the main bearing. Accordingly, there is no need to complicate the shape of the discharge muffler to mount the discharge muffler on the upper surface of the main bearing, and the structure of the compression portion may be simple.

In addition, as the oil drain path is formed on the edge of the compression portion, oil may be recovered more effectively while the oil flows in the radial direction of the rotor by the rotational force of the rotor, thereby improving lubrication performance and operational reliability of the compression portion.

In addition, even when the diameter of the main bearing (or the sub-bearing) is increased to make the compression space large and shield the compression space, the first oil drain part recessed on the edge of the main bearing (or the sub-bearing) may provide a wide passage to the second oil drain part of the cylinder. Accordingly, even if eco-friendly refrigerants are applied to the compressor, reduction in compression performance or oil recovery rate may be prevented.

In addition, according to embodiments disclosed herein, a radial width of a passage formed between the inner peripheral surface of the casing and the first oil drain part may be larger than the radial width of a passage formed by the second oil drain part. In this case, a bottleneck in an oil flow during the process of oil passing from the first oil drain part to the second oil drain part may be eliminated, thereby enabling smoother oil recovery.

In addition, according to embodiments disclosed herein, the first oil drain part and the second oil drain part forming the oil drain path may have a flat or curved surface continuous with each other. Accordingly, oil may flow smoothly along surfaces of the first oil drain part and the second oil drain part, and oil recovery may be performed effectively.

In addition, according to embodiments disclosed herein, the axial height of the first oil drain part to the total axial height of the main bearing, which is an example of a part in which the first oil drain part is formed, may be 0.2 to 0.35. In this case, while a portion of the main bearing maintains a circular shape, the height of an oil film may be maintained to be the appropriate height or more of the compression portion, thereby facilitating lubrication of the compression portion.

Further, according to embodiments disclosed herein, the oil drain path may be formed between the fastening holes for fastening the compression portion. In this case, the fastening holes may be disposed adjacent to the edge of the compression portion while avoiding interference between the fastening holes and the oil drain path. Accordingly, a wide compression chamber may be secured in the center of the compression portion, and compression capacity may be increased.

In addition, according to embodiments disclosed herein, the rim may be formed on the upper end of the outer peripheral surface of the main bearing, and the first oil drain part may be formed on the lower portion of the rim. In this case, the upper surface of the rim may maintain a circular shape, and thus, may provide a large area in which the discharge muffler having a circular shape may be seated. Accordingly, due to the first oil drain part, the discharge muffler may not be required to be changed into a complex shape, and compatibility of the compressor may be increased.

In addition, a stepped structure may be formed between the rim and the first oil drain part, and thus, a large oil contact area may be formed. In this case, the amount of oil floating inside of the compressor may be reduced.

Additionally, according to embodiments disclosed herein, the first oil drain part and the second oil drain part may be connected to each other to be radially misaligned from each other. In this case, the oil drain path may be formed by mixing an axial path and a radial path, and secure a wider oil contact area, thereby reducing the amount of oil floating inside of the compressor and increasing an oil recovery rate.

In addition, according to embodiments disclosed herein, the first oil drain part may be formed along the outer peripheral surface of the compression portion and thus may have a larger volume compared to when the first oil drain part is formed in the center part of the compression portion. This may provide a larger oil storage space inside of the compressor and reduce the amount of oil leaking out of the compressor.

In addition, according to embodiments disclosed herein, the first oil drain part may have a structure recessed radially on the outer peripheral surface of the compression portion, so the first oil drain part may have a simple shape and be easily processed. Further, due to this simple structure, the first oil drain part may require reduced manufacturing costs for processing and may be advantageous for mass production.

The above description is merely an illustrative explanation of the technical idea. Various modifications and variations may be made without departing from the essential characteristics by those skilled in the art to which the embodiments belong. Accordingly, the embodiments disclosed are intended to illustrate rather than limit the technical idea, and the scope of the technical idea may not be limited by the embodiments. The scope of protection should be interpreted by the claims below, and all technical ideas within the equivalent scope should be interpreted as being included in the scope of the claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, for example, may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," for example, means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a casing;

an electric drive that is disposed inside of the casing and rotates a rotational shaft;

a compression portion disposed inside of the casing and comprises a cylinder, a main bearing, and a sub-bearing which together define a compression space;

a discharge muffler disposed above the compression portion;

at least one first oil drain portion recessed radially inward on an outer peripheral surface of the main bearing;

at least one second oil drain portion formed by axially penetrating the cylinder, wherein the at least one first oil drain portion and the at least one second oil drain portion communicate with each other in an axial direction to form an oil drain path; and a rim formed on an upper portion of the outer peripheral surface of the main bearing, the rim protruding radially toward an inner peripheral surface of the casing more than the at least one first oil drain portion, wherein an upper surface of the rim has the discharge muffler seated thereon, and wherein the at least one first oil drain portion, the rim, and the discharge muffler have an overlapping region in the axial direction.

2. The compressor of claim 1, wherein the at least one first oil drain portion forms a passage between the outer peripheral surface of the main bearing and the inner peripheral surface of the casing.

3. The compressor of claim 2, wherein the at least one first oil drain portion extends from a point axially downward from an upper end of the outer peripheral surface of the main bearing to a lower end of the outer peripheral surface of the main bearing.

4. The compressor of claim 1, wherein a radial width of a passage formed between the inner peripheral surface of the casing and the at least one first oil drain portion is larger than a radial width of the at least one second oil drain portion.

5. The compressor of claim 1, wherein a surface of the at least one first oil drain portion and a surface of the at least one second oil drain portion form a continuous flat or curved surface.

6. The compressor of claim 1, wherein the at least one second oil drain portion comprises:

a first drain inner surface forming an inner surface of the at least one second oil drain portion;

a second drain inner surface that faces the first drain inner surface, is spaced apart therefrom, and is formed at a position closer to the inner peripheral surface of the casing than the first drain inner surface; and connecting inner surfaces that connect the first drain inner surface with the second drain inner surface, wherein the first drain inner surface and the at least one first oil drain portion form a continuous flat or curved surface.

7. The compressor of claim 6, wherein a relationship among a radial distance L1 between the rim and the inner peripheral surface of the casing, a radial distance L2 between a surface of the at least one first oil drain portion and the inner peripheral surface of the casing, a radial distance L3 between the second drain inner surface and the inner peripheral surface of the casing, and a radial distance L4 between the first drain inner surface and the inner peripheral surface of the casing is $L3<L1<L2=L4$.

8. The compressor of claim 6, wherein a relationship among a radial distance L1 between the rim and the inner peripheral surface of the casing, a radial distance L2 between a surface of the at least one first oil drain portion and the inner peripheral surface of the casing, and a radial distance L3 between the second drain inner surface and the inner peripheral surface of the casing is $L3<L1<L2$.

9. The compressor of claim 6, wherein each of the connecting inner surfaces is formed to have a curved surface.

10. The compressor of claim 1, wherein a relative ratio OH/BH of an axial height OH of the at least one first oil drain portion to a total axial height BH of the rim and the at least one first oil drain portion is 0.2 to 0.35.

11. The compressor of claim 1, wherein the rim is spaced apart upward axially from an upper end of the at least one second oil drain portion, and wherein the at least one first oil drain portion is formed between the rim and the at least one second oil drain portion.

12. The compressor of claim 1, wherein the at least one first oil drain portion comprises a plurality of first oil drain portions and the at least one second oil drain portion comprises a plurality of second oil drain portions, and wherein each of the plurality of first oil drain portions and each of the plurality of second oil drain portions are disposed along a circumferential direction of the compression portion and communicate with each other in the axial direction.

13. The compressor of claim 1, wherein main fastening holes and cylinder fastening holes through which fasteners pass are formed in the main bearing and the cylinder, respectively, and wherein the at least one first oil drain portion is formed between the main fastening holes along a circumferential direction, and the at least one second oil drain portion is formed between the cylinder fastening holes along the circumferential direction.

14. The compressor of claim 1, wherein a plurality of main fastening holes through which fasteners pass is formed through the main bearing along a circumferential direction thereof, and wherein a center of each of the main fastening holes is formed between the compression space and the at least one first oil drain portion in a radial direction.

15. The compressor of claim 14, wherein the center of the main fastening hole and the at least one first oil drain portion are spaced apart from each other along the circumferential direction of the main bearing.

16. The compressor of claim 1, wherein an outer peripheral surface of the cylinder is in close contact with the inner peripheral surface of the casing, and wherein each of the outer peripheral surface of the main bearing and an outer peripheral surface of the sub-bearing is spaced apart from the inner peripheral surface of the casing.

17. The compressor of claim 1, wherein a diameter of the cylinder is larger than a diameter of each of the main bearing and the sub-bearing, wherein the at least one first oil drain portion is formed in each of the main bearing and the sub-bearing, and wherein the at least one second oil drain portion is formed in the cylinder.

18. The compressor of claim 1, wherein the at least one first oil drain portion is formed on the outer peripheral surface of the main bearing, which faces the inner peripheral surface of the casing, by being recessed inward in a radial direction of the main bearing.

19. The compressor of claim 1, wherein the at least one first oil drain portion is axially continuous from an upper end of the outer peripheral surface of the main bearing to a lower end of the outer peripheral surface of the main bearing.

20. The compressor of claim 1, wherein each of the at least one first oil drain portion and the at least one second oil drain portion has an equal cross-sectional shape along the axial direction.

21. The compressor of claim 1, wherein an axial height of the at least one first oil drain portion is lower than an axial height of the rim.

22. The compressor of claim 1, wherein the oil drain path comprises:

a first passage formed between an upper portion of the outer peripheral surface of the main bearing and the inner peripheral surface of the casing;

a second passage formed by the at least one first oil drain portion; and a third passage formed by the at least one second oil drain portion.

23. The compressor of claim 1, wherein the at least one first oil drain portion comprises:

a main oil drain portion formed in the main bearing; and a sub-oil drain portion formed in the sub-bearing, wherein the main oil drain portion and the sub-oil drain portion form the oil drain path with the at least one second oil drain portion.

24. The compressor of claim 1, wherein a sub-oil drain portion extends from a point axially upward from a lower end of an outer peripheral surface of the sub-bearing to an upper end of the outer peripheral surface of the sub-bearing.

25. The compressor of claim 1, wherein a sub-oil drain portion extends along the axial direction from an upper end of an outer peripheral surface of the sub-bearing to a lower end thereof.

26. The compressor of claim 1, wherein a circumferential width of the at least one first oil drain portion is equal to a circumferential width of the at least one second oil drain portion.

27. The compressor of claim 1, wherein the outer peripheral surface of the main bearing overlaps the at least one second oil drain portion in a radial direction.

28. The compressor of claim 1, wherein an upper surface edge of the main bearing or a lower surface edge of the sub-bearing has a circular shape, and wherein the discharge muffler is seated on an upper surface edge of the main bearing or the lower surface edge of the sub-bearing.

29. A compressor, comprising:

a casing;

an electric drive that is disposed inside of the casing and rotates a rotational shaft;

a compression portion that is disposed inside of the casing and comprises a cylinder, a first bearing, and a second bearing which together define a compression space;

a discharge muffler disposed above the compression portion; and an oil drain path formed between an outer peripheral surface of the compression portion and an inner peripheral surface of the casing, wherein the oil drain path comprises:

a first path formed between an outer peripheral surface of the first bearing and the inner peripheral surface of the casing, a second path formed by a first oil drain portion recessed radially inward on the outer peripheral surface of the first bearing, and a third path formed by a second oil drain portion penetrating axially through the cylinder, wherein a rim is formed on an upper portion of the outer peripheral surface of the first bearing, the rim protruding radially toward the inner peripheral surface of the casing more than the first oil drain portion, wherein an upper surface of the rim has the discharge muffler seated thereon, and wherein the first oil drain portion, the rim, and the discharge muffler have an overlapping region in an axial direction.

30. A compressor, comprising:

a casing;

an electric drive that is disposed inside of the casing and rotates a rotational shaft;

a compression portion that is disposed inside of the casing and comprises a cylinder, a main bearing, and a sub-bearing which together define a compression space;

a discharge muffler disposed above the compression portion; and an oil drain path which is formed between an outer peripheral surface of the compression portion and an inner peripheral surface of the casing, wherein an outer diameter of the cylinder is greater than each of an outer diameter of the main bearing and an outer diameter of the sub-bearing, and wherein the oil drain path comprises:

a first passage formed between an upper end portion of an outer peripheral surface of the main bearing and the inner peripheral surface of the casing, a second passage formed by a first oil drain portion recessed radially inward on the outer peripheral surface of the main bearing, and a third passage formed by axially penetrating the cylinder, wherein a rim is formed on an upper end of the outer peripheral surface of the main bearing, the rim protruding radially toward the inner peripheral surface of the casing more than the first oil drain portion, wherein an upper surface of the rim has the discharge muffler seated thereon, and wherein the first oil drain portion, the rim, and the discharge muffler have an overlapping region in an axial direction.

* * * * *